US011135470B2

(12) United States Patent
Monti

(10) Patent No.: US 11,135,470 B2
(45) Date of Patent: Oct. 5, 2021

(54) EXERCISE APPARATUS

(71) Applicant: Jonathan Monti, Newport, RI (US)

(72) Inventor: Jonathan Monti, Newport, RI (US)

( * ) Notice: Subject to any disclaimer, the term of this patent is extended or adjusted under 35 U.S.C. 154(b) by 0 days.

(21) Appl. No.: 16/266,884

(22) Filed: Feb. 4, 2019

(65) Prior Publication Data

US 2019/0168062 A1 Jun. 6, 2019

Related U.S. Application Data

(63) Continuation-in-part of application No. 15/266,589, filed on Sep. 15, 2016, now Pat. No. 10,195,478.

(Continued)

(51) Int. Cl.

*A63B 21/00* (2006.01)
*A63B 21/02* (2006.01)

(Continued)

(52) U.S. Cl.

CPC .... *A63B 21/4001* (2015.10); *A63B 21/00069* (2013.01); *A63B 21/023* (2013.01); *A63B 21/025* (2013.01); *A63B 21/068* (2013.01); *A63B 21/4009* (2015.10); *A63B 21/4029* (2015.10); *A63B 21/4033* (2015.10); *A63B 21/4047* (2015.10); *A63B 23/0211* (2013.01); *A63B 23/03525* (2013.01); *A63B 23/12* (2013.01); *A63B 23/1236* (2013.01); *A63B 21/00076* (2013.01); *A63B 21/0085* (2013.01); *A63B 21/00181* (2013.01); *A63B 21/0552* (2013.01); *A63B 23/0216* (2013.01); *A63B 2208/0214* (2013.01); *A63B 2208/0242* (2013.01); *A63B 2208/0247* (2013.01); *A63B 2208/0252* (2013.01);

(Continued)

(58) Field of Classification Search

CPC ..... A63B 21/00069; A63B 21/00076; A63B 21/00181; A63B 21/0085; A63B 21/023; A63B 21/025; A63B 21/0552; A63B 21/068; A63B 21/4001; A63B 21/4009; A63B 21/4029; A63B 21/4033; A63B 21/4047; A63B 23/0211; A63B 23/0216; A63B 23/03525; A63B 23/12; A63B 23/1236; A63B 69/0058

See application file for complete search history.

(56) References Cited

U.S. PATENT DOCUMENTS 5,545,114 A * 8/1996 Gvoich ..... A63B 21/055 482/123
6,387,024 B1 * 5/2002 Monti ..... A63B 21/4035 482/142

(Continued)

*Primary Examiner* — Megan Anderson
(74) *Attorney, Agent, or Firm* — Bay State IP, LLC

(57) ABSTRACT

A piece of exercise equipment particularly for improved strength training exercises. More particularly, the invention relates to equipment that allows the user to vary tension when performing different exercises. The present invention is specifically designed for improved exercise through the variability of a tension component for use in such exercises as the plank exercise, sit-ups, push-ups and supine pull-ups that includes a core support, a guide arm, a head support, and a foot support that work in conjunction to most optimally support the user. The core support, the head support and the foot support are all connected, supported, and elevated from the floor by a central support system.

14 Claims, 85 Drawing Sheets

Related U.S. Application Data

(60) Provisional application No. 62/218,872, filed on Sep. 15, 2015.

(51) Int. Cl.

| | |
|---|---|
| ***A63B 23/12*** | (2006.01) |
| ***A63B 23/035*** | (2006.01) |
| ***A63B 21/068*** | (2006.01) |
| ***A63B 23/02*** | (2006.01) |
| *A63B 21/055* | (2006.01) |
| *A63B 21/008* | (2006.01) |

(52) U.S. Cl.

CPC ..... *A63B 2208/0257* (2013.01); *A63B 2208/0261* (2013.01); *A63B 2208/0266* (2013.01); *A63B 2208/0295* (2013.01); *A63B 2210/50* (2013.01); *A63B 2225/09* (2013.01); *A63B 2225/093* (2013.01); *A63B 2225/102* (2013.01)

(56) References Cited

U.S. PATENT DOCUMENTS

| | | | | |
|---|---|---|---|---|
| 6,932,749 | B2 * | 8/2005 | Barnes | A63B 23/03525 482/142 |
| 7,806,815 | B2 * | 10/2010 | Fernandez | A63B 21/4047 482/140 |
| 9,101,792 | B2 * | 8/2015 | Ho | A63B 23/0211 |
| 9,782,619 | B2 * | 10/2017 | Wang | A63B 21/4033 |
| D816,784 | S * | 5/2018 | Monti | D21/690 |
| 9,968,825 | B2 * | 5/2018 | Snyder | A63B 23/0211 |
| 2014/0274617 | A1 * | 9/2014 | Ho | A63B 21/154 482/140 |
| 2015/0375036 | A1 * | 12/2015 | Ho | A63B 21/4031 482/140 |

* cited by examiner

EXERCISE APPARATUS

CROSS REFERENCE TO RELATED APPLICATION

This application is a continuation-in-part and takes priority from and claims the benefit of U.S. patent application Ser. No. 15/266,589, filed on Sep. 15, 2016, the contents of which are herein incorporated by reference.

BACKGROUND OF THE INVENTION

Field of the Invention

The present invention relates generally to exercise equipment for improved, and highly efficient strength training exercises. More particularly, the invention relates to equipment that allows the user to vary tension when performing different body weight resistive exercises.

Description of the Related Art

Currently, and as has been the case for decades, many types of exercise equipment exist and are used for maintaining a healthy lifestyle, getting back into shape, rehabilitation and various other physical fitness purposes. Some of the existing equipment attempts to limit the strain on the body of the user in performing certain exercises. Certain concurrent equipment improves the user's ability to perform certain exercises, improvement to increase support to the user while simultaneously allowing the user to perform certain exercises in a more efficient and effective way with less strain on their body and increased stability. Devices that can be used for broad range of types of push-ups are great resources in this capacity.

Furthermore, devices that would work in concert with these broad range of push-ups devices and thus allows users to perform static and semi-static exercises such as the plank, bird dog and downward dog off the floor in a comfortable, inviting, safe and highly efficient manner are concurrently are highly desirable. Also, devices that allow a user to be positioned upright upon completion of the exercise circuit and not prone on the floor are concurrently are highly desirable.

Further desirable are devices that allow a user to influence the look and strength of their abdominal muscles without having to use a specific and targeting sit-up type device as well as devices that can measure and verify push-ups for push-up testing in military, police and fire training, applications. Additionally, important are machines that allow the user to adjust the provided tension for an exercise with greater ease but still provide varied tension levels for different user ability level as well as allowing for a choice of difficulty level, while varying exercise routines in an innovative way to perform both progressive and regressive body weight resistance exercises.

SUMMARY OF THE INVENTION

The instant apparatus and system, as illustrated herein, is clearly not anticipated, rendered obvious, or even present in any of the prior art mechanisms, either alone or in any combination thereof. A versatile system, method and series of apparatuses for creating and utilizing an exercise device and performing a series of health cultivating exercises. The system affords the user the ability to change exercises in a quick and efficient manner.

It is therefore an object of the present invention to provide exercise equipment that is specifically designed for improved exercise through the variability of a tension component for use in such body weight resistive exercises as planks, sit-ups, push-ups, bird dog, half boat and downward dog yoga poses and supine pull ups.

It is an object of the system to provide the safe, efficient, and inviting device known today for performing, plank, push-up, bird dog, yoga half boat, and supine pull-up exercises. It is an object of the system to add to the challenge, experience and effect of common exercise movements such the downward dog. It is an object of the system to allow the user to work through fatigue while doing progressive or regressive body weight resistance exercises.

It is an object to provide a "real technology" for affecting the abdominal musculature as well as an exercise technology that provides a psychological component wherein a user has a goal to get to a level where they can perform added load exercise a state where the body sees the greatest and most efficient changes. It is an object to provide a system and a method wherein a user starts with assistance and has the ultimate goal to get to added load.

It is an object of the system to have a configuration that utilizes less core parts, possesses the structural integrity of a commercial piece of equipment, but yet is very light in its construction. Further to this point, different methods of fusing metal together may be able to be employed in its construction.

It is an additional object to provide an exercise technology that allows a user to experience benefits and changes in the body with a very small amount of exercise in a very short amount of time per exercise session. It is an object that the technology provides a very significant improvement for a device that can measure, and verify push-up testing for military, police and fire applications. It is an objective to introduce a system wherein that the supportive force applied to the user during static exercises also allows the exercises to be performed in semi-static fashion.

Structurally, an objective of the instant system includes providing a core support, a guide arm, a head of machine support, a foot support and a central support system wherein the core support comprises a body support pad and is attached to the guide arm at a fulcrum and through a force component. At one end of the core support, the core support is telescopically attached to the head of machine support which comprises a safety pad and at least two handlebars. At the opposite end, the core support is telescopically attached to the foot support which comprises of a foot pad, a foot element for resistance and/or support, and a foot element positioner. The core support, the head of machine support and the foot support are all connected to and supported by a central support beam having legs.

It is a further object that the system to store energy to counterbalance the user during certain static pose exercises, such as the plank, birddog, and yoga half boat and downward dog exercise. It is an object that the placement of the safety pad provides improved support to the user during certain static exercises. It is an object of the system that the placement of the safety pad is integral in the operation of machine, in setting up for exercises and getting off of the machine.

It is an object of the system to provide a foot element support and restraining member to augment performance of certain exercises on the machine, specifically contributing to the user's ability to perform improved closed kinetic chain exercises by providing additional support and stability, while ensuring the user's safety while performing the exercises.

It is an object of the instant system to provide a head support including telescoping capabilities in order to allow the user to perform plank and push-up exercises with different angles employed in the shoulder as the user connects to the plank pad or handles of the machine through the arms.

A further object is to introduce a system wherein the combination of the positions of a safety pad and foot element assist the user in maintaining the correct posture for certain exercises. It is an object of the system that the placement of a fulcrum is ideal for closed kinetic chain exercises, specifically plank, push-up and supine pull-up exercises. It is an object of the system that the fulcrum may be strategically positioned so there is no need to make any adjustments as the user switches from one exercise to another.

It is an object of the system to introduce a guide arm that assists the user in maintaining proper positioning while performing certain exercises, such as preventing the user's back to sag during a plank exercise, additionally, preventing the user from maintaining a cheat like pose with their derriere in the air.

Further, it is an object of the system to introduce a guide arm that is located in the center of the apparatus, such that a user has sufficient freedom to move his or her legs forward, such as in a mountain climber plank exercise.

It is an additional object of the system to introduce a force component wherein minor adjustments to the force component will allow the user to move from level to level or set to set with not too much neuromuscular shock to the body, therefore, making it so this difference in levels is not too great or noticeable, and still therefore will not create a heightened sense of fatigue too quickly during any bout of exercise.

A further object of the system is to provide the user various levels of resistance, counterbalance, and/or added load depending on the type of exercise the user is doing. It is an object additionally, in the alternative, to provide a system wherein large changes in the force component will cause great stress to the neuromuscular system and therefore create a greater challenge to a user, as would be highly appreciated by elite athletes and those looking to shock their muscles.

It is an object of the system that the raised position of the core support relative to the floor allows the user to improve the level and benefits of certain exercises by providing the user the ability to incorporate a greater range of motion during the exercise. An example of this would be the user having the ability to move their leg past parallel when doing a one footed push-up or plank exercise. Or, a dynamic bird dog exercise with assistance or added load.

It is an object of the system that the raised position of the core support relative to the ground surface, as provided by the system, allows the user to activate additional muscle groups when performing certain exercises. An example of this is when a user does sit-up type exercises with one foot on the floor and one up in the machine, and thus the oblique muscles can be affected from either side when a twist is incorporated.

It is an object of the system that the raised position of the core support relative to the floor allows the user to more easily get on and/or off of the machine. It is an object of the system that the guide arm may positioned in different positions depending on the user's choice of exercise.

It is an object of the system to introduce a machine that assists and allows the user to laterally move the torso while performing sit-up exercises, that it is perfectly suited for angular oblique sit-up exercises and is foldable to be more easily stored and carried.

There has thus been outlined, rather broadly, the more important features of the exercise equipment embodiments in order that the detailed description thereof that follows may be better understood, and in order that the present contribution to the art may be better appreciated. There are additional features of the system, accompanying methods and apparatuses that will be described hereinafter and which will form the subject matter of the claims appended hereto.

In this respect, before explaining at least one embodiment of the system, accompanying methods and apparatuses in detail, it is to be understood that the system, accompanying methods and apparatuses are not limited in application to the details of construction and to the arrangements of the components set forth in the following description or illustrated in the drawings. The system, accompanying methods and apparatuses are capable of other embodiments and of being practiced and carried out in various ways. Also, it is to be understood that the phraseology and terminology employed herein are for the purpose of description and should not be regarded as limiting.

These together with other objects of the system, accompanying methods and apparatuses, along with the various features of novelty, which characterize the invention, are pointed out with particularity in the claims annexed to and forming a part of this disclosure. For a better understanding of the system, its operating advantages, and the specific objects attained by its uses, reference should be made to the accompanying drawings and detailed descriptive matter in which there are illustrated several embodiments of the system.

BRIEF DESCRIPTION OF THE DRAWINGS

Advantages of the present invention will be apparent from the following detailed description of exemplary embodiments thereof, description should be considered in conjunction with the accompanying drawings, in which having thus described the invention in general terms, reference will now be made to the accompanying drawings, which are not necessarily drawn to scale, and wherein:

FIG. 1 is a perspective view of exercise equipment;

DETAILED DESCRIPTION OF THE SEVERAL EMBODIMENTS

Figure 1A:
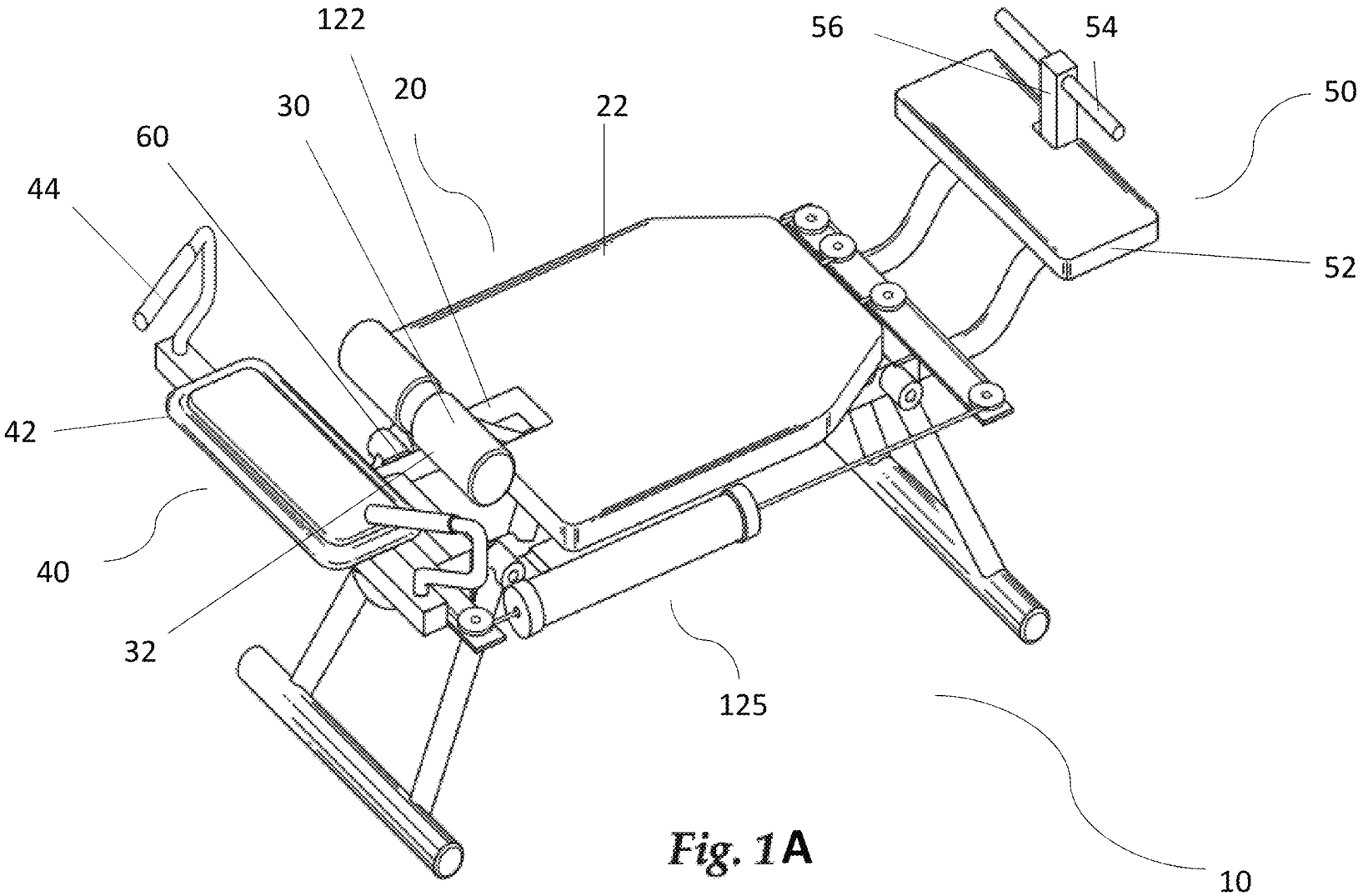
FIG. 1A is a perspective view of the exercise equipment without a retractable harness.

FIG. 1 is a perspective view of exercise equipment 10. The exercise machine 10, also a system and series of apparatuses, may comprise three main support and utilization members, namely at least one core support 20, at least one head support 40, at least one foot support 50, and at least two legs 64. The exercise equipment 10 is a main support frame 60 which supports the three main support members 20, 40, 50. The head support 40, more closely depicted in FIGS. 8-10, consists of a plank support pad 42 and handlebars 44. The position of the handlebars 44 may be adjusted by the user depending on the type of exercise desired. The foot support 50, more closely depicted in FIGS. 11-13, consists of a foot pad 52, a foot element 54, and a foot element positioner 56.

Figure 14:
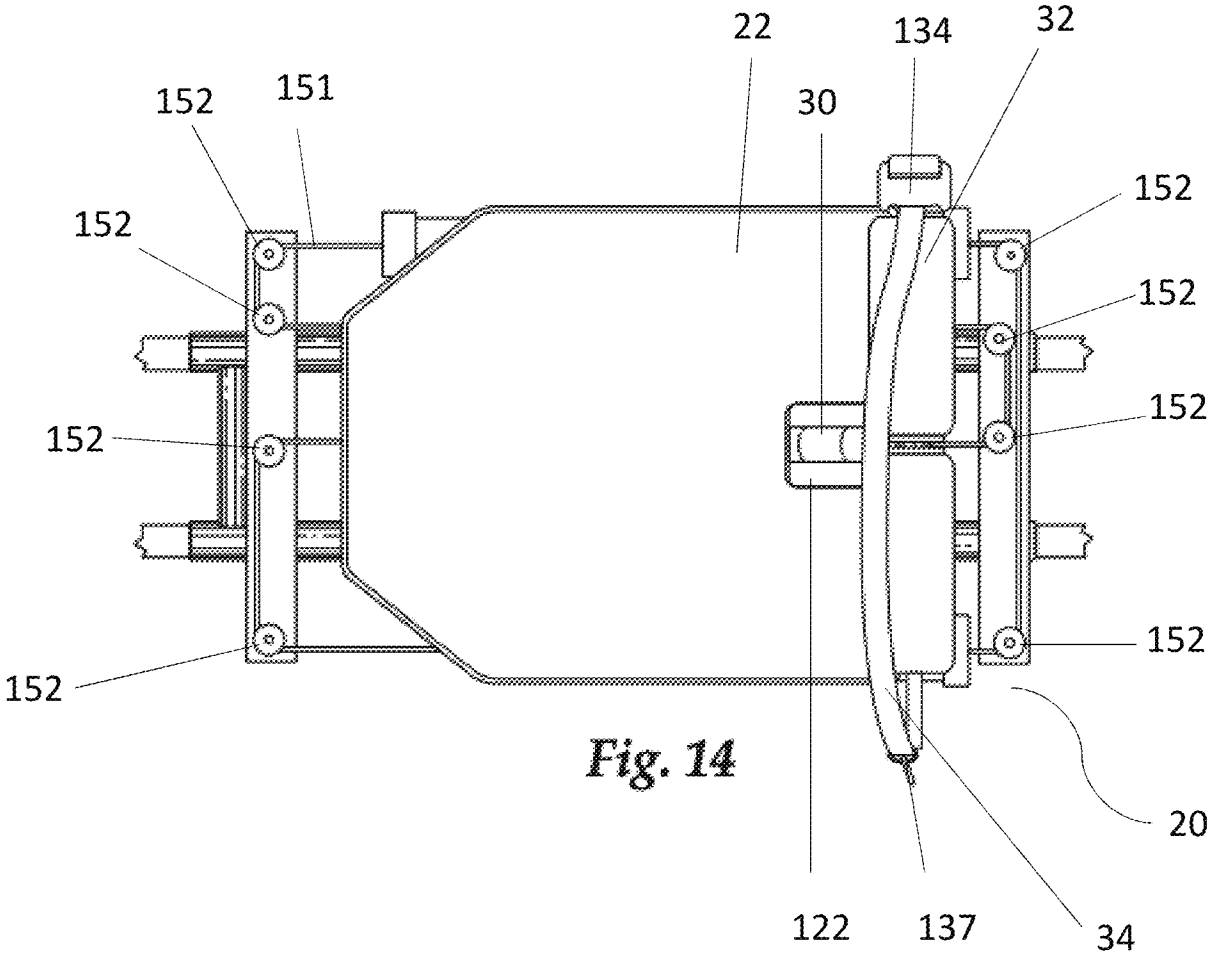
FIG. 14 is a partial top view of the core support.
Figure 15:
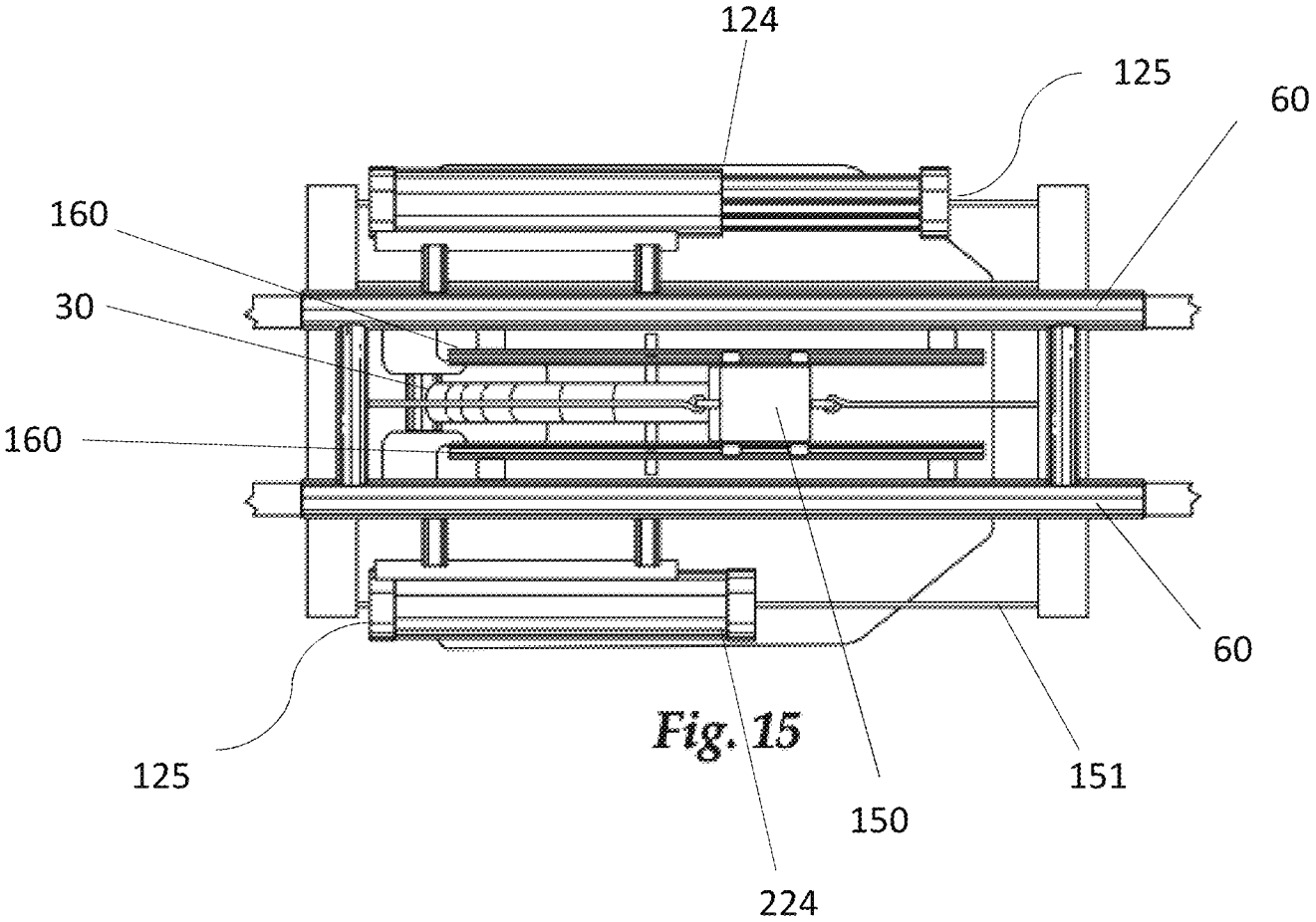
FIG. 15 is a partial bottom plan view of the core support.
Figure 16:
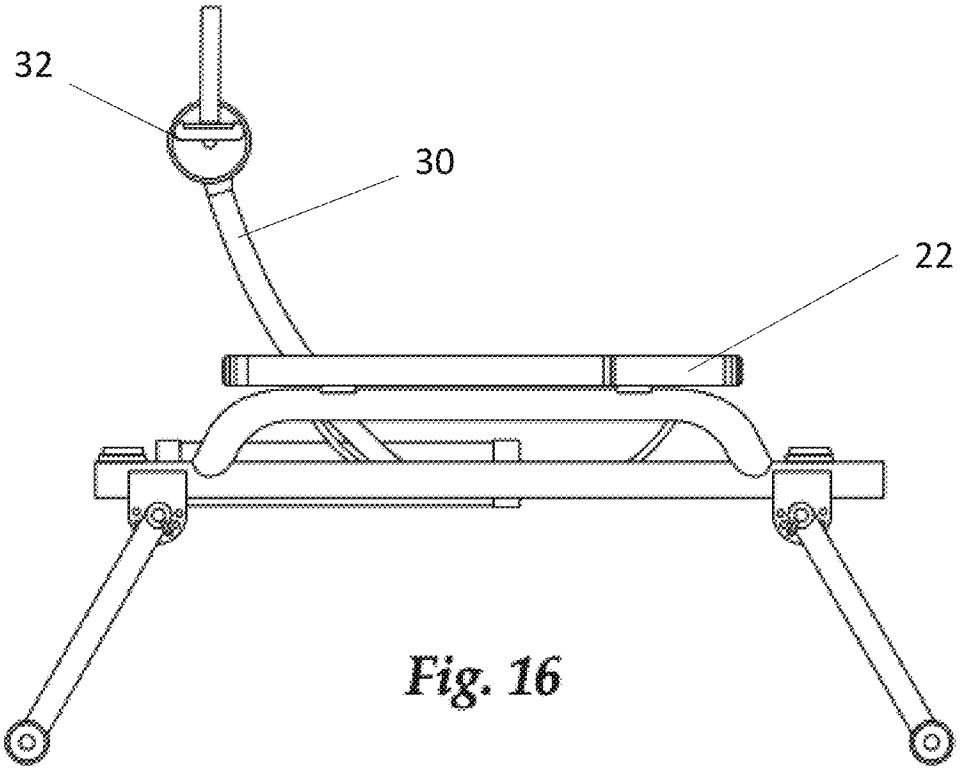
FIG. 16 is a partial front side view of the core support.

The core support 20, more closely depicted in FIGS. 14-16, may comprise a body support pad 22, a guide arm 30 and a guide arm pad 32, and a retractable harness 34. The guide arm 30 is connected to the core support 20 by at least one fulcrum 26 that allows the guide arm 30 to move with the user. The guide arm is connected by at least one fulcrum 26 to the center of the core support 20 and can be extended upwards through a groove 122 in the body support pad 22. In another embodiment, the guide arm 30 is also connected to a force component 125 that can be varied and adjusted according to the user. The force component 125 is depicted more closely in FIGS. 20, 20A, and 21.

FIG. 1A is a perspective view of the exercise equipment shown in FIG. 1. In this embodiment, the machine does not have the retractable harness.

Figure 1B:
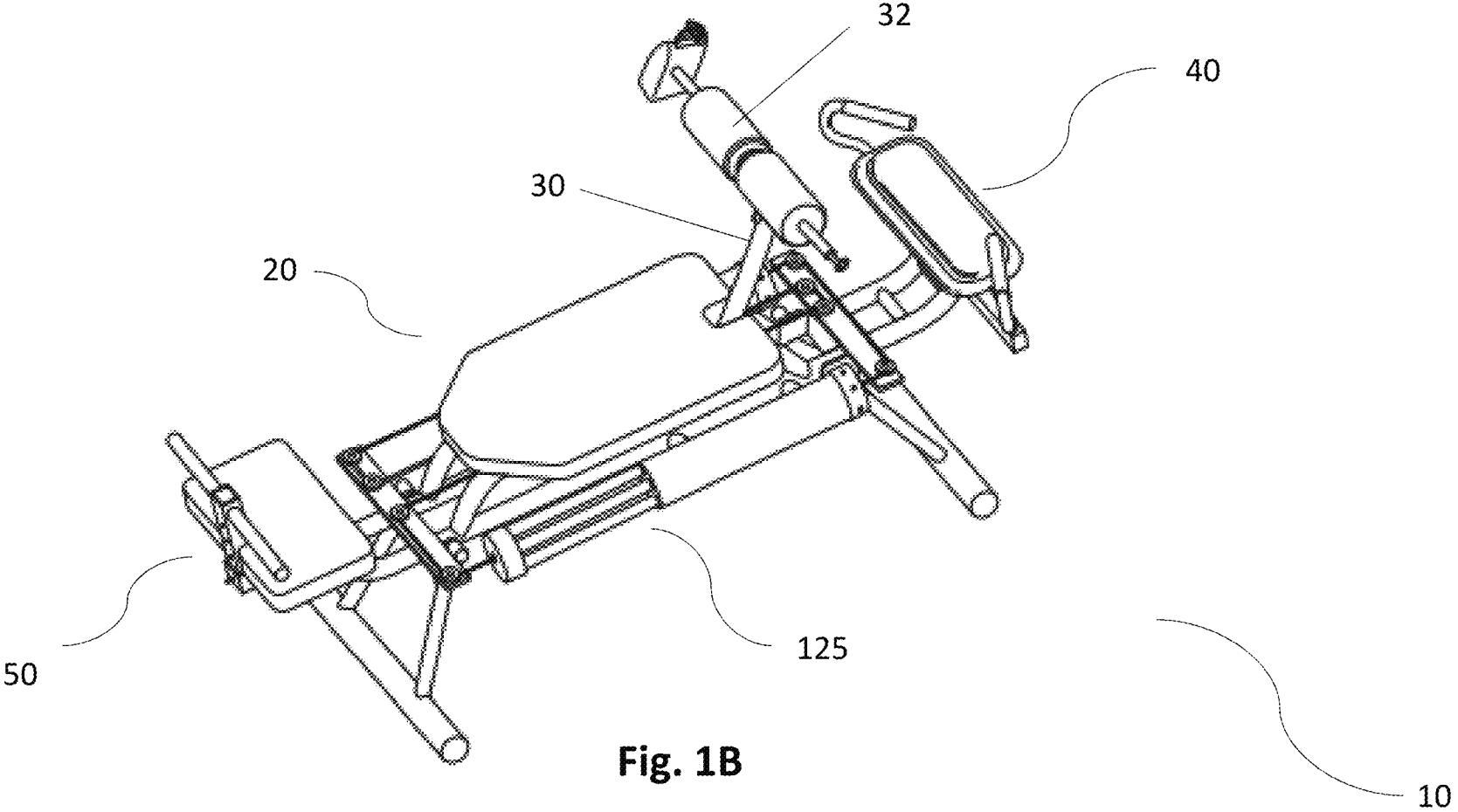
FIG. 1B is a perspective view of the exercise equipment with the guide arm up.

FIG. 1B is a perspective view of the exercise equipment as shown in FIG. 1. In illustration the guide arm is up.

Figure 2:
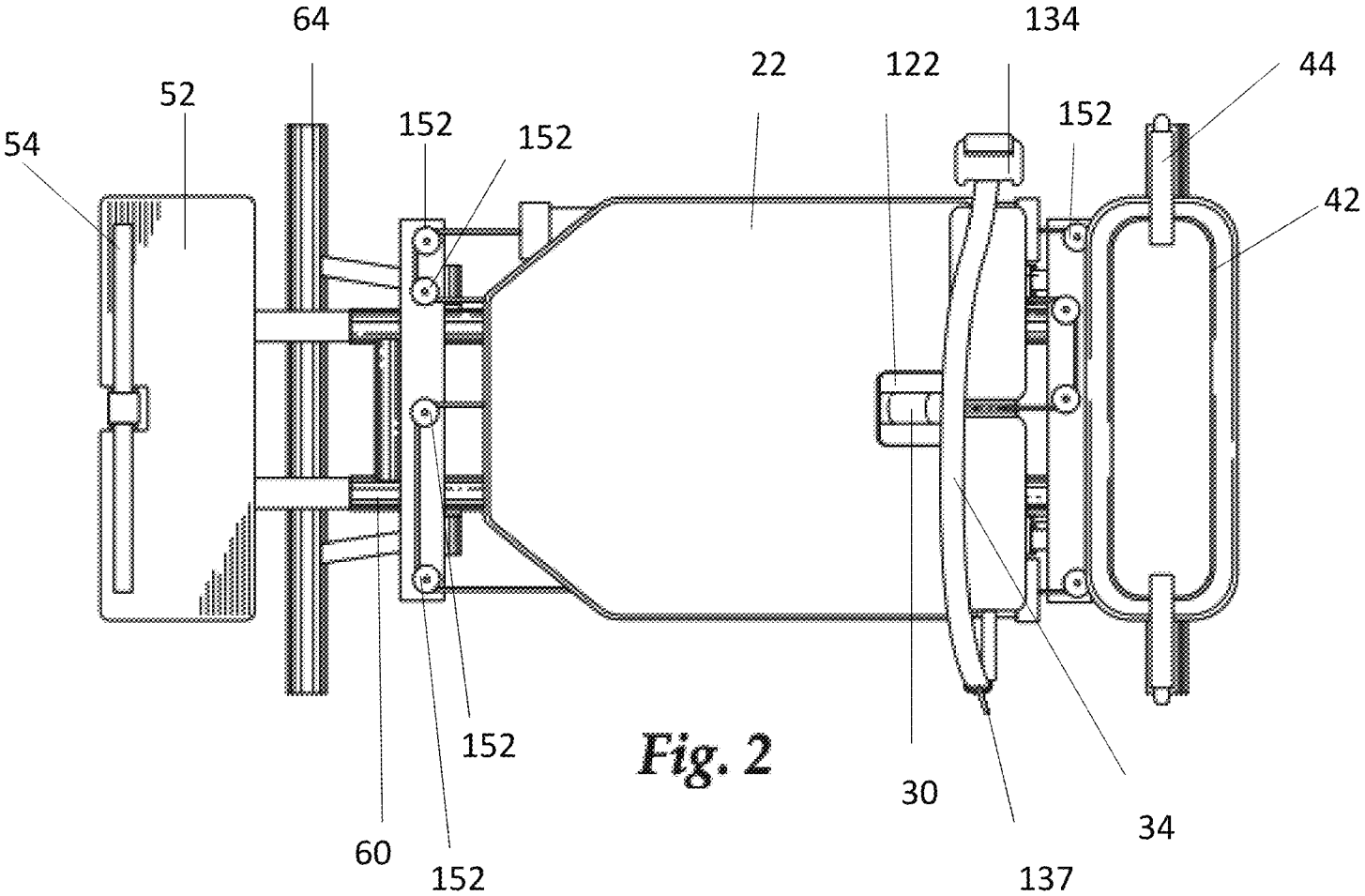
FIG. 2 is a top plan view of the exercise equipment.

FIG. 2 is a top view of the exercise machine, a main support frame 60 supports the body pad 22, foot pad 52, and plank support pad 42. The guide arm 30 extends through the groove 122 of the body support pad 22. In this embodiment, the retractable harness extends from the guide arm 30 and works through a harness ratchet mechanism 134 before attaching to a harness latch 137. In this view, the rotating guide members 152 of the force mechanism 125 can also be seen below the body pad 22.

Figure 3:
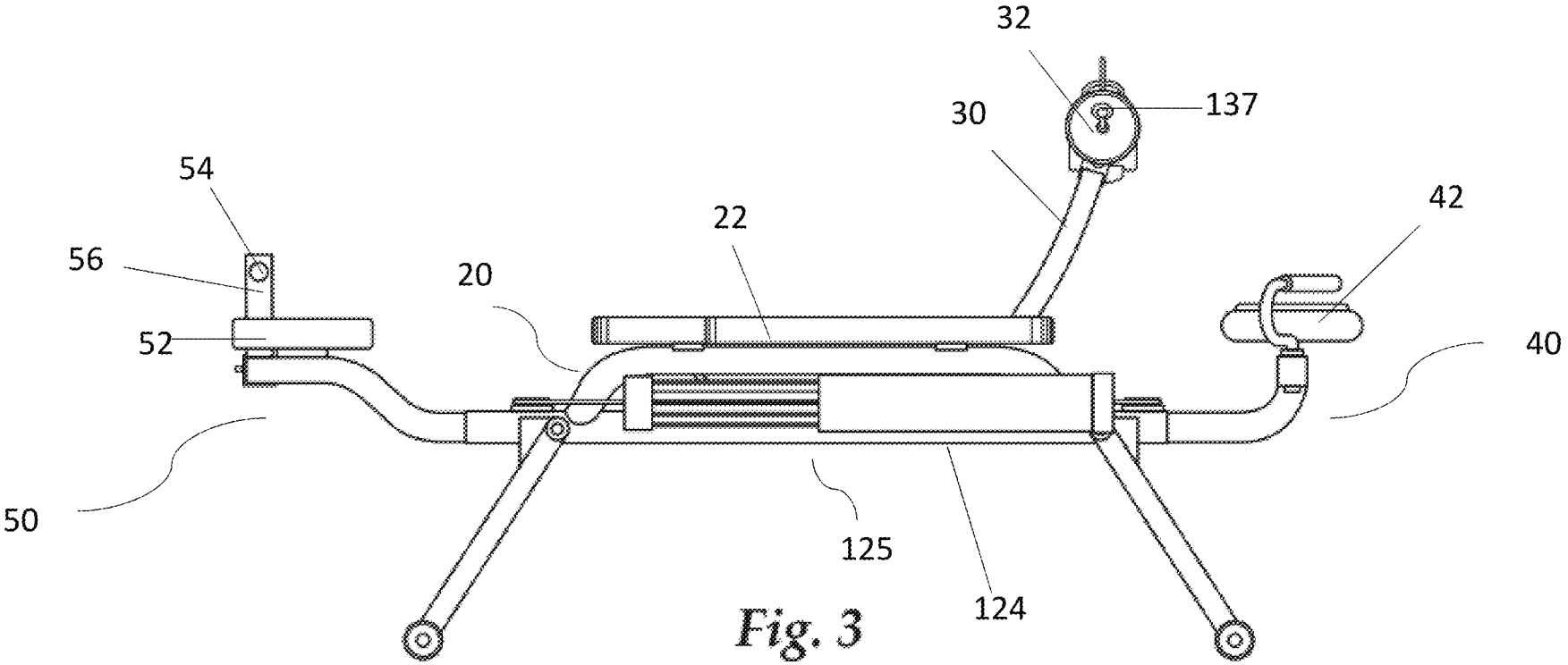
FIG. 3 is a front side view of the exercise equipment.

FIG. 3 is a side view of the exercise machine, in this view a main support beam frame supports the core support 20, head support 40, and foot support 50 which support the body pad 22, plank support pad 42, and foot pad 52, respectively. The guide arm 30 extends through the body support pad, and the retractable harness is attached to the harness latch. The foot pad 42 supports a foot 56 element positioner located perpendicularly to the foot pad. The foot element positioner further supports a foot element 54 positioned parallel to the foot pad. In this view, the added load canister 124 of the force component 125 is located beneath the body support pad 22 next to the core support frame 60.

In one embodiment, the force component, 125 consists of at least one added load canister 124 and at least one assisted canister 224 comprising a grouping of male tubes 126 and a grouping of female tubes 127, wherein the male tubes 126 have a smaller diameter than the female tubes and wherein as the male tubes 126 of one canister unit starts to extend out of the female tubes 127, a male canister 126 of a second canister unit starts to move into the corresponding female tubes 127 of a second female canister unit. In this embodiment canisters are connected via a guide cable such that they create a loop 129. One canister unit is active while the other canister unit is inactive, the active canister unit then pulls the inactive canister unit.

Figure 4:
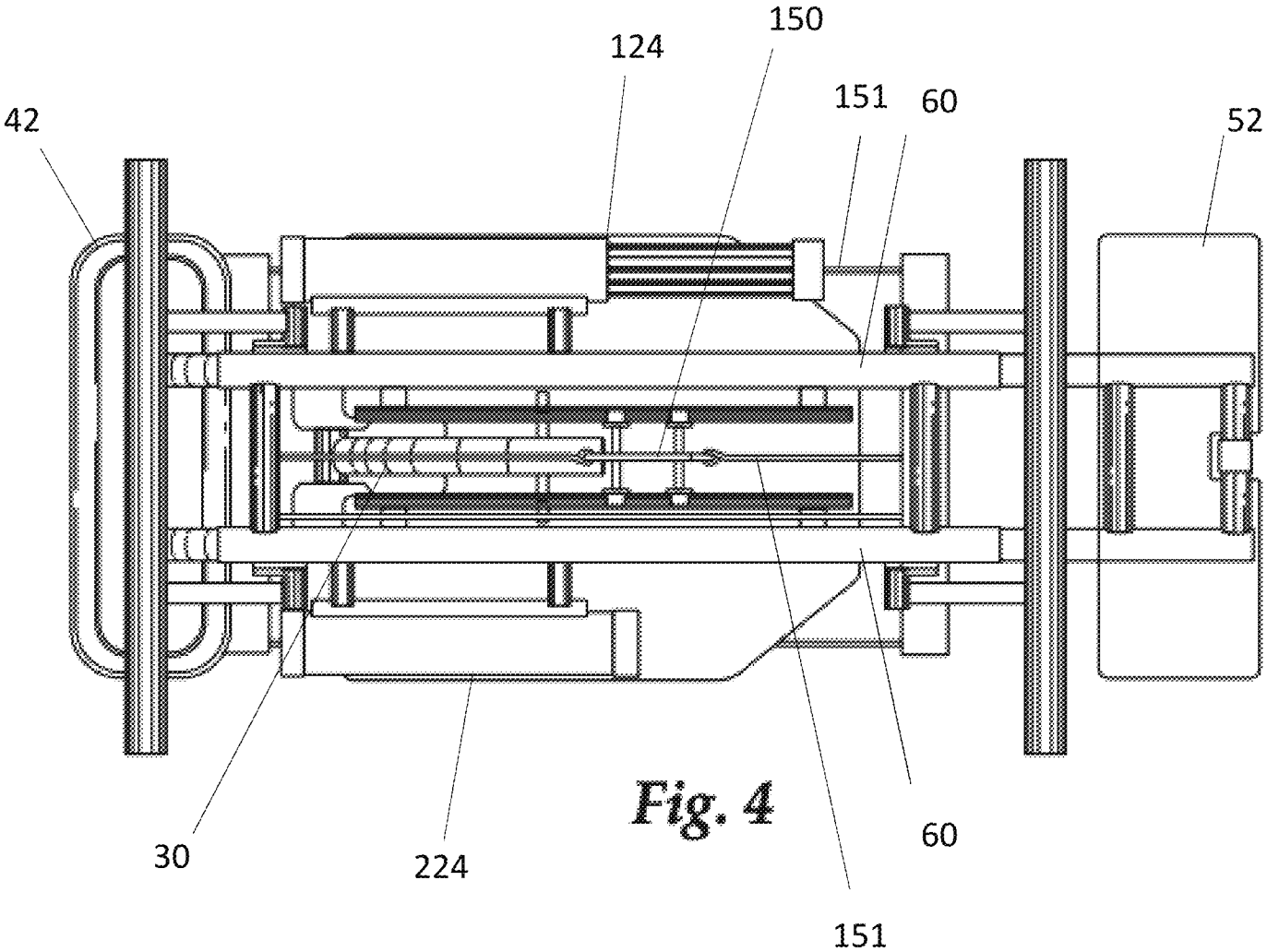
FIG. 4 is a bottom view of the exercise equipment.

FIG. 4, is a view from the bottom, a main support frame 60 runs the length of the exercise machine 10 and connects the three main supports members 20, 40, 50 of the exercise equipment 10. In this embodiment, the main support frame consists of two vertical beams connected by two cylindrical horizontal beams, forming a rectangular frame. Other embodiments could be imagined, such as a single beam, or horizontal or vertical multiple beams, for additional support. From the bottom, the force component can be seen 125, including the assisted canister 224 and the added load canister 124, located on opposing sides of the machine. The assisted canister and the added load canister are connected via a guide cable 151. The guide cable 151 connects the assisted canister to a trolley 150 before connecting the trolley to the added load canister. The guide cable 151 then completes a loop by connecting the added load canister 142 to the assisted canister 224. The force component will be described in greater detail and view in FIGS. 20, 20(*a*), and 21.

Figure 5:
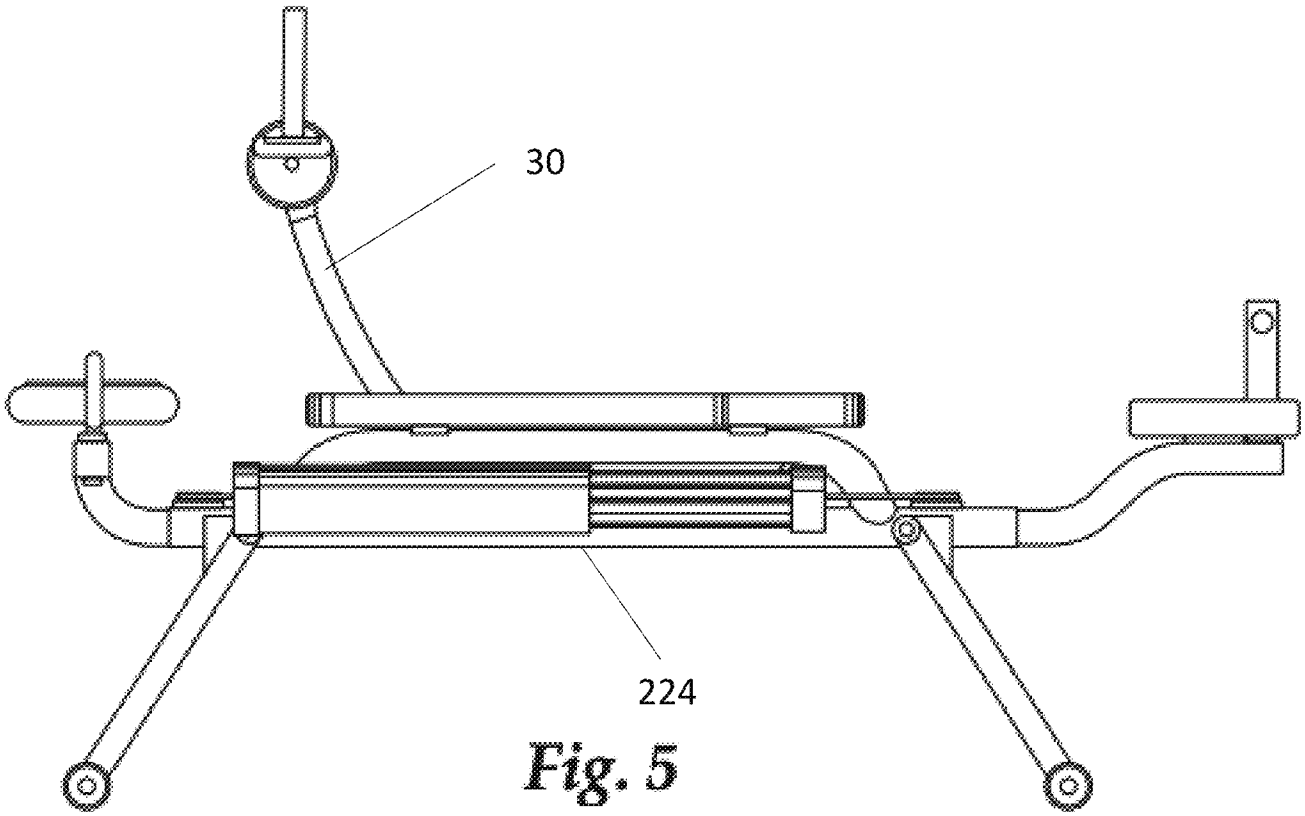
FIG. 5 is a side view of the exercise equipment.

FIG. 5 is a side view of the exercise equipment. In this view, the guide member 30 of the core support 20 is up and the assisted canister 224 of the force mechanism 125 can be seen on the side of the exercise machine.

Figure 6:
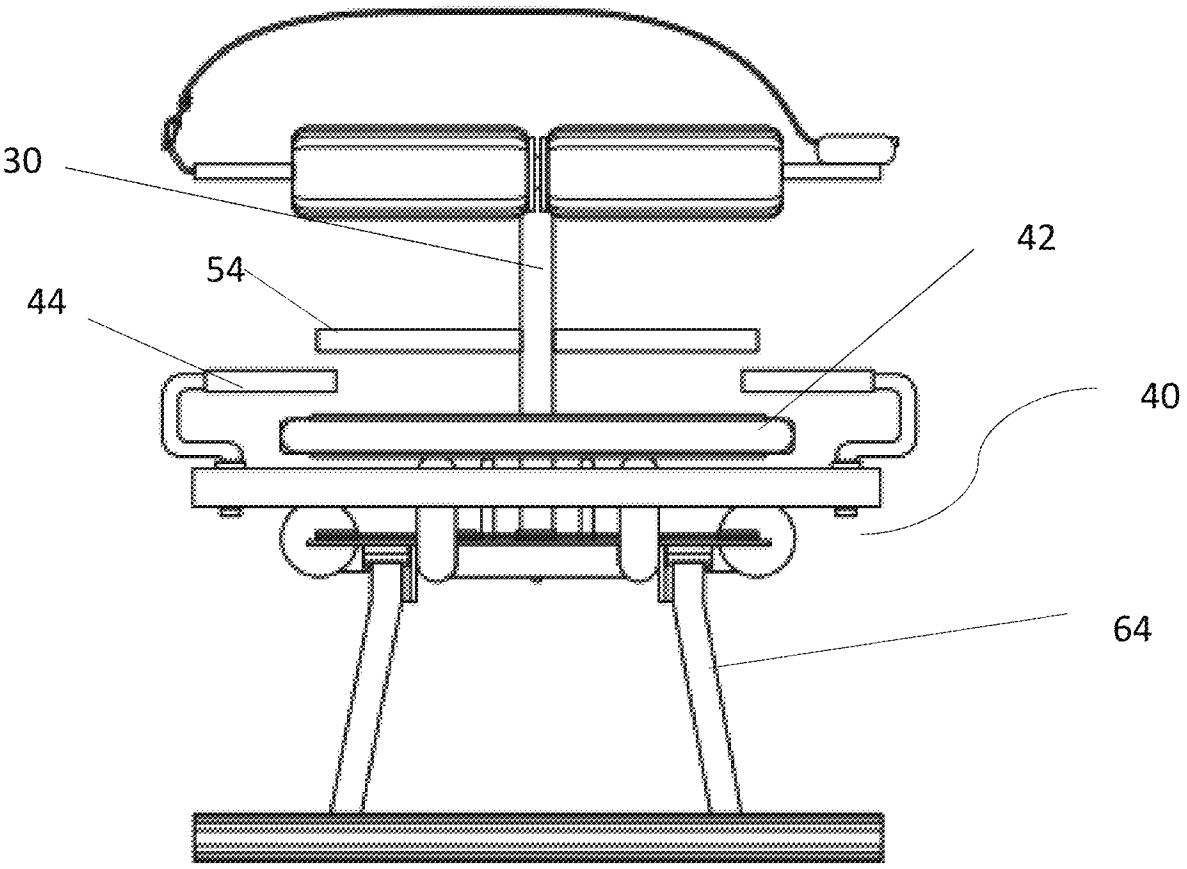
FIG. 6 is a view of the exercise equipment from the head of the equipment.

FIG. 6 is a view from the head of one embodiment of the exercise machine 10. It is essentially the front of the machine. It consists of the head of machine leg 64 the head support 40, the front of the plank support pad 42, the handlebars 44 and in the background, is seen the foot element 54 and the foot element positioner 56.

Figure 7:
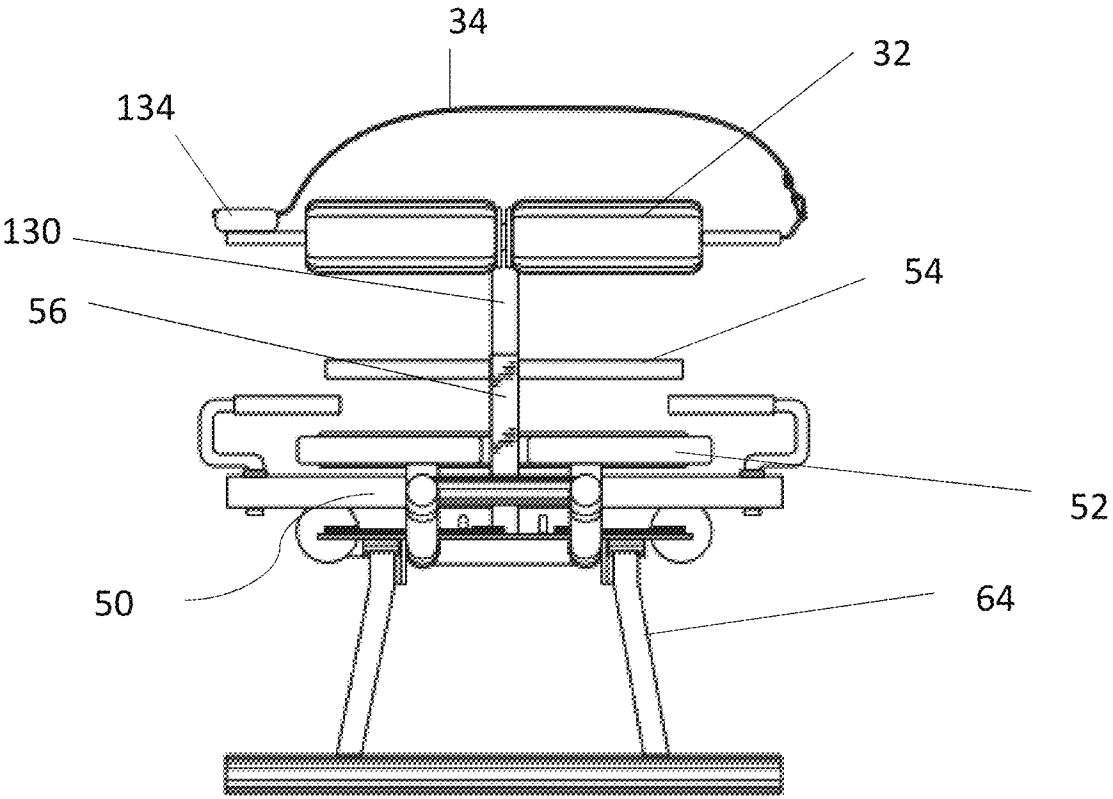
FIG. 7 is a view of the exercise equipment from the feet.

FIG. 7 is a view from the foot of the exercise machine 10. It is essentially the back of the machine. It consists of the foot area leg 64, the foot support 50, the back end of the foot pad 52, the foot element 54, the foot element positioner 56, and the handle bars 44 are seen in the background. Additionally, the guide arm 30, guide arm pad 32, retractable harness 34, and harness ratchet mechanism 134 can be seen.

Figure 8:
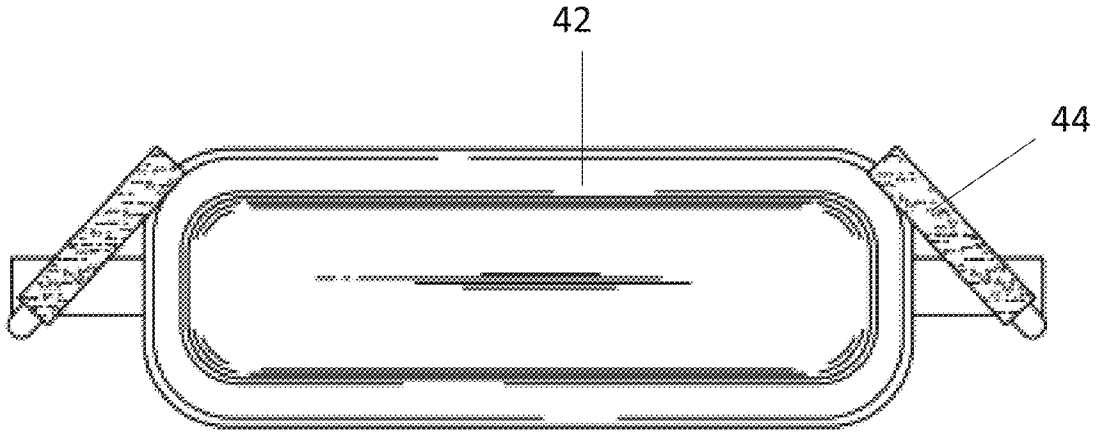
FIG. 8 is a partial top plan view of the head of machine support.
Figure 9:
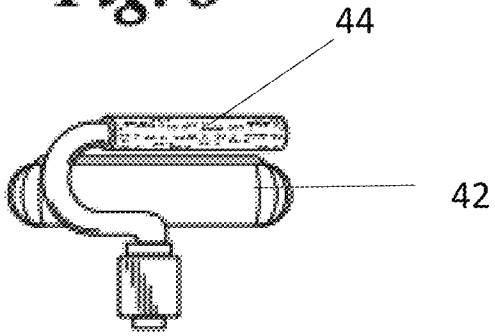
FIG. 9 is a partial front side view of the head of machine support.
Figure 10:
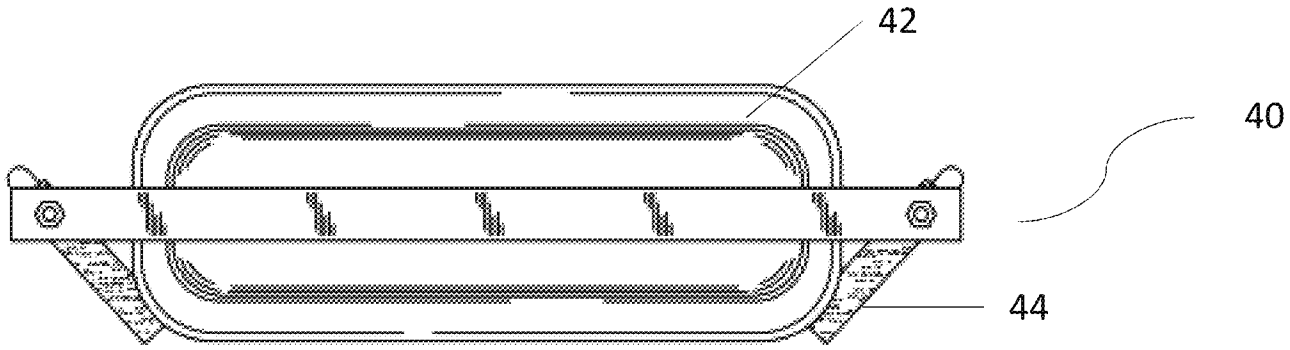
FIG. 10 is a partial bottom view of the head machine support.

FIG. 8 is the top plan view of the head of the machine support 40. It consists of the plank pad 42, the handle bars 44 and the foot of the front leg 64. FIG. 9 is a partial front side view of the head of the machine support 40. It consists of a side view of the plank pad 42 and the handlebars 44. FIG. 10 is a partial bottom view of the head of the machine support 40, which may comprise a plank pad 42, and the handlebars 44.

Figure 11:
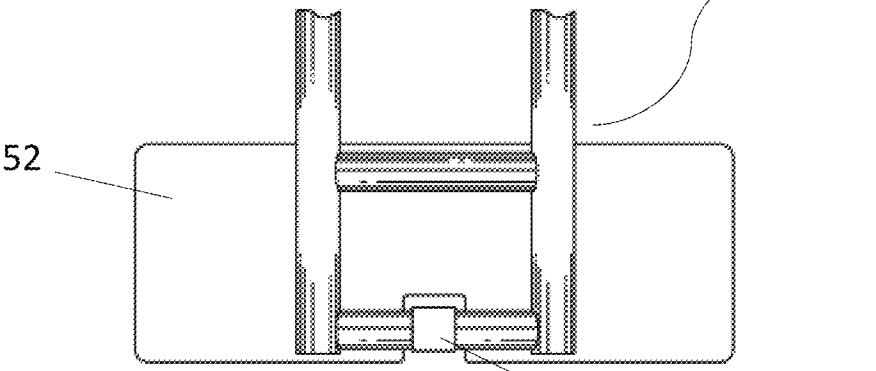
FIG. 11 is a partial bottom view of the foot support.
Figure 12:
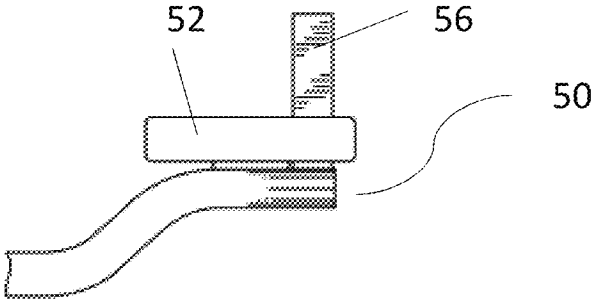
FIG. 12 is a partial front side view of the foot support.

FIG. 11 is a partial bottom view of the foot support 50 which comprises a foot support pad 52, a foot element 54 and a foot element positioner 56. FIG. 12 is a partial front side plan view of the foot support 50 further illustrating the back end of the core support system 60, a side view of the foot support pad 52, a side view of the foot element 54 and the foot element positioner 56.

Figure 13:
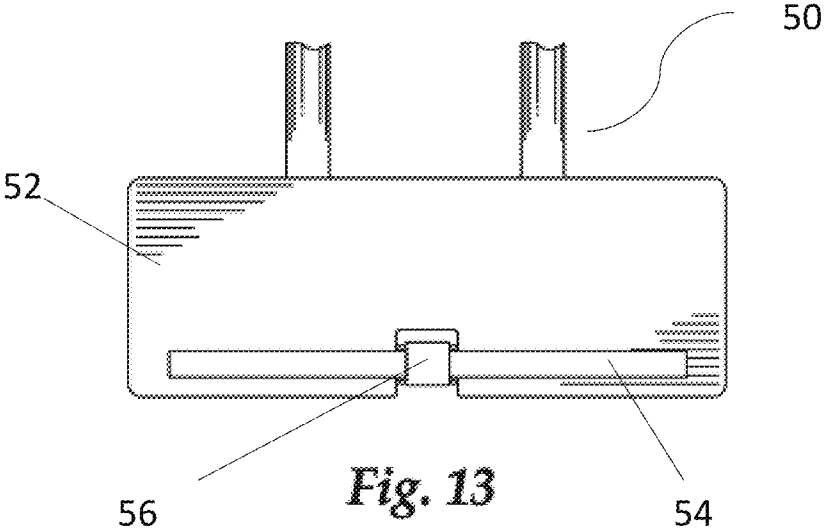
FIG. 13 is a partial top view of the foot support.

Additionally, FIG. 13 is a partial top view of the foot support 50. It consists of the top view of the foot support pad 52, the top view of the tube of the foot element 54 and the top view of the tube of the foot element positioner 56.

FIG. 14 is a partial top plan view of the core support 20 illustrating the body support pad 22, the groove 122 in the body support pad, the guide arm 30 and the guide arm pad 32. Additionally, the rotating guide members 152, and the guide cable 151 of the force component 125 can be seen below the body support pad.

FIG. 15 is a partial bottom view of the core support 20 which comprises a central support frame 60, body support pad 22, the guide arm 30, and the force component comprising the assisted canister 224, the added load canister 124, at least two rails 160, a trolley 150, a guide cable 151.

FIG. 16 is a partial front side view of the core support 20 illustrating the body pad 22, the guide arm 30, and the guide arm pad 32.

Figure 17:
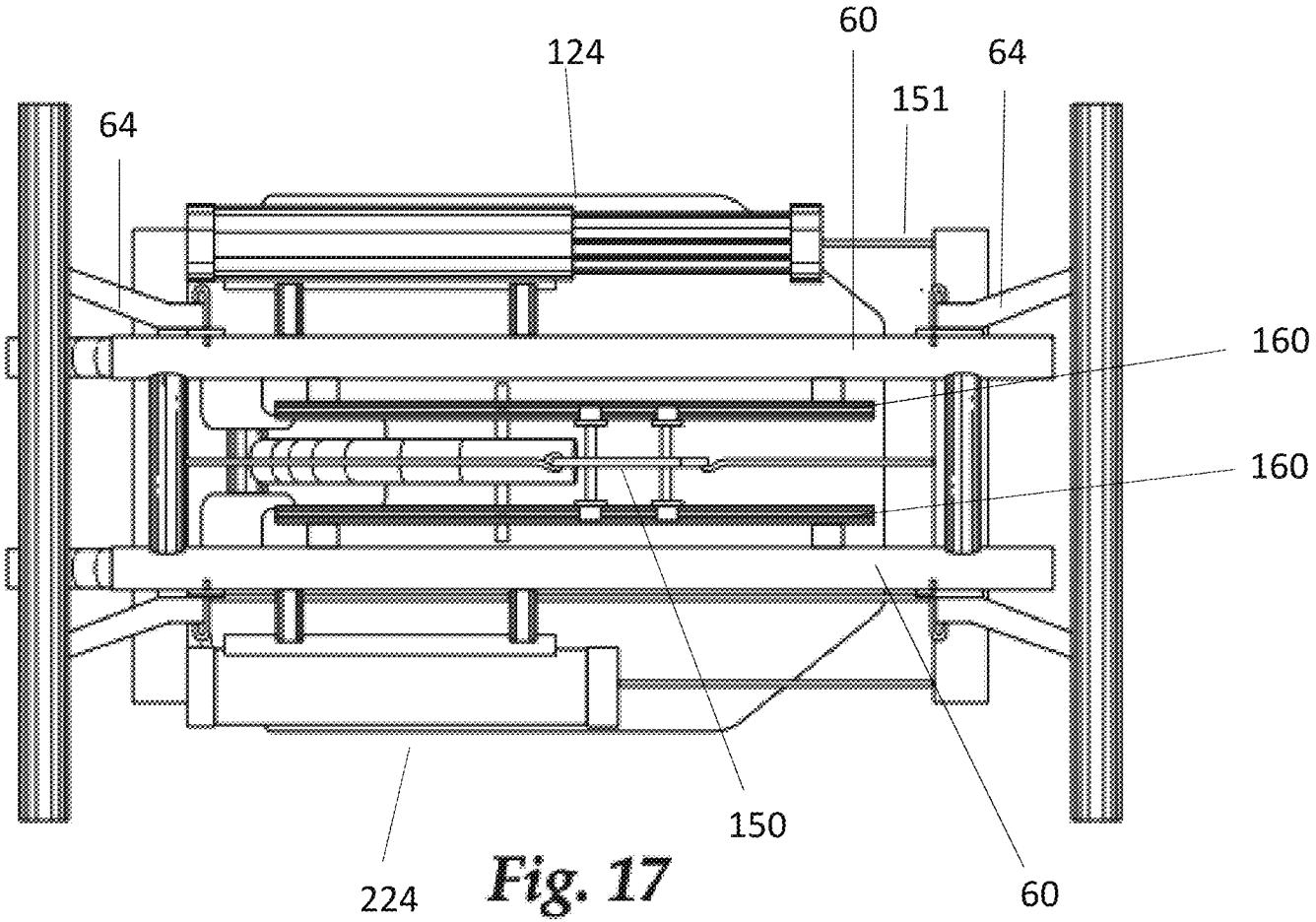
FIG. 17 is a bottom view of the core and force component.

FIG. 17 is the bottom view of the main support frame 60 and the head and foot area legs 64. The force component 125 is also illustrated, as in FIG. 15.

Figure 17A:
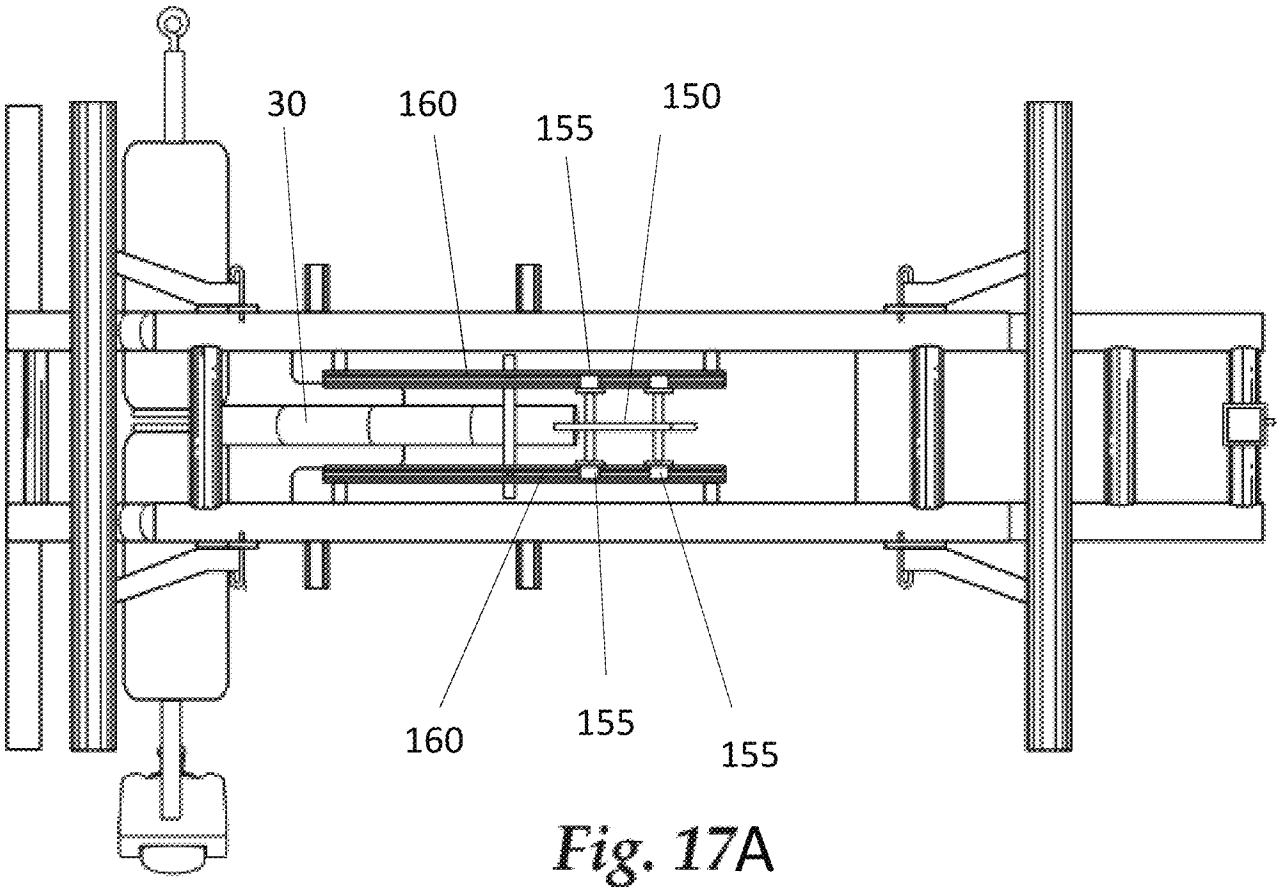
FIG. 17A is a bottom view of the apparatus without the canisters.

FIG. 17A is a bottom view of the rail and trolley system without the added load 124 or assisted canister 224 or the body pad 22. In this view, the guide arm 30 is down and the trolley wheels 155 can be seen on the rails 160.

Figure 18:
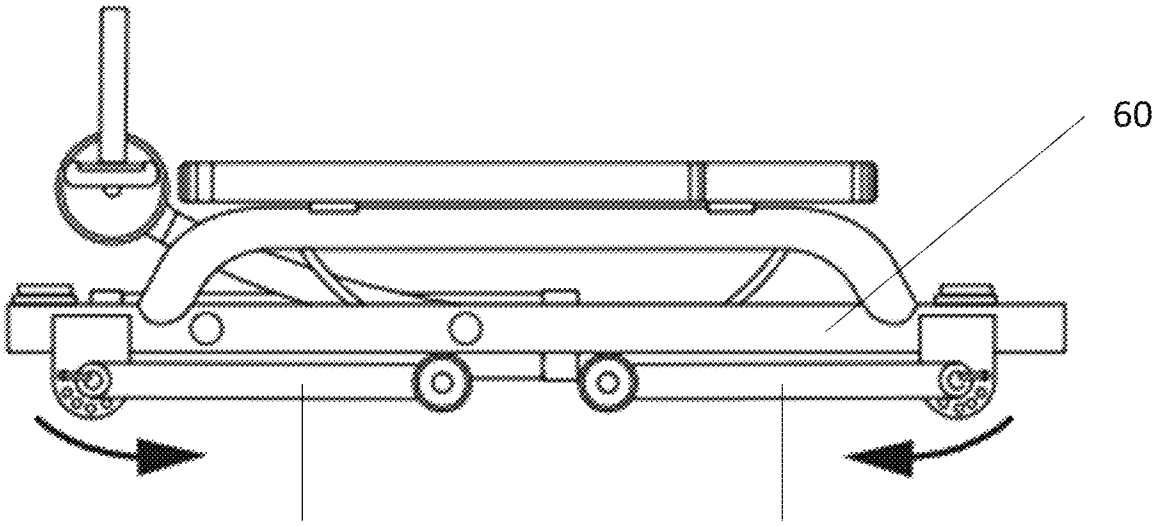
FIG. 18 is a view of the equipment with the legs folded inward.

FIG. 18 illustrates the exercise machine with the legs 64 folded inward beneath the main support frame 60 to save space for storage and during transport.

Figure 19:
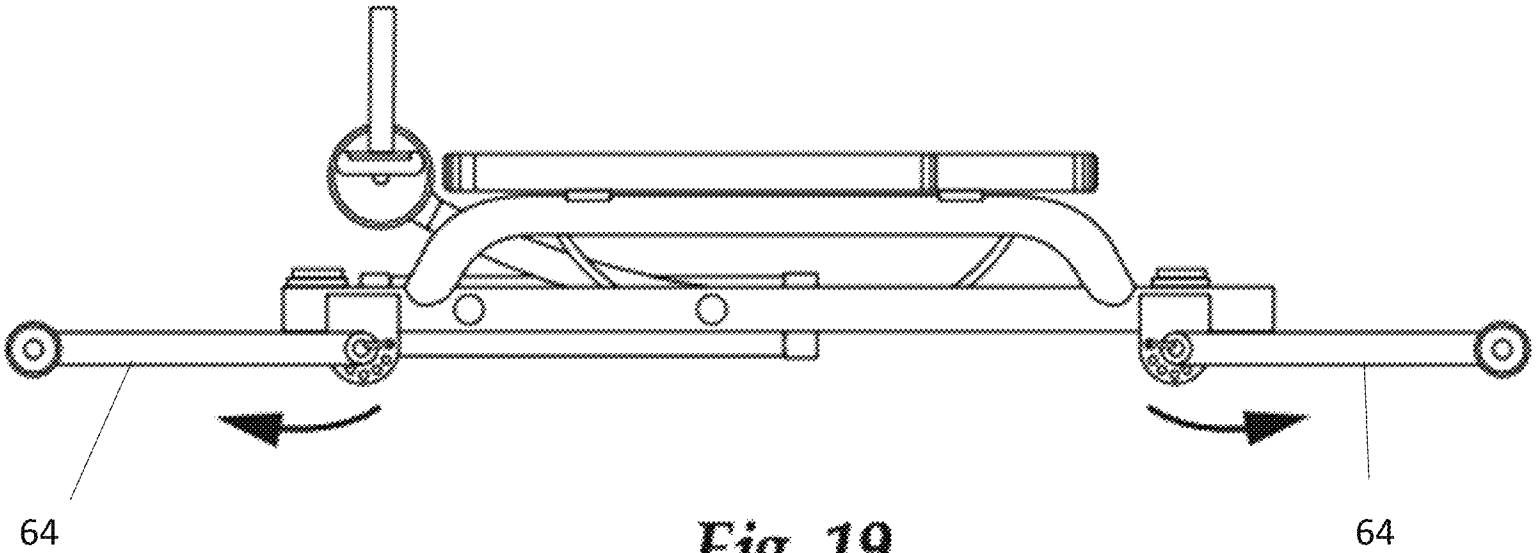
FIG. 19 is a side view of the exercise machine in a folded configuration with the legs folded outward.

FIG. 19 is a side view of the exercise machine 10 illustrating the head of the machine and foot of the machine legs 64 folded outwardly such that the machine takes up less space vertically, for storing in spaces such as underneath a bed.

Figure 20:
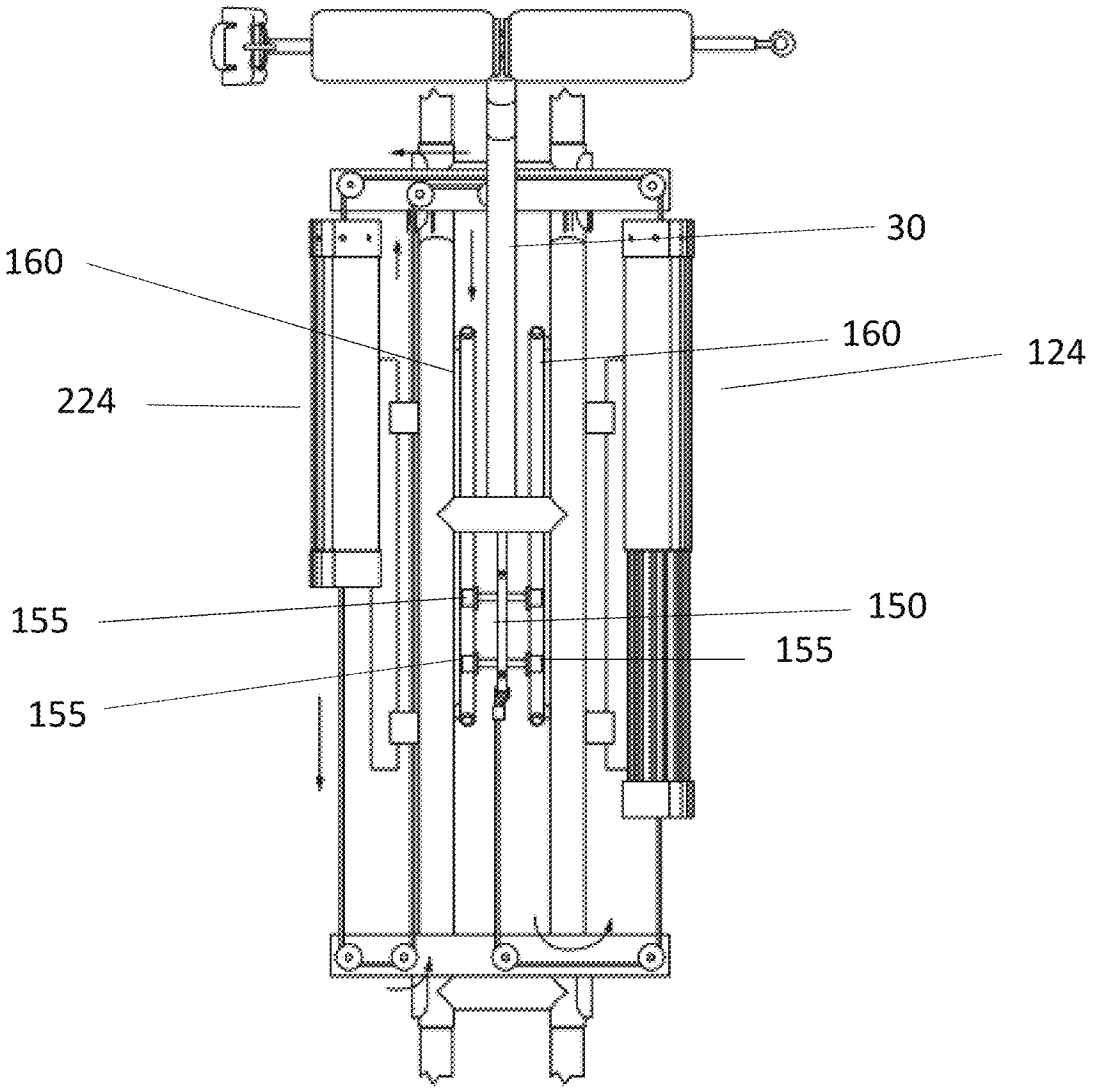
FIG. 20 is a top view of the exercise equipment with the body pad removed to reveal the force component and frame.

FIG. 20 is a top view of the exercise machine with the body pad removed to show the main support frame 60, the force component 125, the guide arm 30, the guide arm pad 32. The force component 125 comprises a loop connecting an assisted canister 224, and added load canister 124, and a trolley 125. The added load canister and the assisted canister each further comprise a plurality of telescoping tubes. The telescoping tubes further comprise male tubes 126 and female tubes 127. The female tubes 126 are fixed inside the canister at a front end of the tube, the male tubes 127 are fixed to the canister cap 128 such that when the male tubes are fully inserted into the female tubes the cap creates a closed canister. The male tubes of each canister has a smaller diameter than the female tubes such that the male tubes can be inserted into and extend from the female tubes. If no force is applied in the system, the male tubes 126 of the assisted canister starts 224 extend as the male members 126 of the added load canister 124 begins to retract into the female member, as shown by the arrows. The action of each canister therefore counteracts each other. If the assisted canister 224 has a selection of force, the canister on the right, the added load canister, will have zero force. The action of the assisted canister 224 therefore pulls the added load canister such that the male tubes 126 of the added load canister 124 are completely inserted and the canister cap closes the canister system. The two canisters and trolley are connected via the guide cable 151. The guide cable comprises at least three guide cable members, 151*a*, 151*b*, and 151*c*. One guide cable member 151*a* connects the canister cap 128 of the assisted canister 224 to the trolley 150. One guide cable member 151*b* connects the front end of the assisted canister to the front end of the added load canister 124. Another guide cable member 151*c* connects the canister cap 128 of the added load canister 224 to the trolley 150. The guide cable is looped through a plurality of rotating guide members as it connects the canisters and the trolley.

Figure 21:
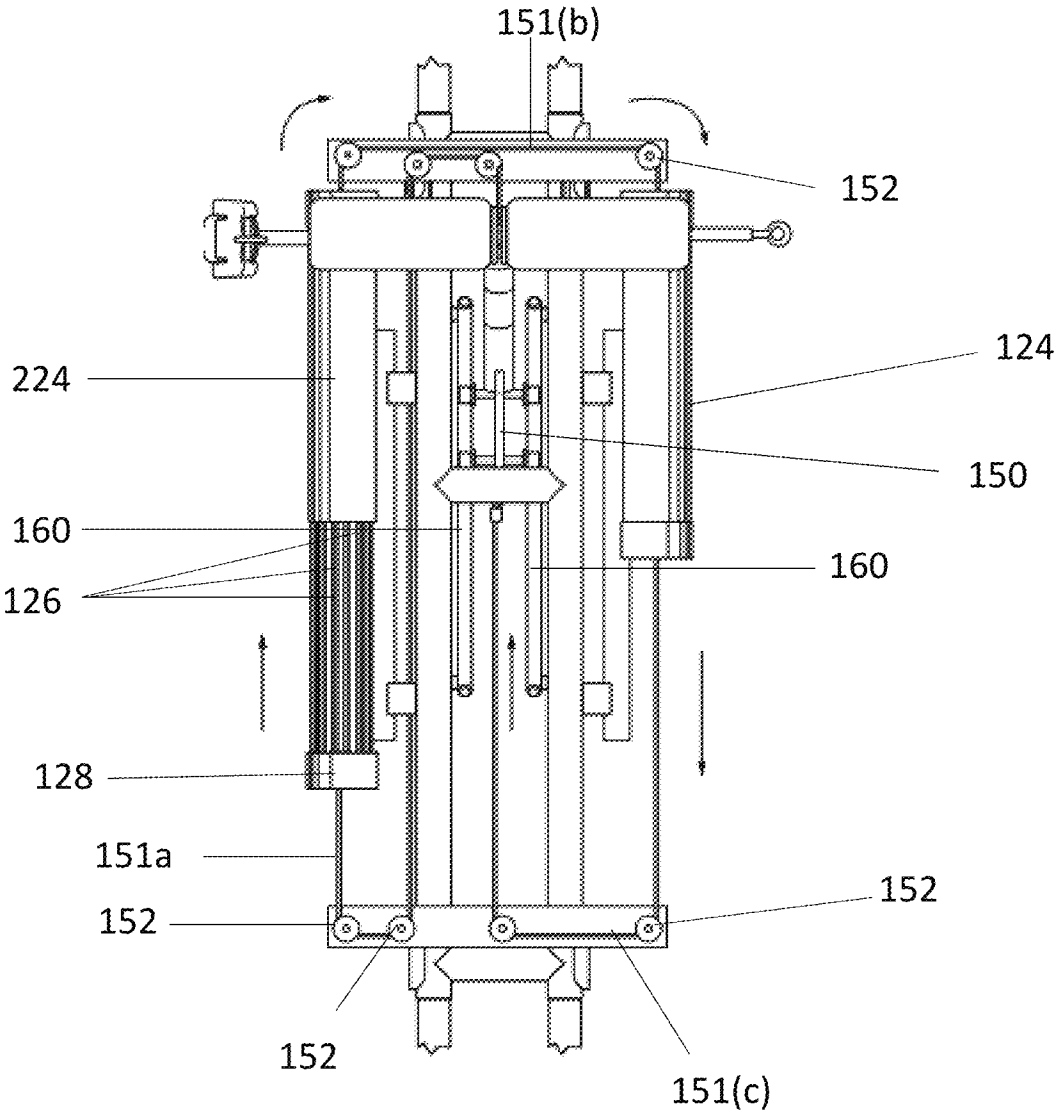
FIG. 21 is a top view of the exercise equipment with the body pad removed to reveal the force component and frame without a harness.

FIG. 21 illustrates an embodiment of the machine in which the body pad 22 has been removed. In this embodiment, the guide arm 30 is up and the added load canister has a force selected. As shown by the arrows, the male members of the added load canister extend and pull the guide cable, thus pulling the male members 126 of the assisted canister into the female tube members of the assisted canister until the male tube members are completely in line with the canister and the canister cap 128 closes the canister. The added load system functions when the loop goes in the opposite direction of what was described in FIG. 20. That is, the added load canister 124 has a selection of force while the assisted canister has a zero force. Action of the added load canister 124 pulls the assisted canister until the male tubes of the assisted canister is completely inserted and the canister cap 128 is on the assisted canister.

Figure 21A:
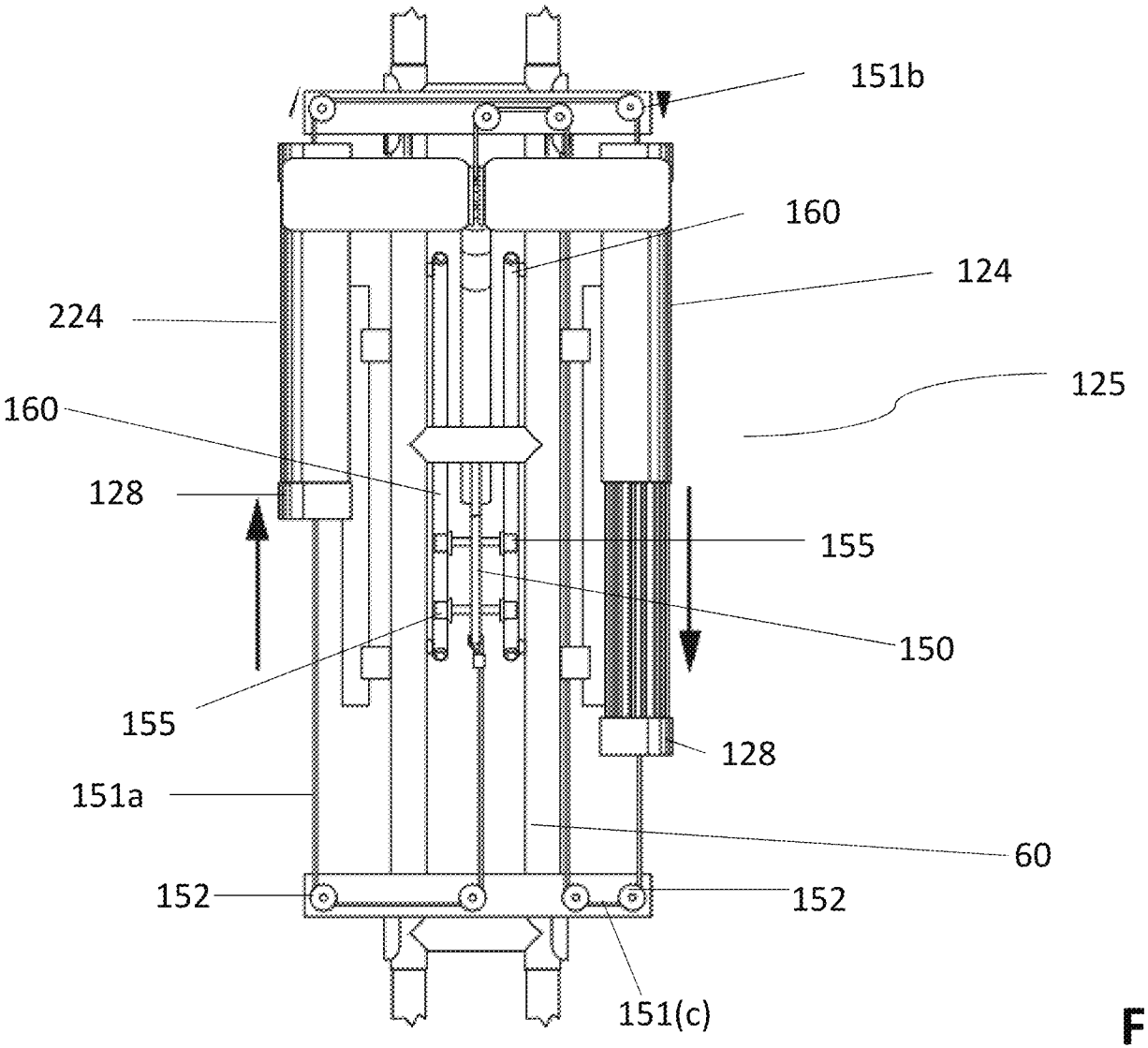
FIG. 21A is a top view of the exercise equipment with the body pad removed to reveal the force component and frame with the guide arm up.

FIG. 21A is a view of the top of the machine with the body pad removed and the guide arm 30 in the up position. In this embodiment, the added load canister has a selection force and the trolley 150 at the front of the rails 160. In this illustration, the male member tubes 126 of the added load canister have been completely extended and the male member tubes 126 of the assisted canister have been pulled such that they are completely inserted into the assisted canister female tube members 127. The rail system comprises at least two rails 160, a trolley 150, the and the guide arm 30 which is connected to the trolley 150. The trolley further comprises at least two wheels 155 which hold the trolley to the wheels. The top wheels of the trolley may be eccentric to help the trolley sit on the rails better. Further, the rails can be cut to include a channel in which the trolley wheels can be located.

Figure 22:
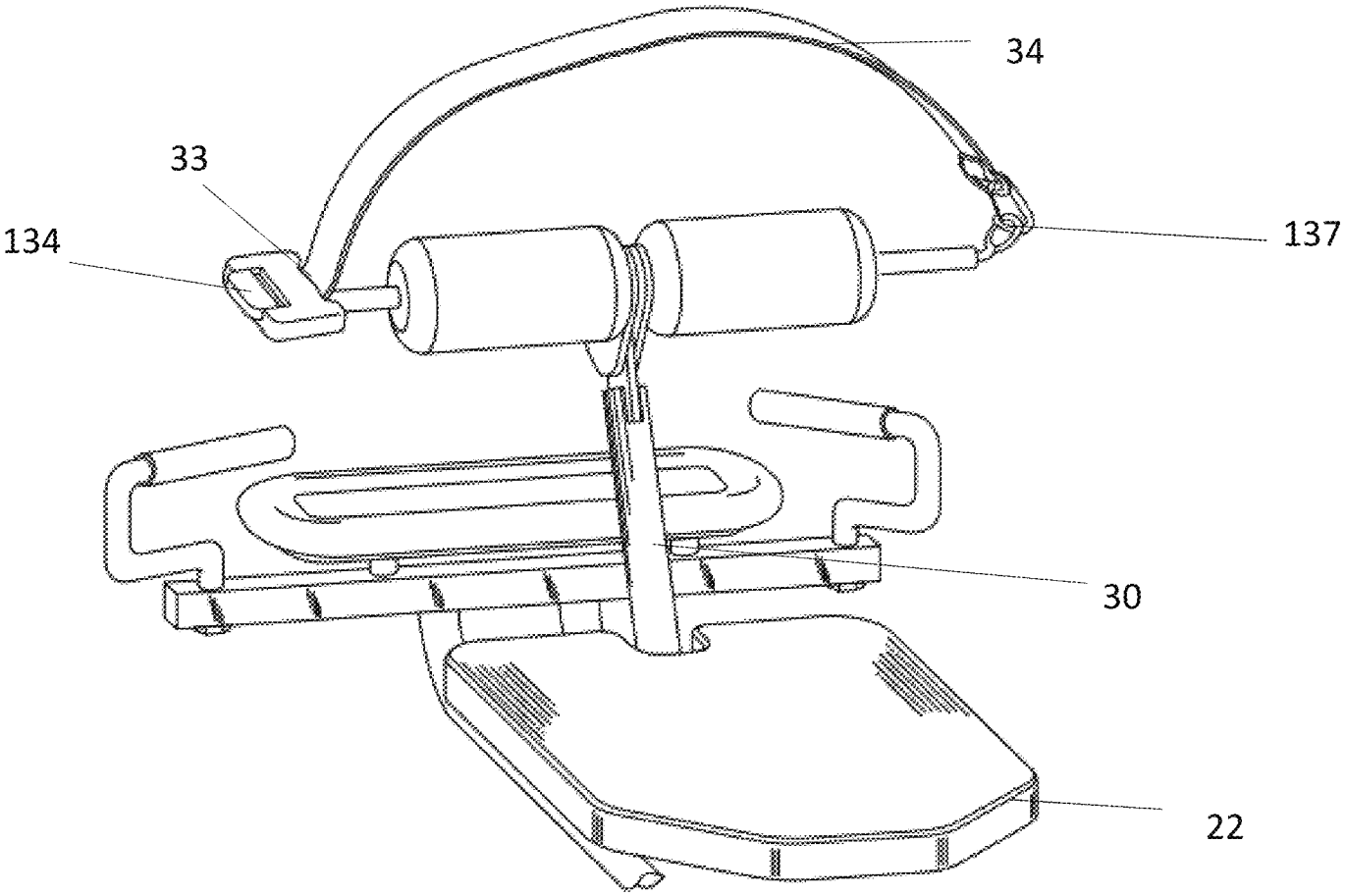
FIG. 22 is perspective view of a harness retracting mechanism.

FIG. 22 is a perspective view of the core support 20 illustrating a retractable harness 34, with a retracting mechanism 33, a ratcheting mechanism 134, and a latching mechanism 137. This retractable harness configuration is housed in the guide arm pad 32 structure and acts as a connection point to the machine for times when a user is performing added load exercises. This structure may also just be utilized as a hooking area and the retractable mechanism 33 may be housed in the belt or harness and hook to the machine at said point.

Figure 23:
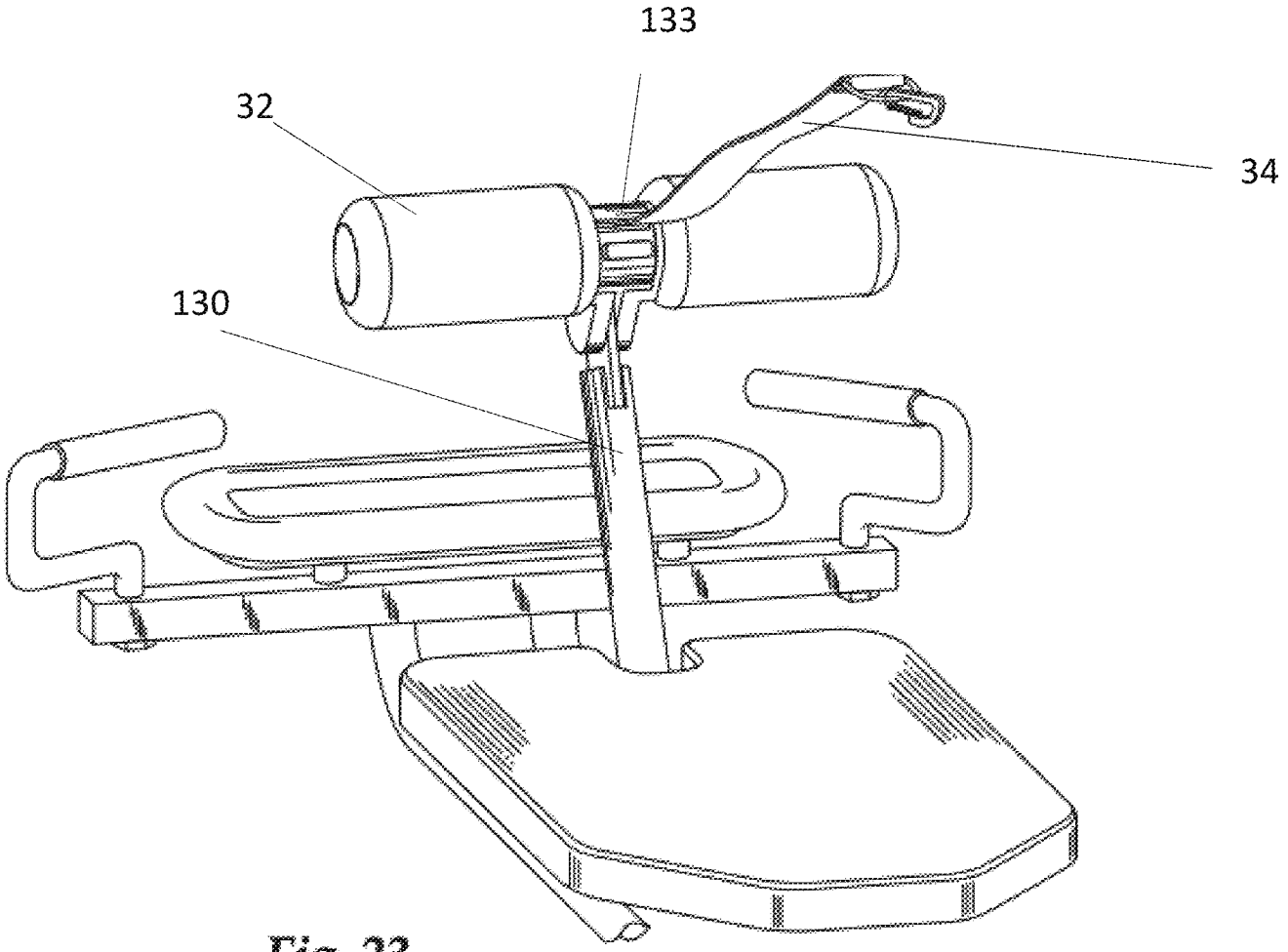
FIG. 23 is an alternate embodiment of a harness retracting mechanism.

FIG. 23 illustrates another embodiment of a harness retracting mechanism 133 located is the center of the guide arm 30 between two segments of the guide arm pad 32.

Figure 24:
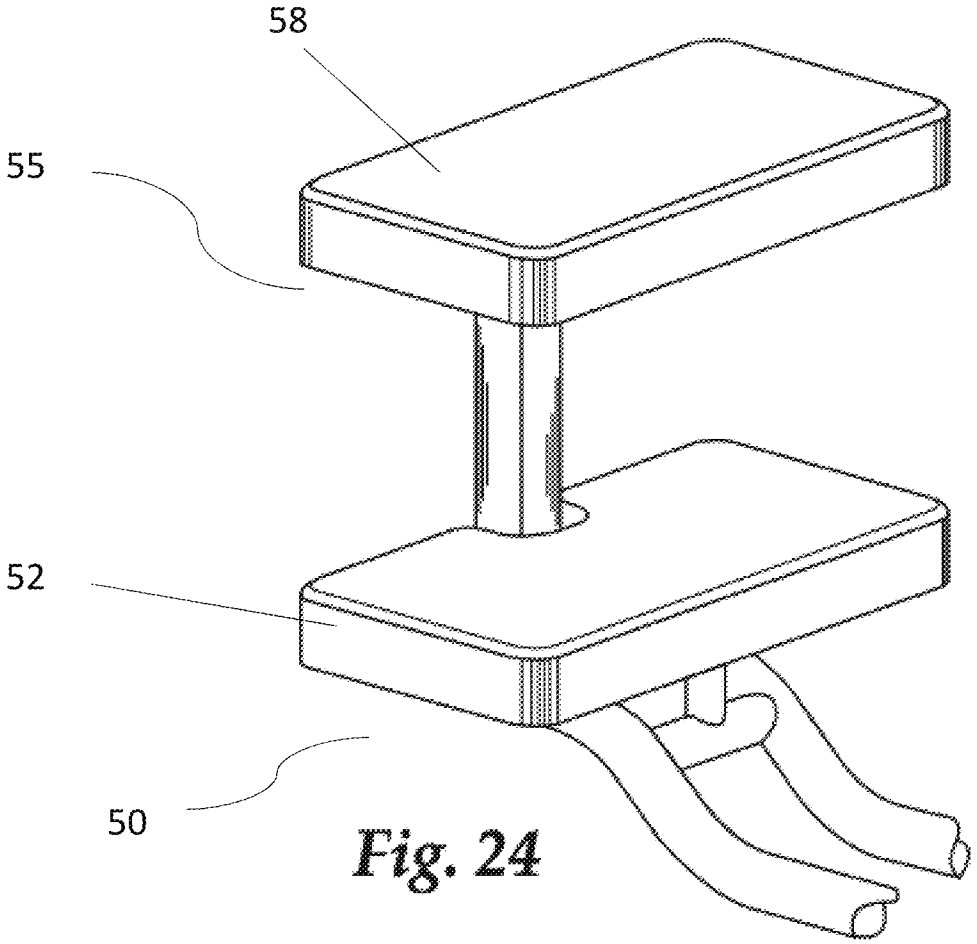
FIG. 24 is a perspective view of an auxiliary foot support.

FIG. 24 illustrates an embodiment of the foot support 50 with an auxiliary foot support 55 and auxiliary foot support pad 58 placed on top of the foot support element positioner 56 for the purposes of providing a support to elevate a user's feet.

Figure 24A:
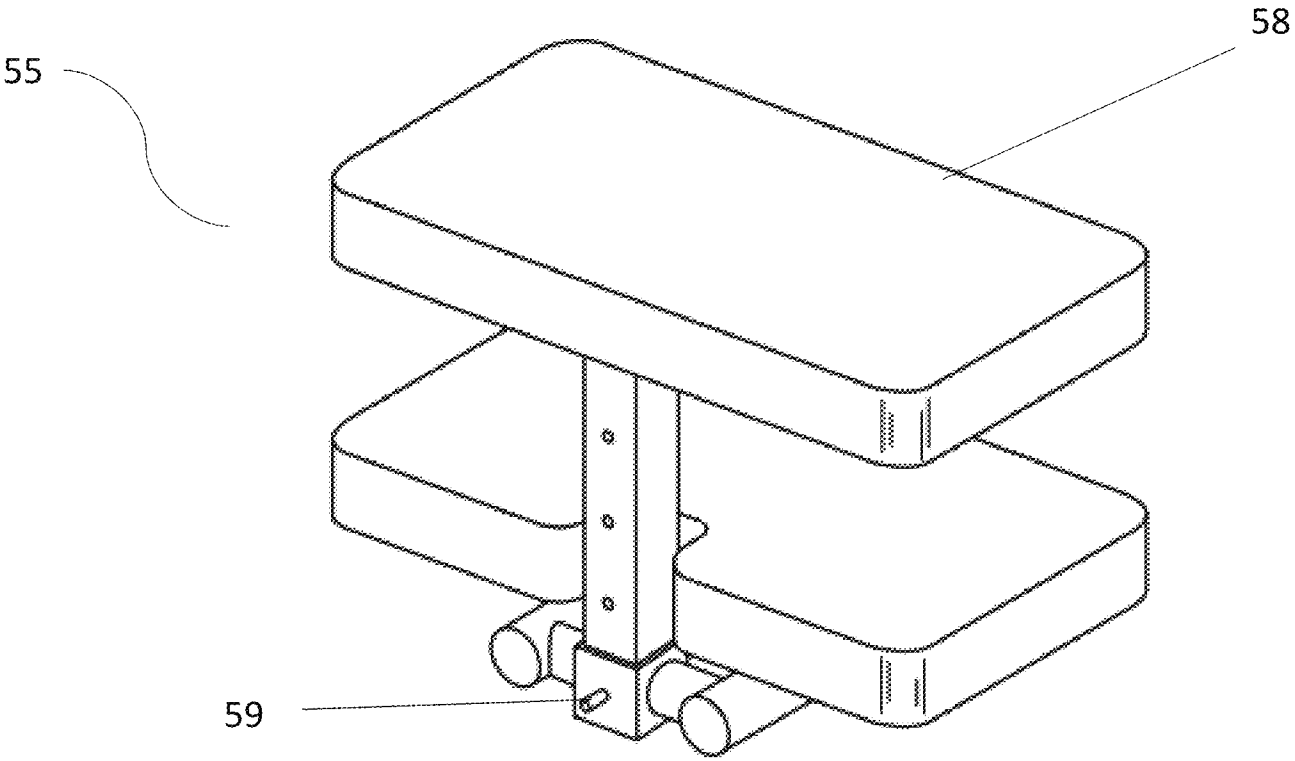
FIG. 24A is a view from the back of the auxiliary foot support.

FIG. 24A illustrates an embodiment of the auxiliary foot support 55 wherein the height of the auxiliary foot support 55 can be adjusted by securing a pin or a peg 59 through a hole in the foot element positioner 56 or a hole in a vertical support rod of the auxiliary foot support that corresponds to the desired height.

Figure 25:
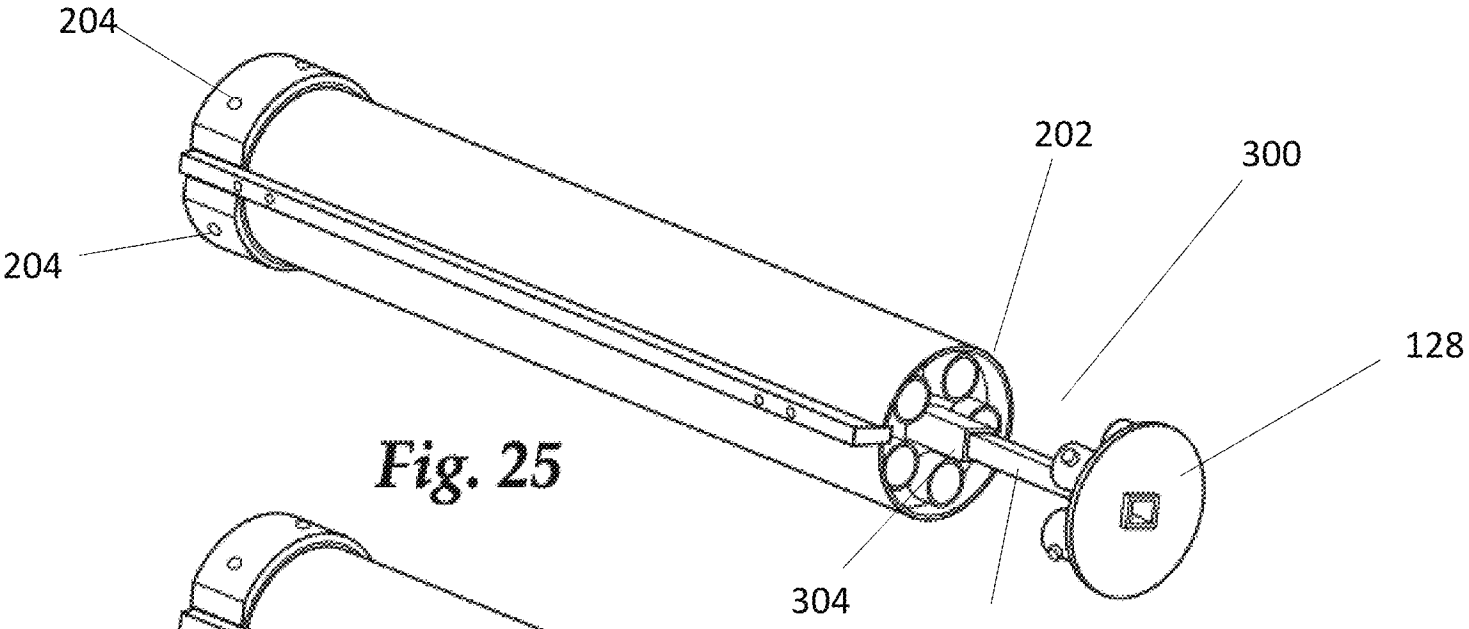
FIG. 25 is an exploded view of a canister.

FIG. 25 illustrates an expanded view of one embodiment of a canister 124 or 224 comprising a wrapping 202, a button arrangement at the front of a canister 204, a telescoping tracking protocol 300. The telescoping member keeps the male and female tube members in line and prevent twisting so that selection can occur can be further divided into a male tracking member 302 and a female tracking member 304. The button arrangement 204 is used to select the amount of force desired. While the canister and the internal tubes are depicted as cylindrical, other shapes such as squares or hexagons are possible. If the canisters are not part of a loop, as they are in this embodiment, the female tubes 127 will need to be actuated by a weak spring to bring them back for selection.

Figure 26:
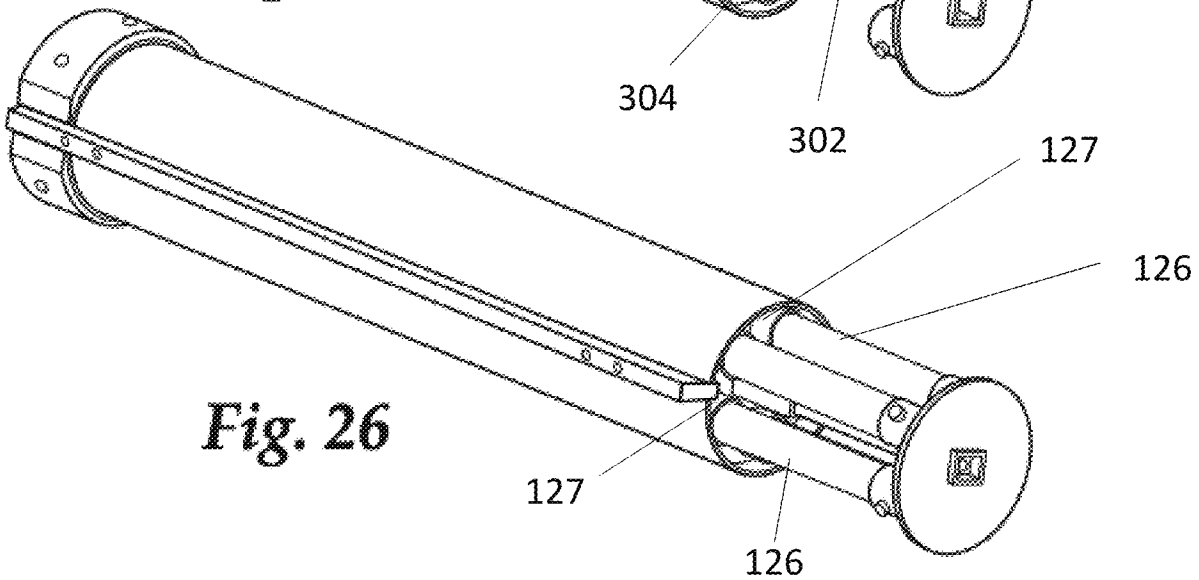
FIG. 26 is an exploded view of a canister with telescoping tubes extended.

FIG. 26 illustrates an expanded view of a canister with the male tubes 126 extended from the female tube 127. Housed in each male member tube 126 is a resilient member and a plunger receiver fixed to the resilient member. The plunger receiver receives a plunger for the purposes of turning the resilient member on or off. Each female member has a key member that receives a male member key for the purposes of keeping the tubes together. The grouping of female tubes is held together by a strapping member. In the front area of the canister is the selection member. This member is comprised of corresponding plungers or buttons which are in line with the corresponding receiving members of the male tubes when they are pulled into place by the mechanisms of the machine and kept in line by the respective key elements. When said members are in place they can be turned on and off. When they are engaged they will essentially be connected to the front end of the canister and selectedly fixed into the front end where the female tubes connect. As the canister expends, the resilient members inside the turned on male members will produce force through the range of motion and this force will be transferred through the machine. The resilient members inside the male tubes that are not turned on will just go for the ride, but offer no force at all.

Figure 26A:
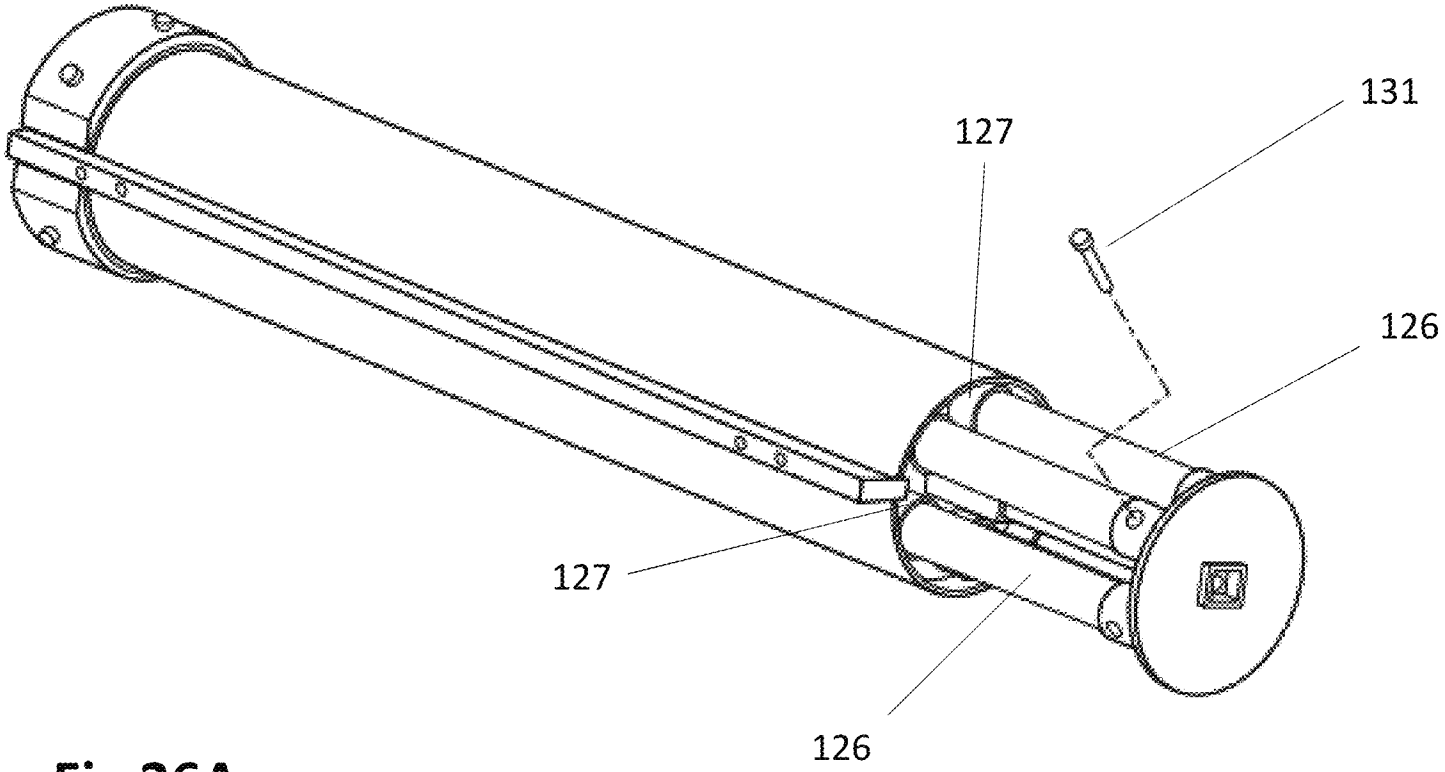
FIG. 26A shows the same expanded view of a canister as shown in FIG. 26 wherein a pin or peg is used to secure the male tube member in place.

FIG. 26A shows the same expanded view of a canister as shown in FIG. 26. In this view, a pin or peg 131 is used to secure the male tube member in place.

Figure 27:
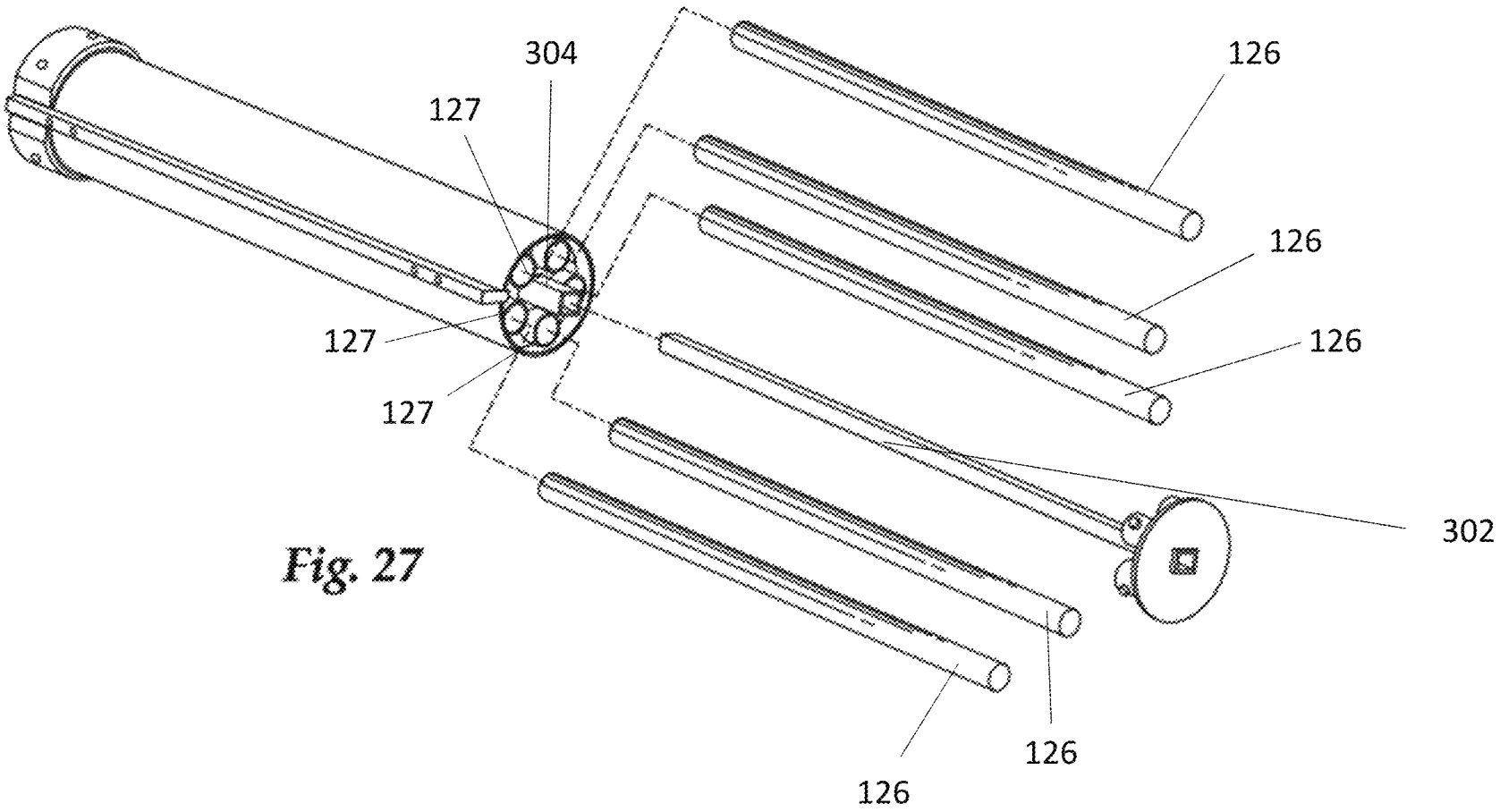
FIG. 27 is an exploded view of a canister with the male tube members separated from the female members.

FIG. 27 is an expanded view of a canister with the male tubes 126 removed from the female tubes 127, as well as the telescoping tracking protocol 300 separated into its component male and female pieces, 302 and 304 respectively.

Figure 27A:
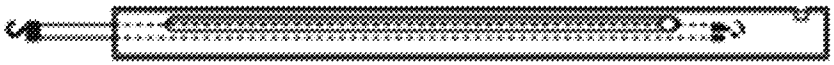
FIG. 27A is an exploded view of the telescoping tubes collapsed.

FIG. 27A is an expanded view of an embodiment of the male and female tubes. In this illustration, the male tube member is inserted inside the female tube member. Inside the male member is a resilient member and a plunger receiver. Inside the female member is a key member.

Figure 27B:
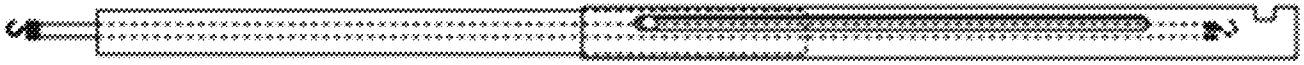
FIG. 27B is an exploded view of the extended telescoping tubes.

FIG. 27B is an expanded view of an embodiment of the male and female tubes in which the male tube is extended from the female tube.

Figure 27C:
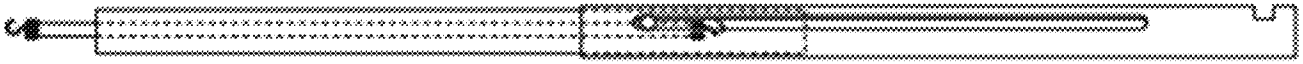
FIG. 27C is an exploded view of the extended telescoping tubes.

FIG. 27C shows another expanded view of an embodiment of the male and female tubes in which the male tube is extended from the female tube. This embodiment represents the configuration of the tubes in an embodiment that does not have a canister system as a force component. In this embodiment, a weak spring is employed to move the portion of the force component that is not directly engaged.

Figure 28:
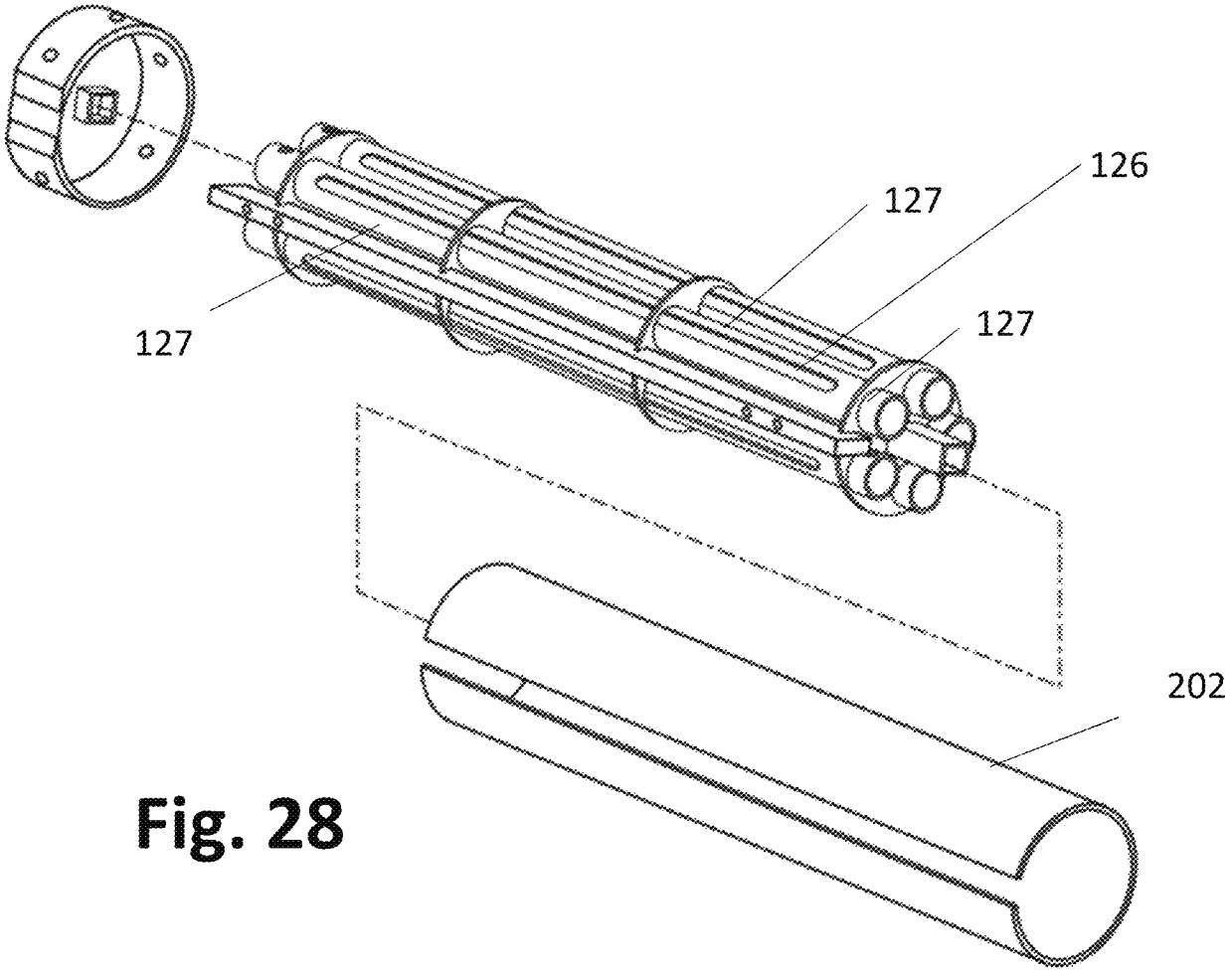
FIG. 28 is an exploded view of the canister with the tube members grouped and the wrapping removed.

FIG. 28 is an expanded view of a canister with the tubes grouped but the canister encasing, including the front of the canister and the canister cap, removed.

Figure 29:
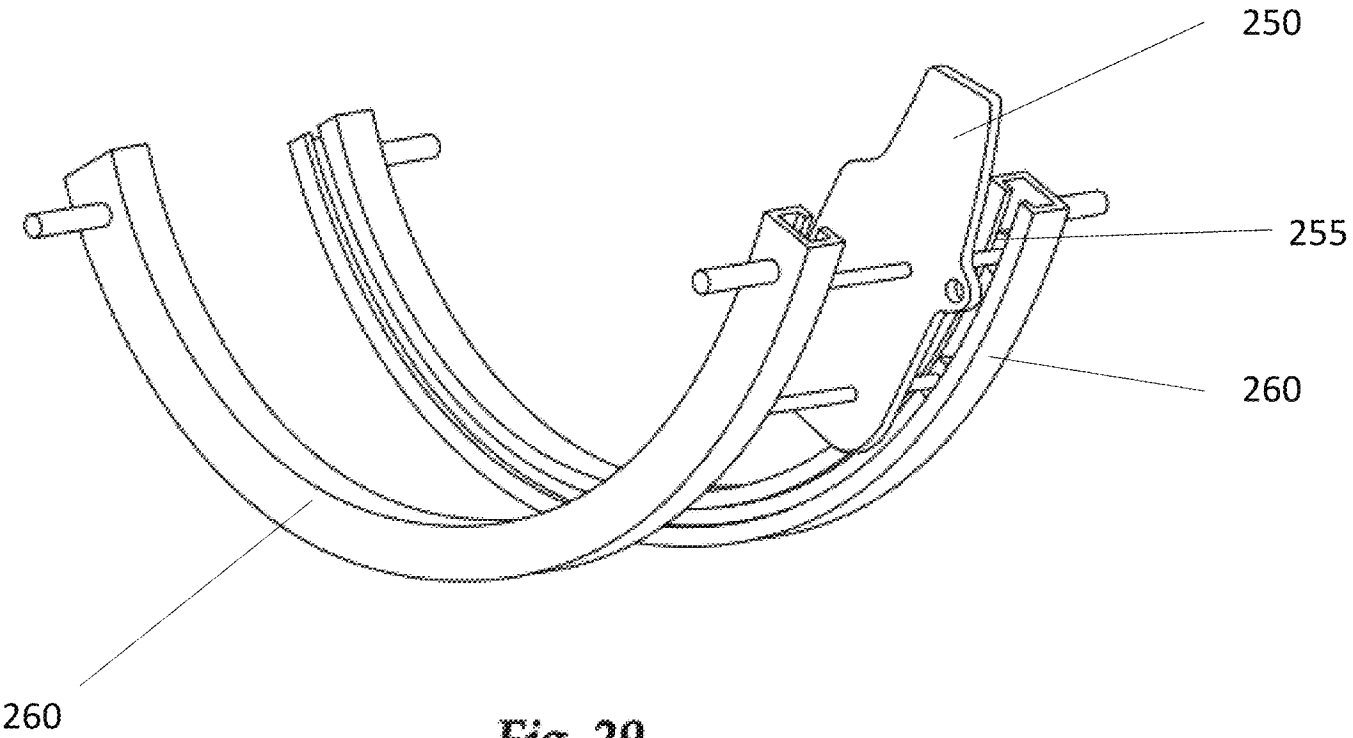
FIG. 29 is a view of one embodiment in which the trolley and track are curved members.

FIG. 29 illustrates one embodiment of a trolley and rail system in which the trolley 250 is a curved female member on a curved male member wherein the curved mail member functions as the tracking member. In this embodiment, the rails 260 are curved and contain a channel such that modified trolley wheels 255 can fit inside the rails. In another embodiment, multiple bar linkage can serve to replace the curved member and actuating member assemblies connected to the guide member. The guide member is pinned in the front so as to produce actuation. At a strategic spot on said guide arm it is pinned a second time by a lifting member. The lowest end of said guide arm in housed in a track. This assembly mimics the movements of the guide arm, trolley and rail system.

Figure 29A:
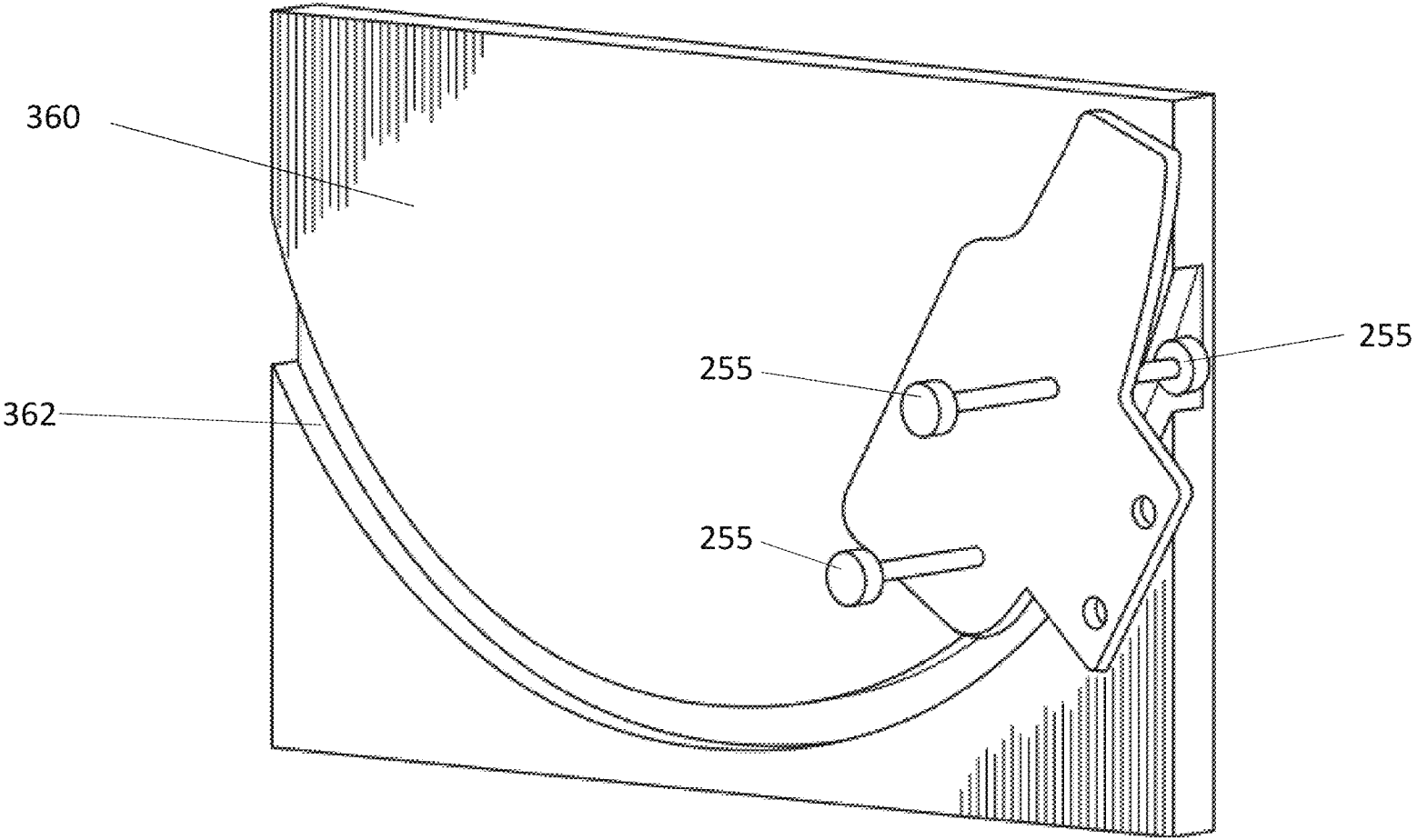
FIG. 29A is a view of another embodiment of a trolley and rail system with a solid wall.

FIG. 29A illustrates another embodiment of a curved trolley and rail system in which the rail system consists of a solid wall 360 with a carved, curved channel 362. The modified trolley wheels 255 fit inside the carved, curved channel.

Figure 29B:
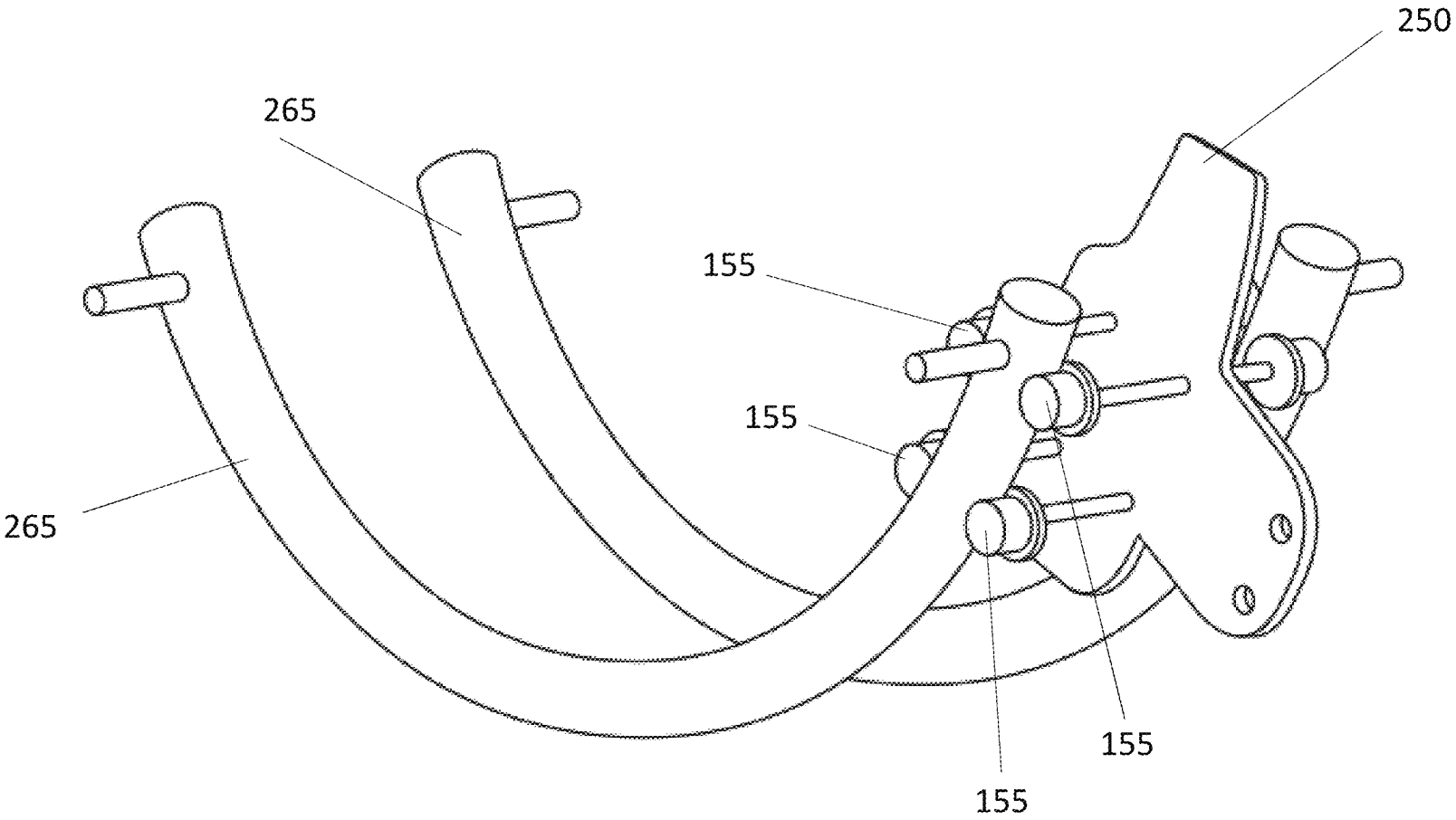
FIG. 29B is a view of another embodiment of a curved trolley and rail system.

FIG. 29B illustrates another embodiment of a curved trolley and rail system in which the at least two trolley wheels 155 of the sit on top of and under the curved rails 265. In this embodiment, the rails 265 do not have a channel.

Figure 30:
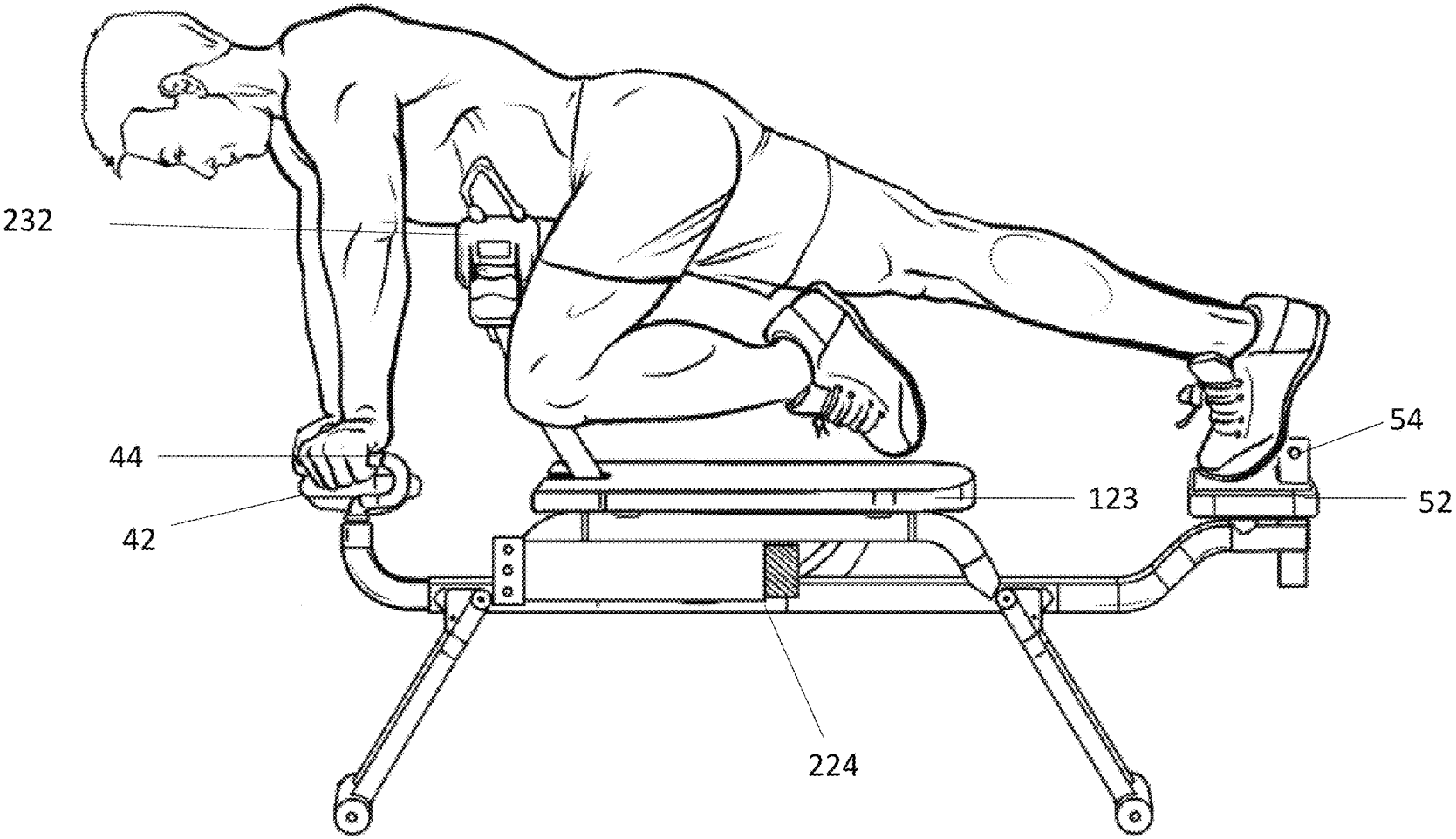
FIG. 30 is a side view of a user performing an assisted mountain climber plank.

FIG. 30 is a side view of a user on the machine performing an assisted mountain climber plank. In this position, a user places his or her hands on the handle bars 44 or the plank safety support pad 42 while his or her feet are placed on the foot support pad 52 against the foot support element 54. The abdomen of the user is in contact with a rectangular embodiment of the guide arm pad 232. In operation of this exercise, the user moves one knee inwards towards his or her chest while keeping the both hands on the handle bars or plank safety support pad and one foot on the foot support pad. The user then returns the foot of the leg which has been moved inward back to the foot support pad 52. This operation continues for a number of reps or is timed. The guide arm 30 and guide arm pad 232 allow a unique support and positioning which stabilizes the upper body in strict positioning allowing the user to focus exercise on the lower abdomen and hip flexor muscles. If desired, the user can employ the belt harness 34 and ratcheting belt mechanism to provide protection for the user or to form the abdomen.

Figure 31:
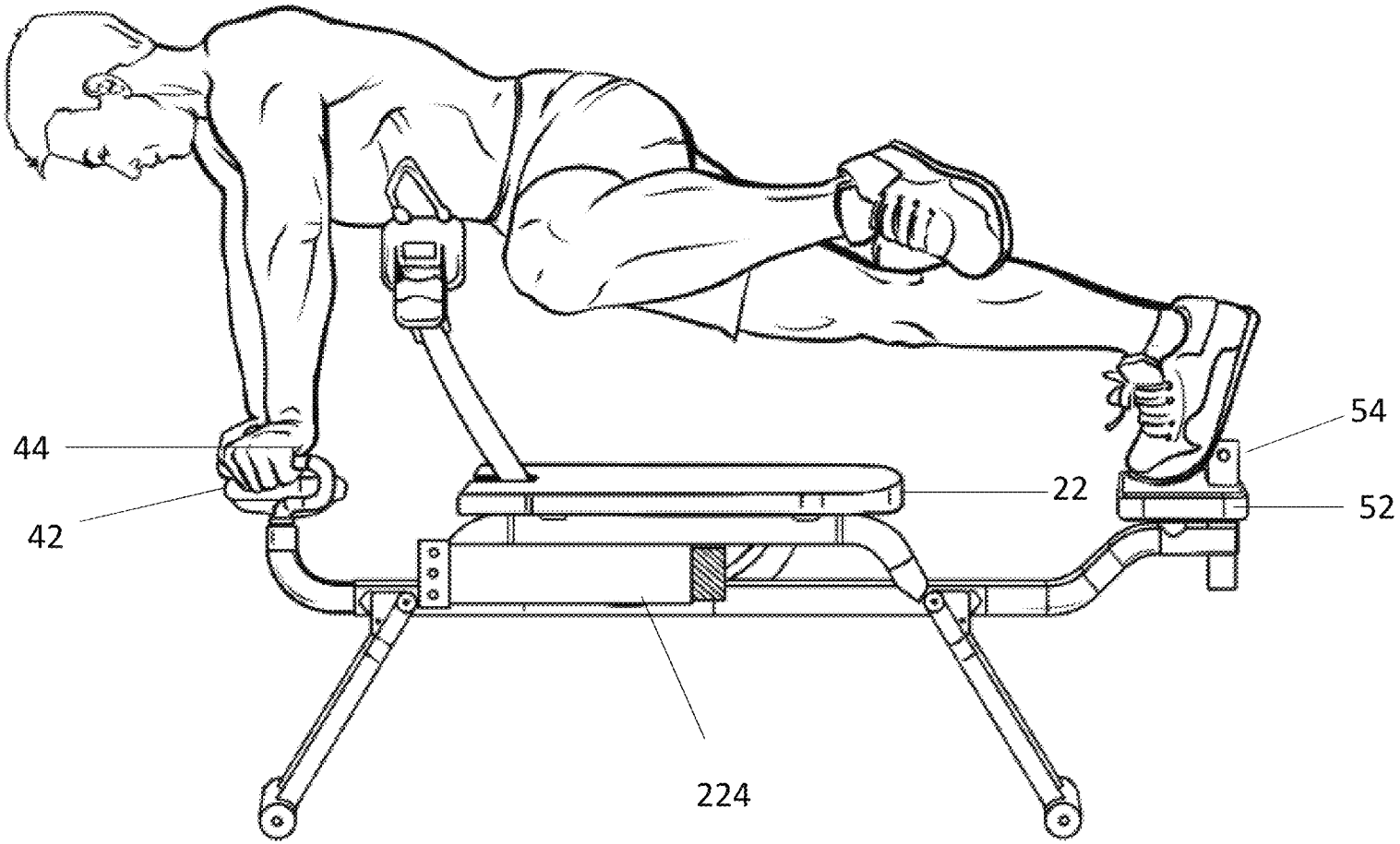
FIG. 31 is a side view of a user performing an assisted spiderman plank movement.

FIG. 31 is a side view of a user on the machine performing an assisted spider man or knee to elbow plank. In this position, a user places his or her hands on the handle bars 44 or the plank safety support pad 42 while his or her feet are placed on the foot support pad 52 against the foot support element 54. In operation of this exercise, the user lifts one knee outward to the side of the body, such that the leg is perpendicular to the body. The force originates from the head of the machine support area 40 which may be anchored as part of or outside of the core support 20 and insertion attachment to the bottom of the guide arm 30.

This figure is an illustration of an embodiment that is adapted to provide for both radial and telescopic adjustment. There are many planes of adjustment in both the head area and the foot area of the machine. For instance, all the adjustment points are not only seen at vertical and horizontal right angles, they can be seen in all radial ranges of motion as well. That is the purpose of the embodiment shown. The adjustments are not only vertically and horizontally oriented, but they can be radially oriented from two separate pivot points constructed in the head area, and two separate pivot points constructed in the foot area. The adjustment in the foot area is a bit more interesting, because they offer the exerciser the ability to widen their footprint by widening their foot position or by offering varied hand positioning. These hand positions can be the same or staggered.

Figure 32:
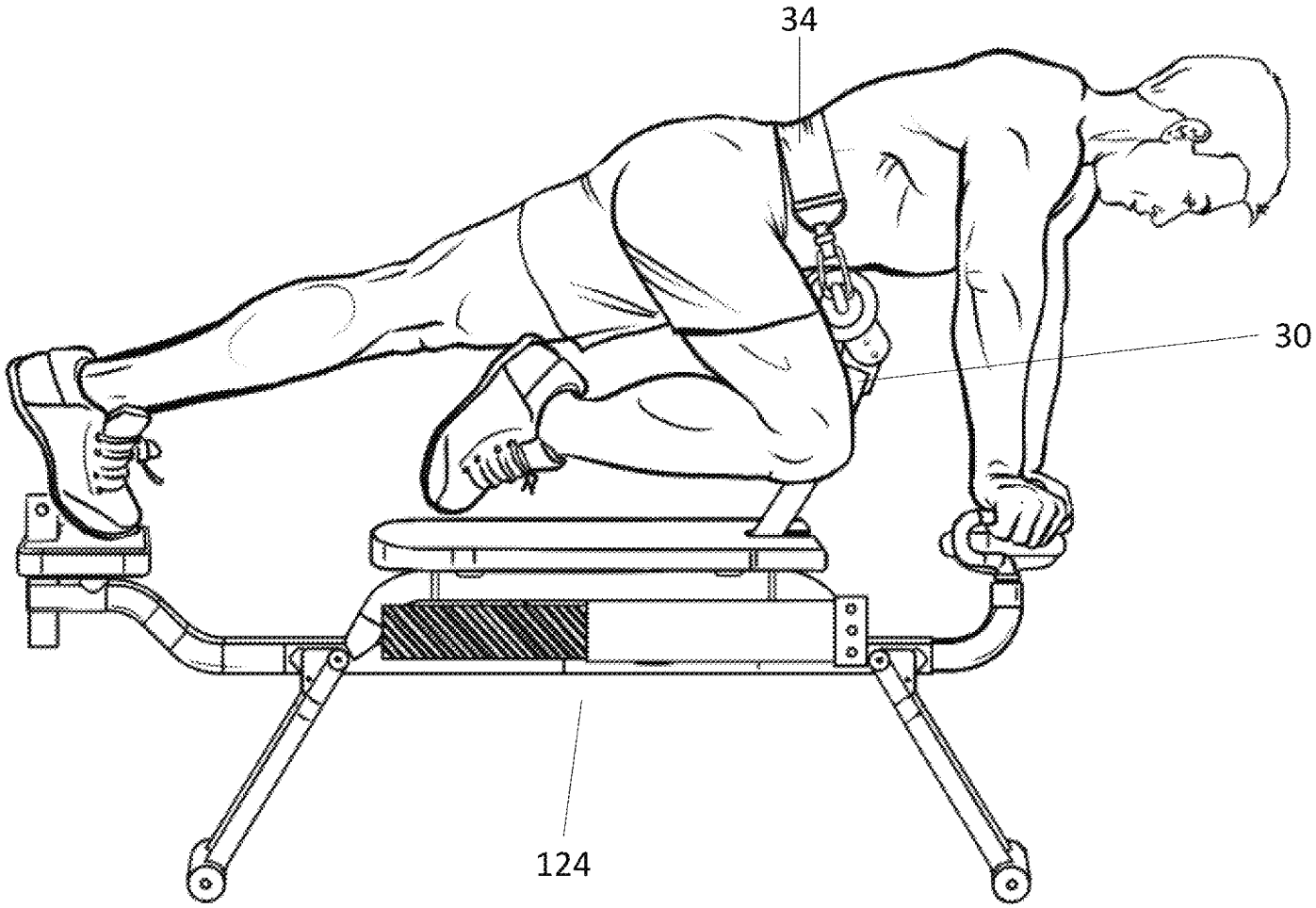
FIG. 32 is a side view of a user performing an added load mountain climber plank.

FIG. 32 is a side view of a user on the machine performing an added load mountain climber plank connected to the machine with a belt harness 34. In this view, the added load canister 124 is shown producing an added force. In this configuration, the assembly hinders the user as they attempt to complete the exercise, allowing for a more difficult exercise and increasing the workout level.

This figure is an illustration of an adapted embodiment for the head area of the machine. Instead of the preferred head area embodiment, a large padded platform is shown. The principal reason for this would be to allow the exerciser the ability to perform exercises whereby the pads of their hands come into contact with the machine for pushing up. There may be a desire to perform standard hand on floor type push-ups, or there may be a desire to perform more of a plyometric type push-up. That is what this platform embodiment would be for.

Figure 33:
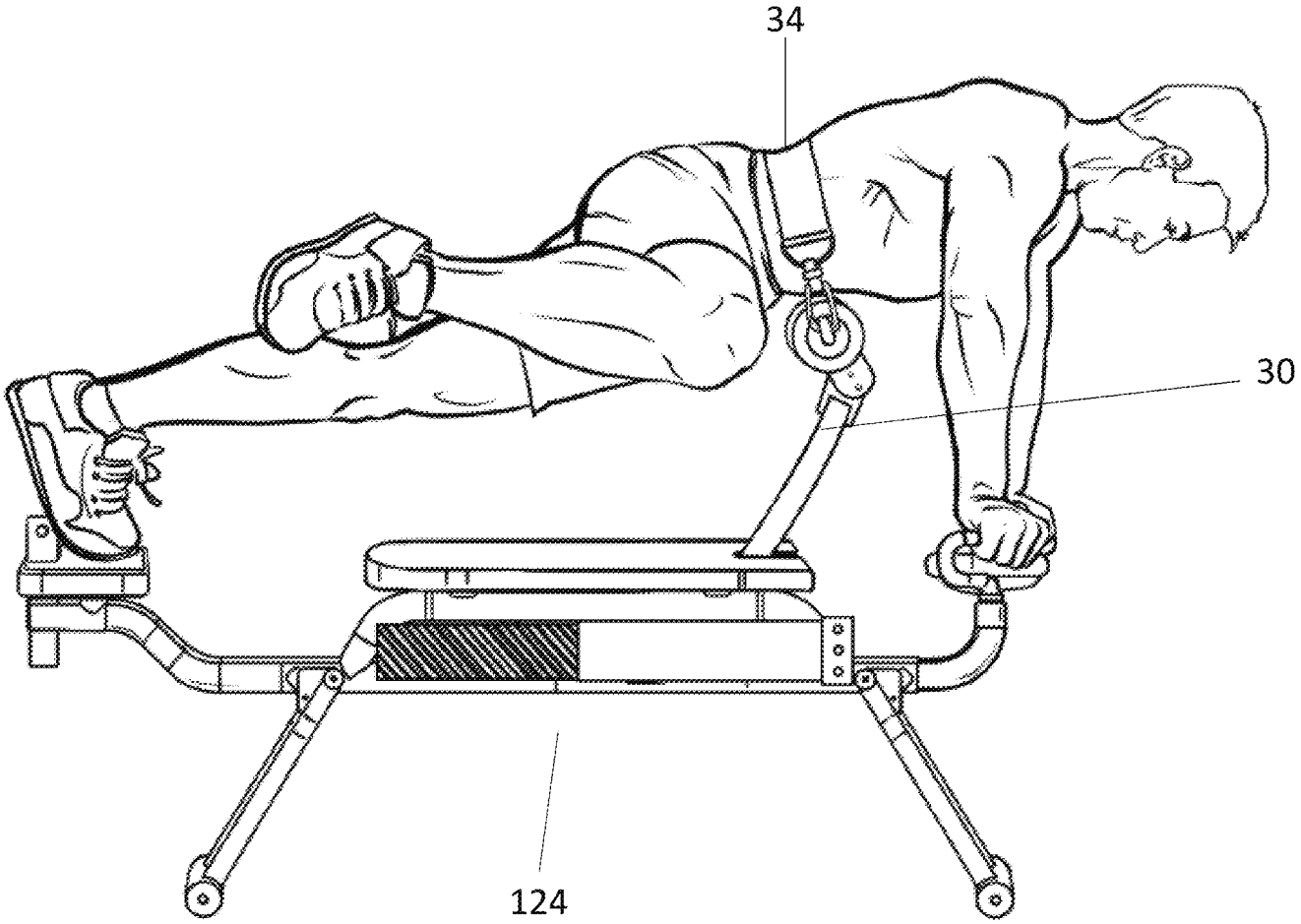
FIG. 33 is a side view of a user performing an added load spiderman plank movement.

FIG. 33 is a side view of a user on the machine performing an added load knee to elbow plank connected to the machine with a belt harness 34. Like in FIG. 31 the force of the added load canister hinders the user while they attempt to complete the exercise, allowing for a more challenging workout.

Figure 34:
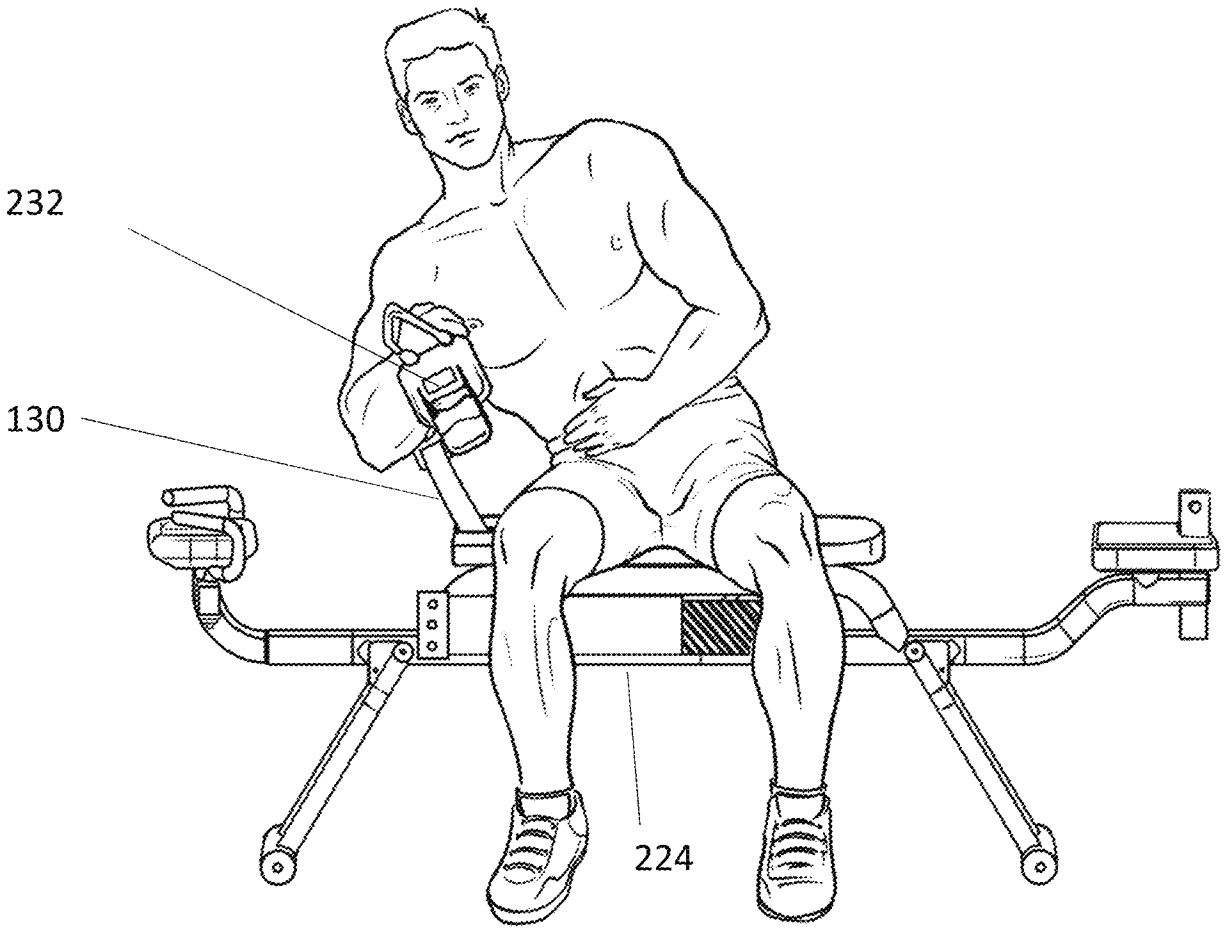
FIG. 34 is a side view of a user performing an assisted side torso exercise in the active position.

FIG. 34 illustrates a side view of one embodiment of the exercise machine with the machine facing left and the exerciser facing the viewer of the drawing, performing an assisted side torso movement exercise. The machine is set up such that the assisted canister 224 is producing assistive force. To perform this exercise, the user declines his or her body either to the side or backwards, while hugging the guide arm pad 232 and being assisted by the machine. Once the user is at the bottom of the range of motion, he or she will then return to a vertical position. In this exercise, the assistance of the machine allows the user to concentrate on creating a vacuum in his or her abdomen and concentrate the vacuum in a specific area. This exercise can be used to combat and affect diastasis recti which is a condition whereby the fibrous tissue in between the two halves of the abdomen becomes weak and create a protrusion.

Figure 35:
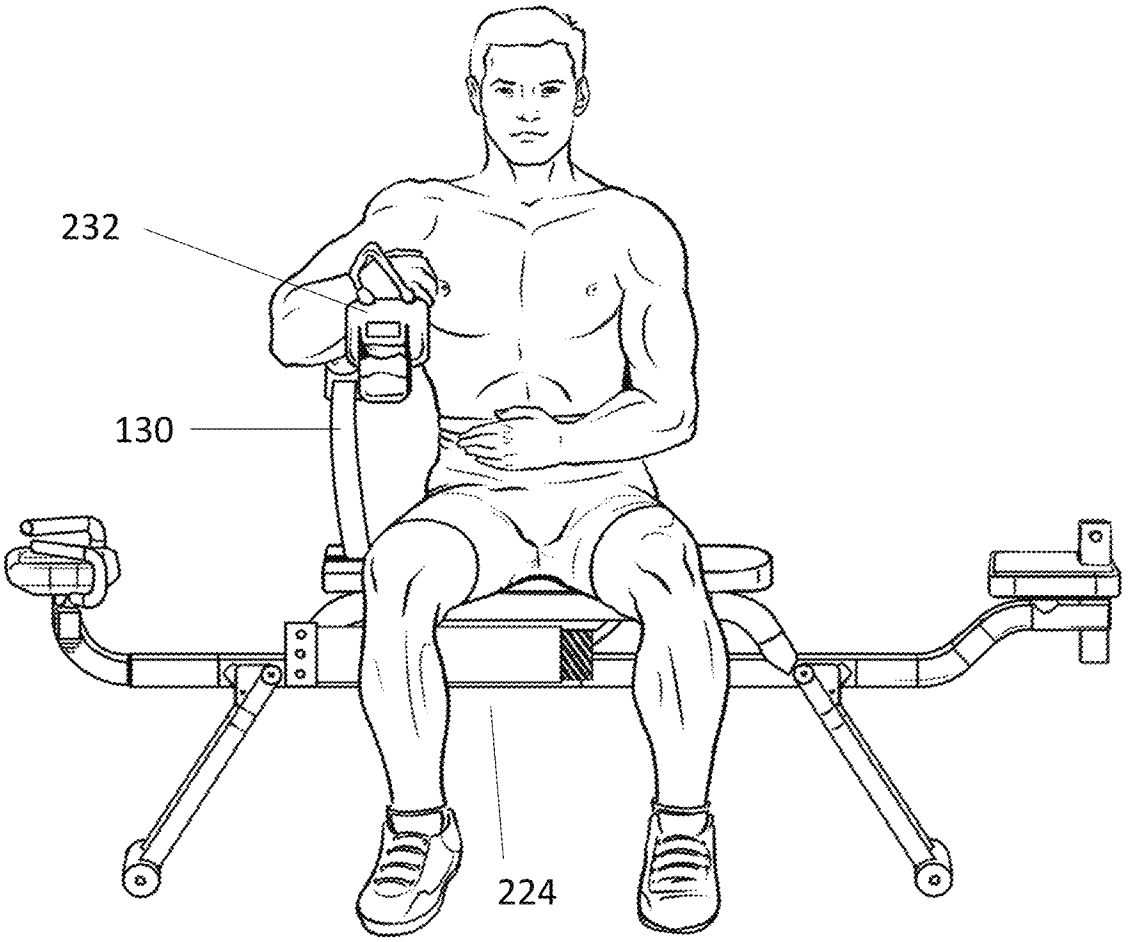
FIG. 35 is a side view of a user in the neutral position of an assisted side torso exercise.

FIG. 35 illustrates one embodiment in which the user is in the vertical, neutral position of the side torso movement exercise as described in FIG. 34.

Figure 36:
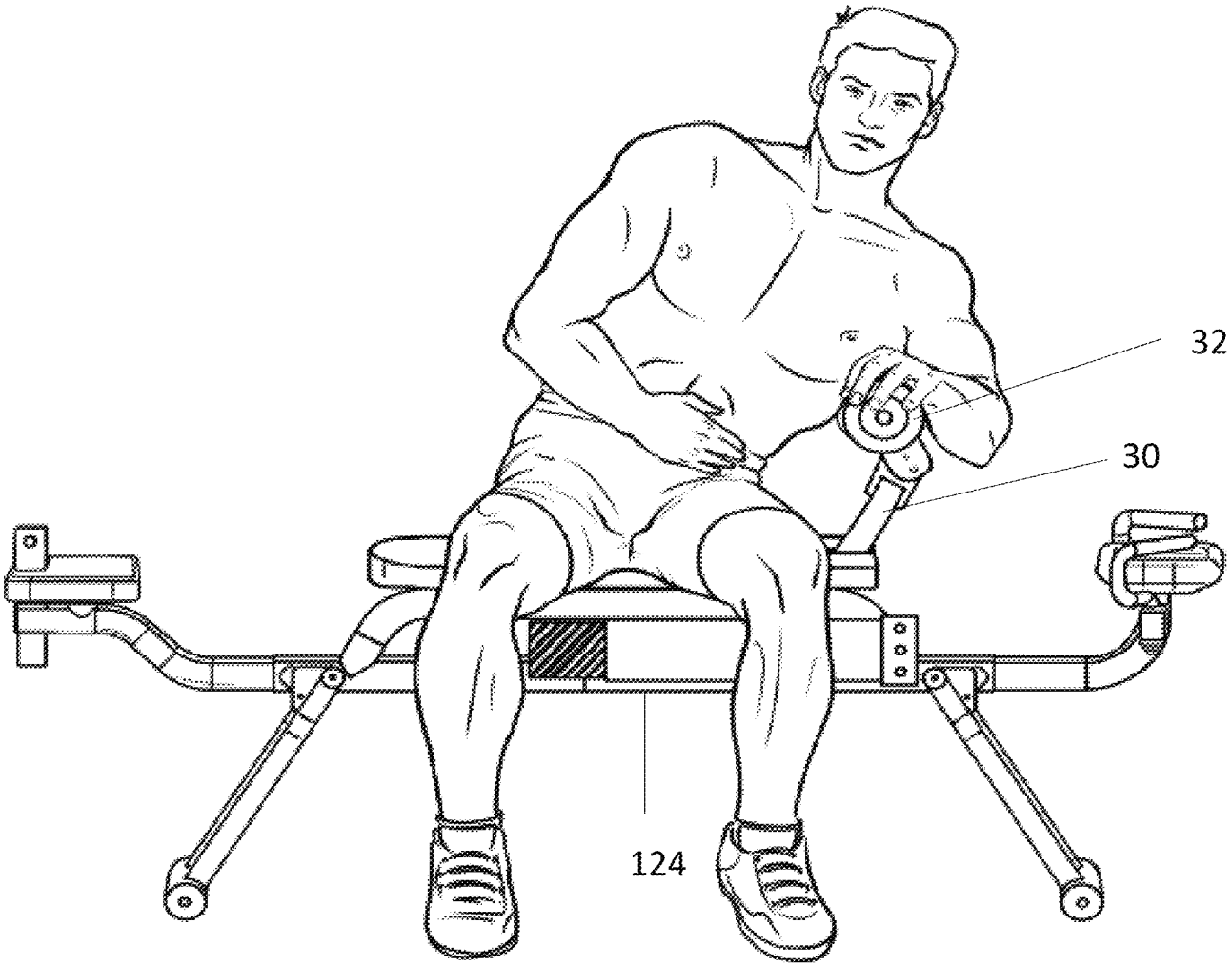
FIG. 36 is a side view of a user in an active position of an added load side torso exercise.

FIG. 36 illustrates one embodiment of an added load side torso movement exercise. The added force is produced by the added force canister 124. This exercise is performed in a similar manner as described in FIG. 34, however in this embodiment the user picks up the guide arm 30 and hugs the cylindrical embodiment of the guide arm pad 32 with his or her arm. The guide arm 30 will then hinder the user as he or she tries to return to a vertical position, thus making the exercise more difficult and increasing the intensity of the workout. The user can perform this side torso exercise either concentrically or eccentrically. When performing this exercise, the counterbalancing half of the abdomen has a propensity to want to move toward the active half of the abdomen. This is very exciting when trying to promote abdomen exercises that have the goal of pulling the abdomen in. Further, this is beneficial because it does not require putting outward pressure on the middle of the abdomen whereby making a diastasis rectis worse. Instead, performing the exercise in this way can promote the coming together of the two halves of the abdomen. When doing this eccentrically this is further exciting. This is because having the user hinder the movement of the machine in this fashion causes the two halves of the torso to come together with even more intensity.

Figure 37:
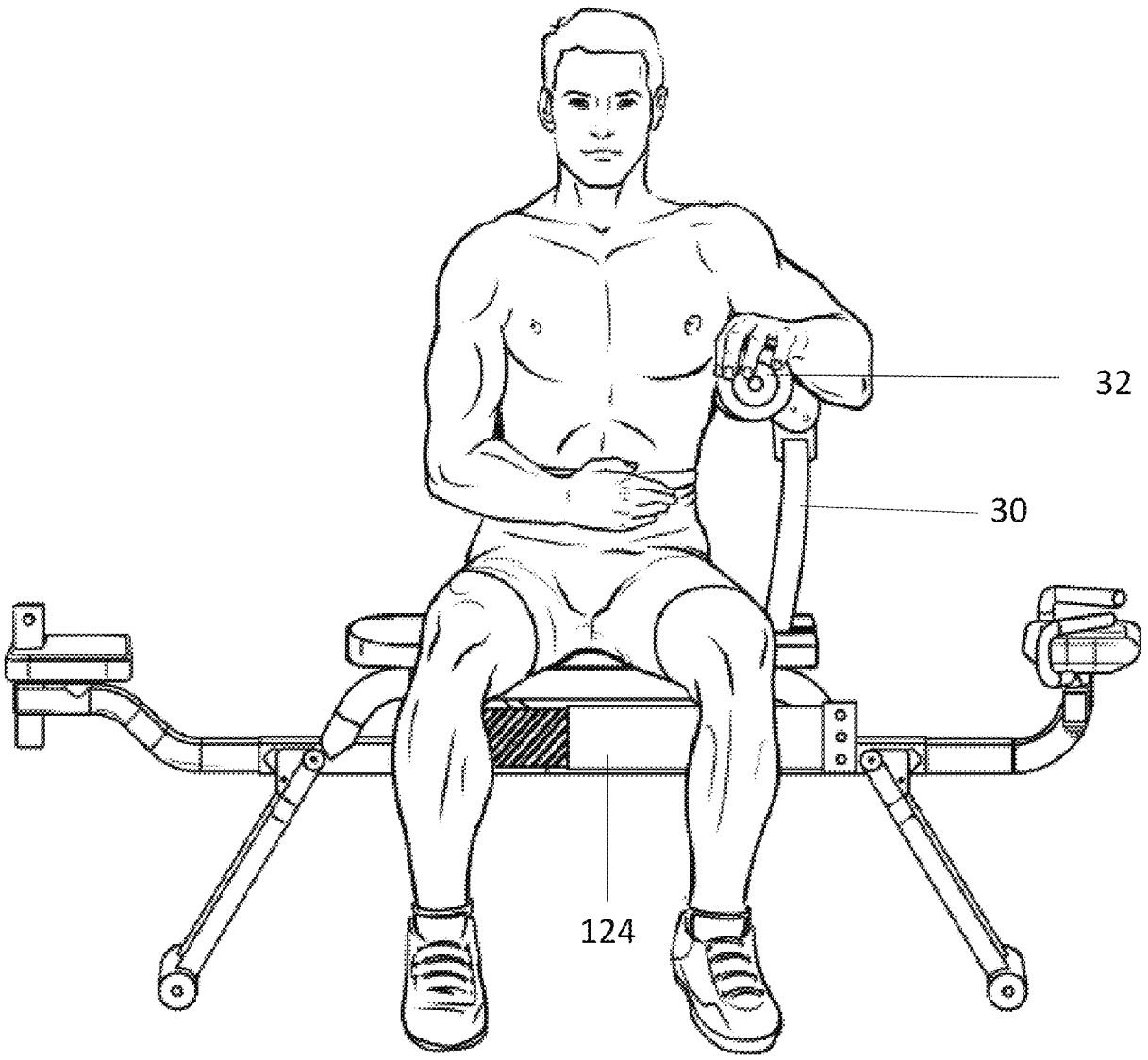
FIG. 37 is a side view of a user in a neutral position of an added load side torso exercise.

FIG. 37 illustrates one embodiment in which the user is in the vertical, neutral position of the side torso movement exercise as described in FIG. 36.

Figure 38:
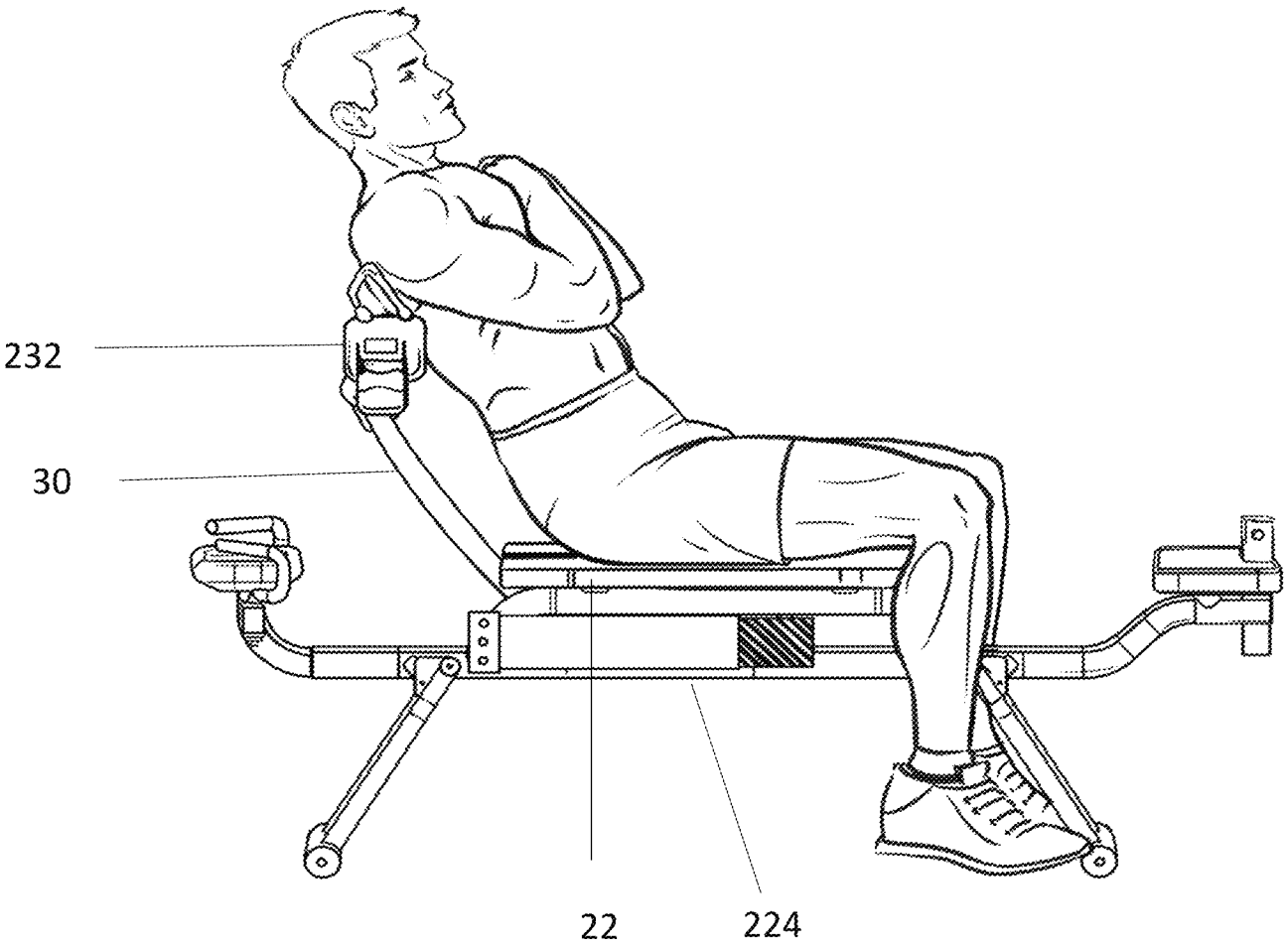
FIG. 38 is a side view of a user performing an assisted seated abdominal exercise in the active position.

FIG. 38 illustrates one embodiment of an assisted seated abdominal exercise. In this embodiment, the machine is facing left and the user is facing right. The assisted canister 224 is producing force to assist the user in performing this exercise. To perform this exercise the user starts in the vertical position. The user can either put their arms across their chest or hold the harness over their shoulders. To proceed, the user leans backward 15 to 20 degrees. At this point the user starts to head back toward the beginning position while simultaneously pressing their feet into the floor. As stated above, this causes the hip flexor muscles to go in the opposite direction and thereby promotes the movement to be performed more by the abdominal muscles in a very safe and efficient manner. This exercise is accentuated and can be intensified by the strictness inherent in the guide arm 30. A derivative of this assisted vertical abdomen exercise would be to twist during the range of motion. This would engage the oblique musculature more intensely.

Figure 39:
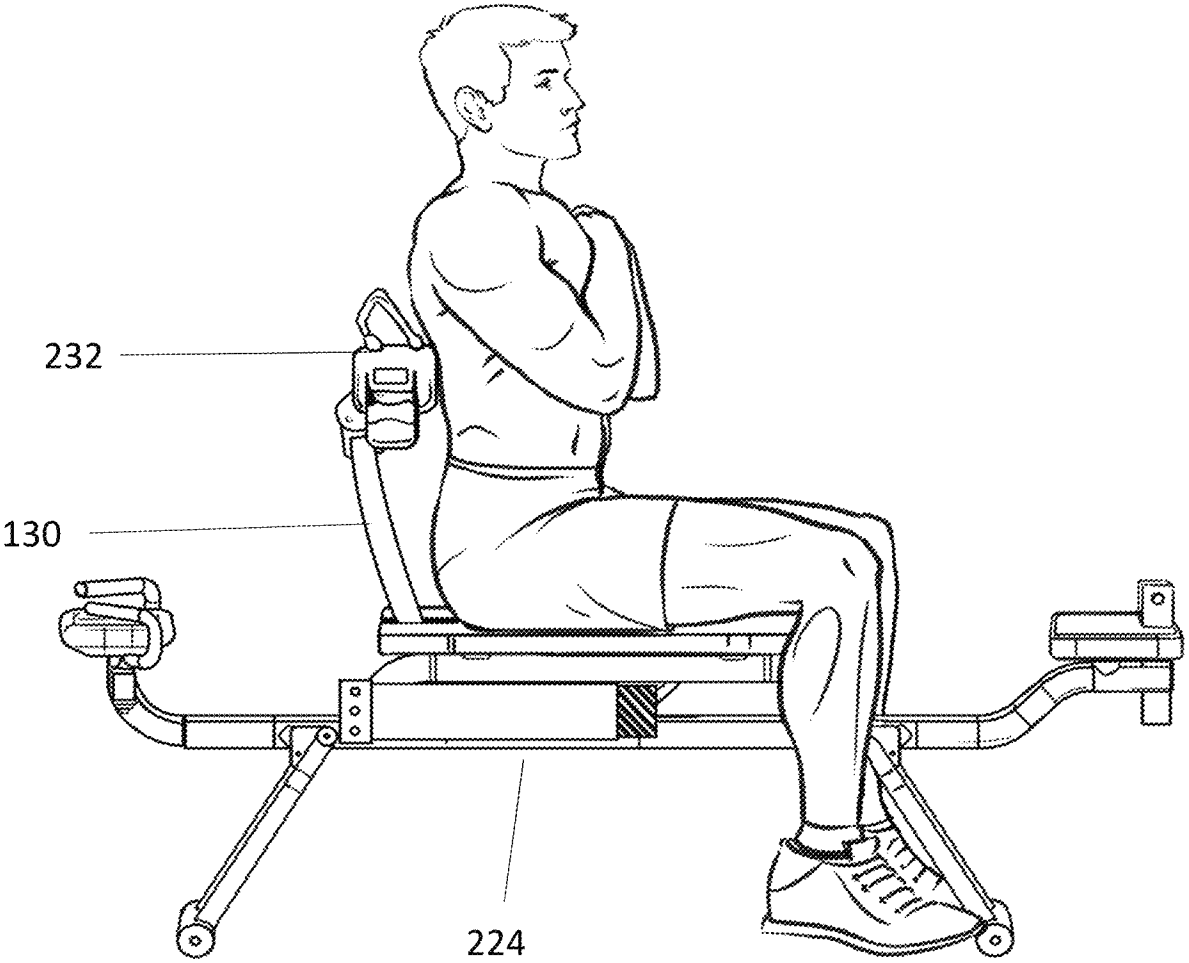
FIG. 39 is a side view of a user performing as assisted seated abdominal exercise in the neutral position.

FIG. 39 illustrates the neutral position of the same exercise as described in FIG. 38.

Figure 40:
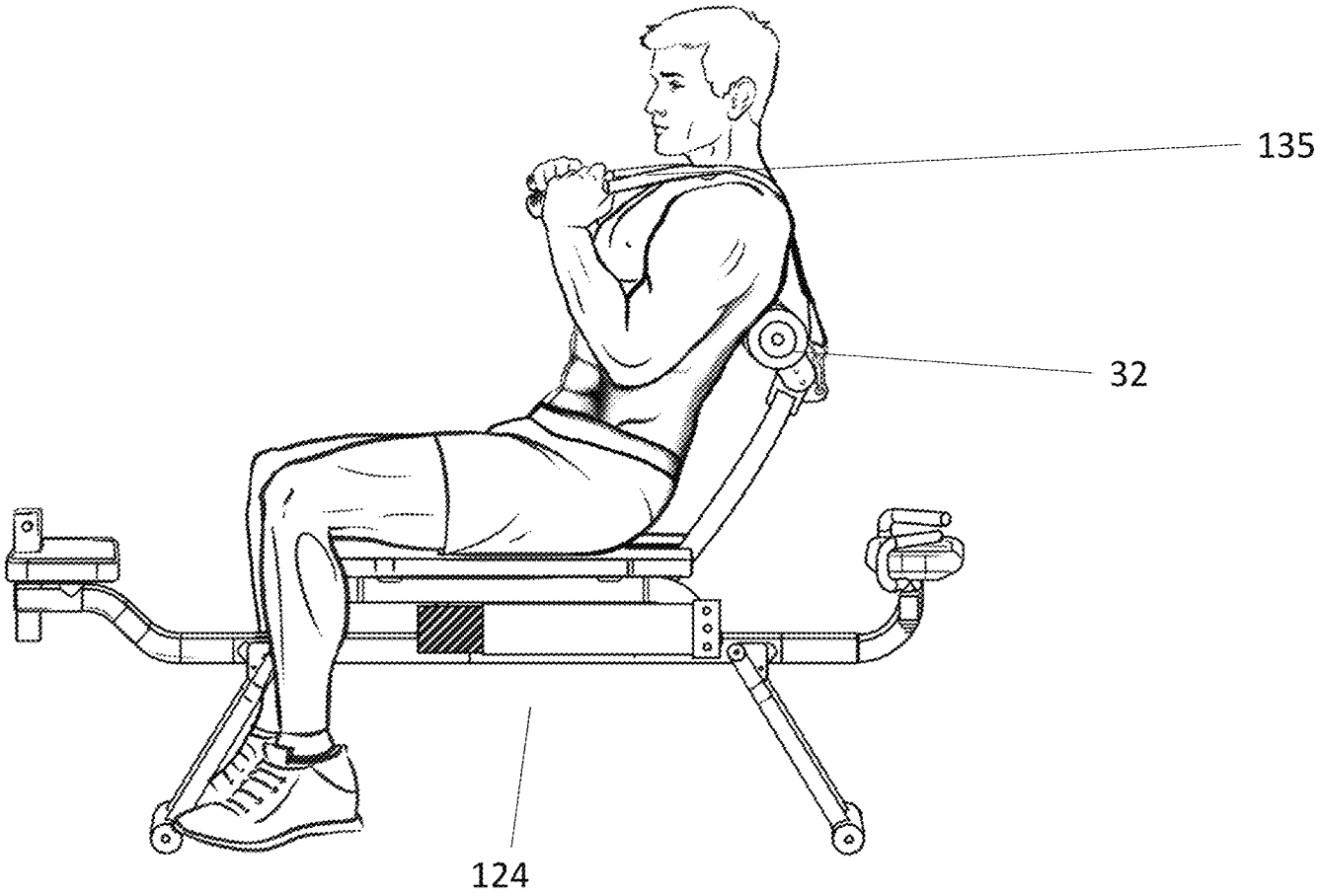
FIG. 40 is a side view of a user performing an added load seated abdominal exercise in the active position.

FIG. 40 illustrates one embodiment of the added load variation of the exercise described in FIG. 38. In this embodiment, the user is facing left while the machine is facing right. The force is exerted by the added load canister 124 to hinder the workout and increase the difficulty. To perform this exercise the user must pick up the harness 135 holding it by the hand grips. Raise it overhead while the harness is connected to the machine which is in the down position. The user should then secure the harness on his or her shoulders as shown in the figure. In further performance of the exercise, the user starts in a vertical position and leans backward against one embodiment of the guide arm pad 32 and pushes against the guide arm 30. Once the user reaches the comfortable end of the range of the exercise they proceed to pull the machine back to vertical by contracting their abdomen and moving their torso forward.

Figure 40A:
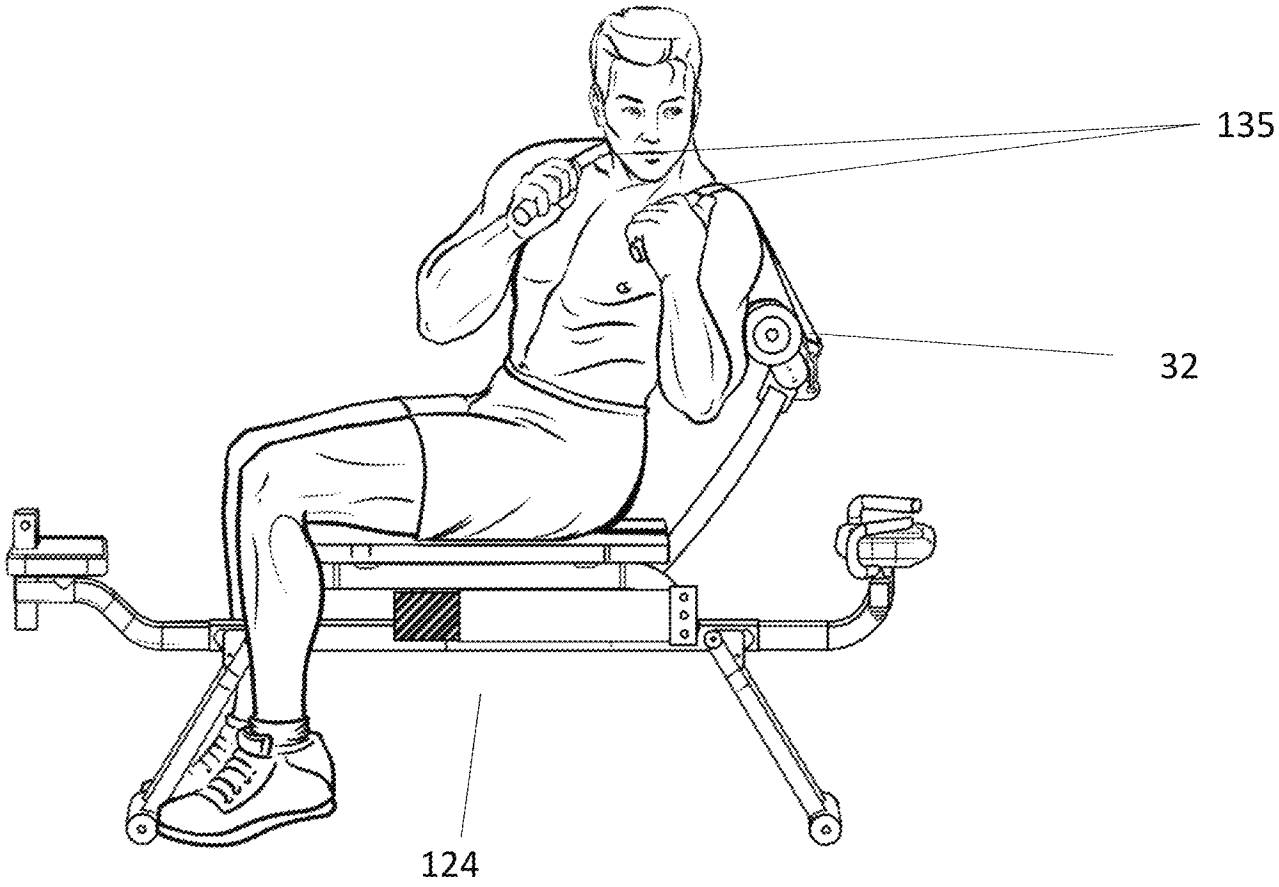
FIG. 40A is a side view of a user performing a seated abdominal exercise with twisting.

FIG. 40A illustrates the same exercise as described in FIG. 40, however in this illustration twisting motions are performed by the user to exercise the obliques.

Figure 41:
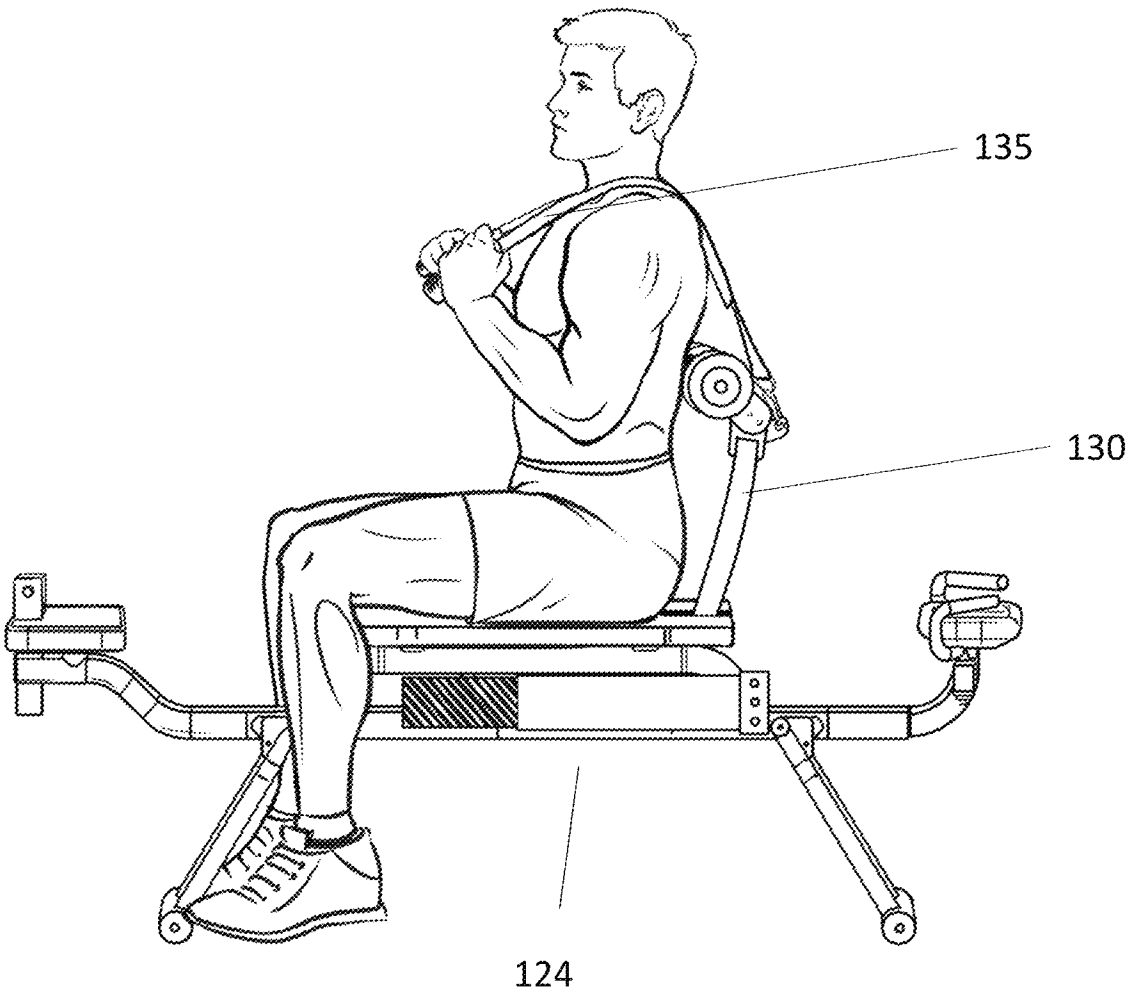
FIG. 41 is a side view of a user performing an added load seated abdominal exercise in the neutral position.

FIG. 41 illustrates one embodiment of neutral position of the exercise described in FIG. 40.

Figure 42:
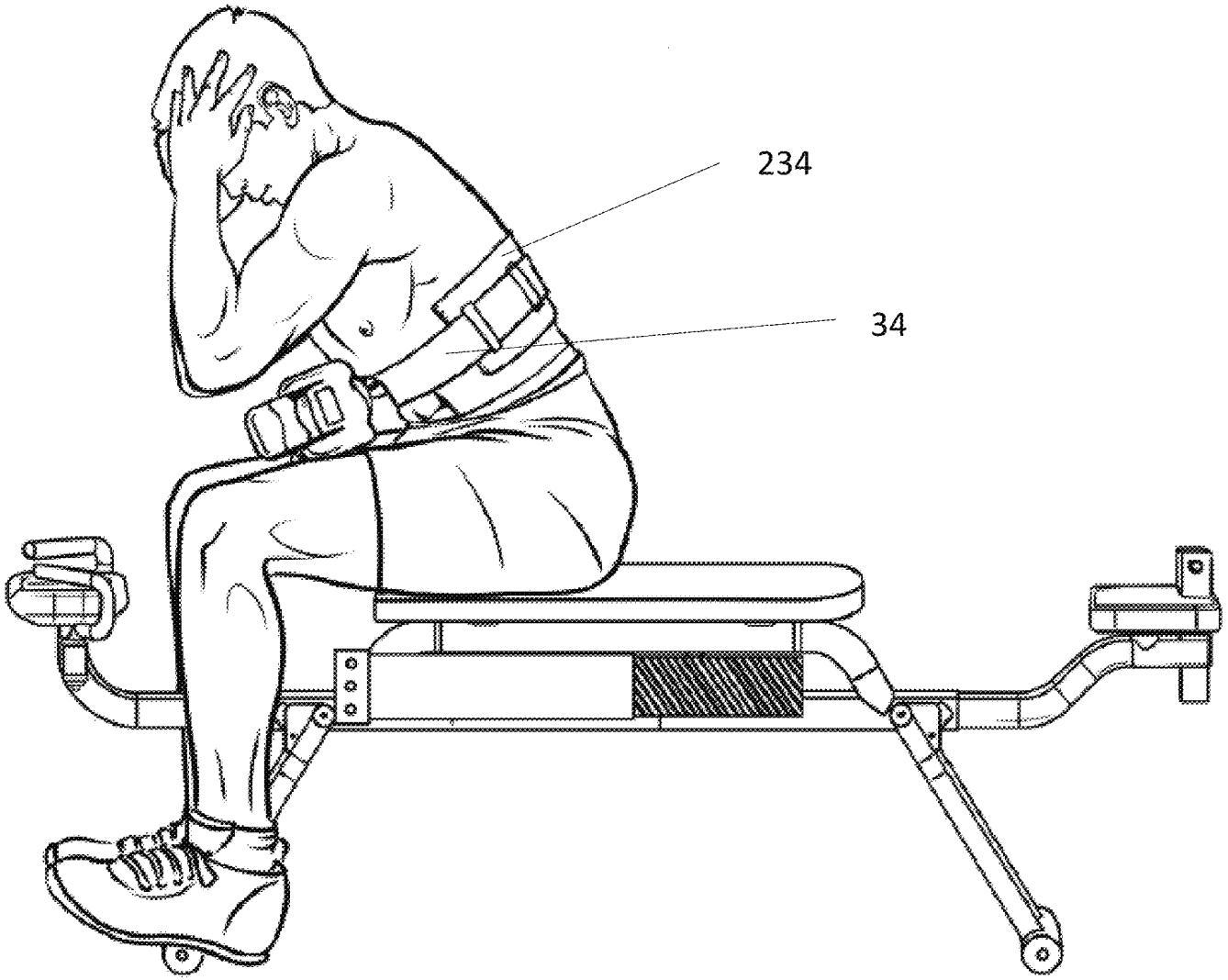
FIG. 42 is a side view of a user performing a seated back extension as part of an abdominal exercise.

FIG. 42 this is a side view of the machine with an exerciser facing left. The exerciser is performing a very unique and correct back extension exercise. This figure illustrates the second phase of the movement. The first phase is moving from neutral to the position shown. To perform this exercise, the user sits on the machine as shown. The user then grasps the guide arm 30 as it is in added load. They then proceed to put the strap of the belt harness 34 around their upper back and clip it to the receiving member. A pad 234 on the belt as shown is usually used here. When in this position the user ratchets the belt, and creates a tighter connection between themselves and the rollers of the guide arm. Even though the user ratchets, they do not ratchet all the way and leave some slack between themselves and the rollers. From the neutral position the user bends forward with the resistance of the machine pulling them in this direction.

Figure 43:
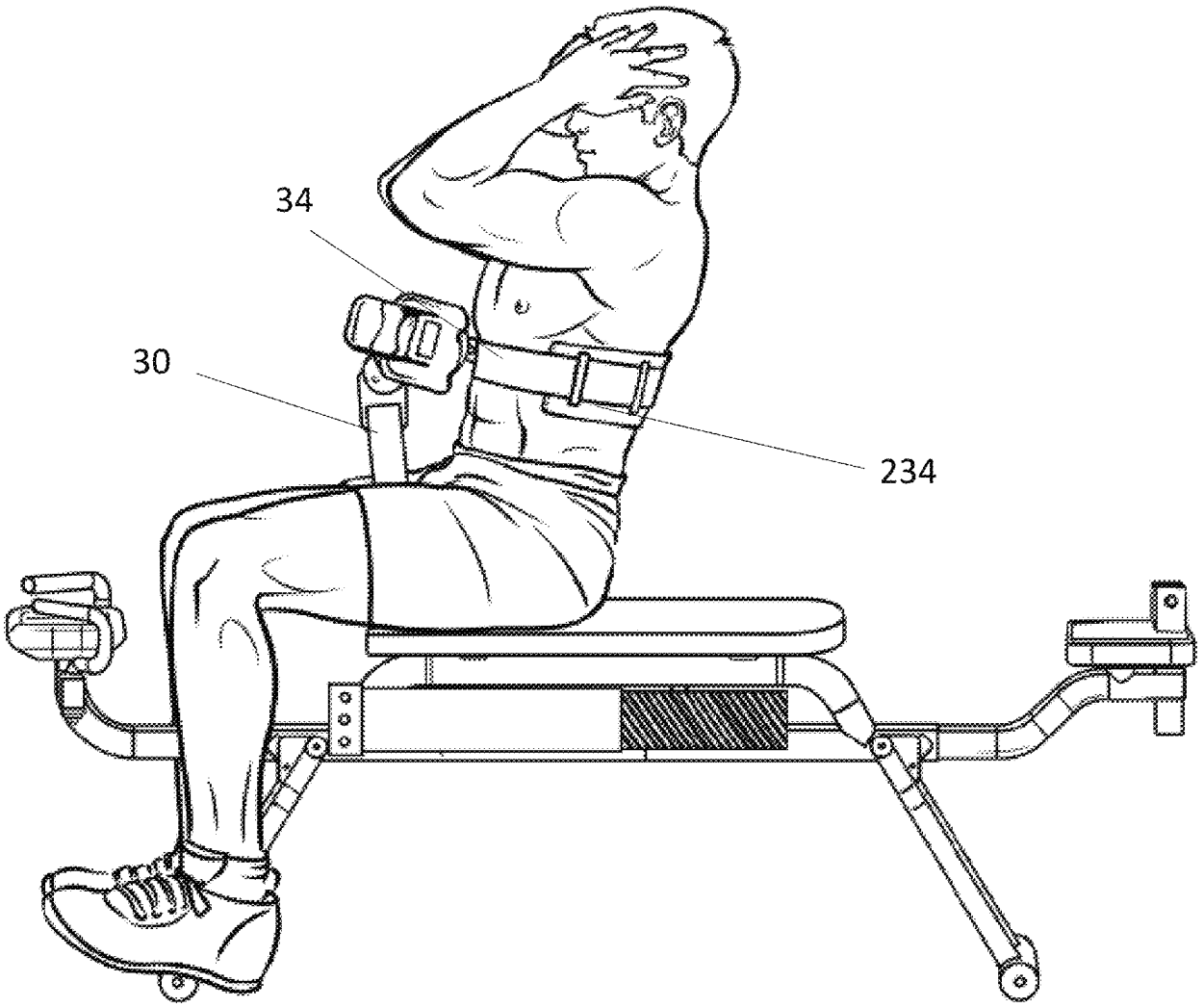
FIG. 43 is a side view of a user performing a seated abdominal exercise.

FIG. 43 in this figure, the third and final phase of the exercise in FIG. 42 is illustrated. To perform this phase the exerciser tightens their abdominal muscles and moves backward to a position just past or somewhere past neutral based on how far the machine will let them. This is a very different type of back extension exercise that possibly has never been done before. It is surprising how much the abdomen is involved in this movement. In the performance of the phase of the exercise the user is pulling the body backward against the resistance of the machine. This is much different and more correct than an exerciser pushing against a force that is pushing on them. This is also excellent because the machine as well as the design of the exercise does not allow the exerciser to perform said exercise past safe ranges of motion into hyperextension.

Figure 44:
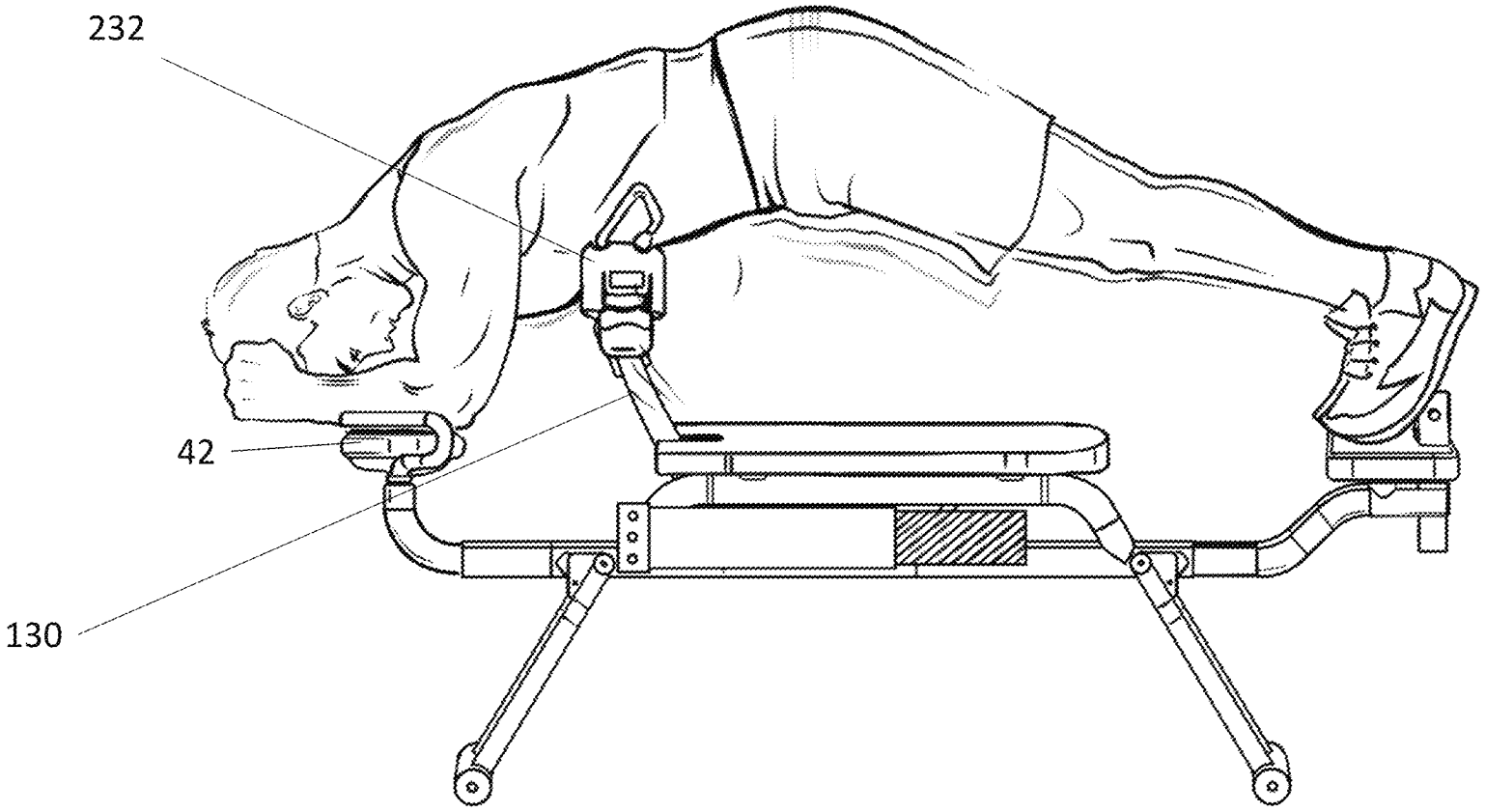
FIG. 44 is a side view of a user performing an assisted major movement plank.

FIG. 44 illustrates one embodiment of a user utilizing the machine to perform an assisted major movement plank. To perform this exercise, a user starts in plank position and pulls his or her body up to achieve the position shown. The user's chest is supported by the guide arm 30 and the guide arm pad 232 while the user's arms are on the plank support pad 42.

Figure 45:
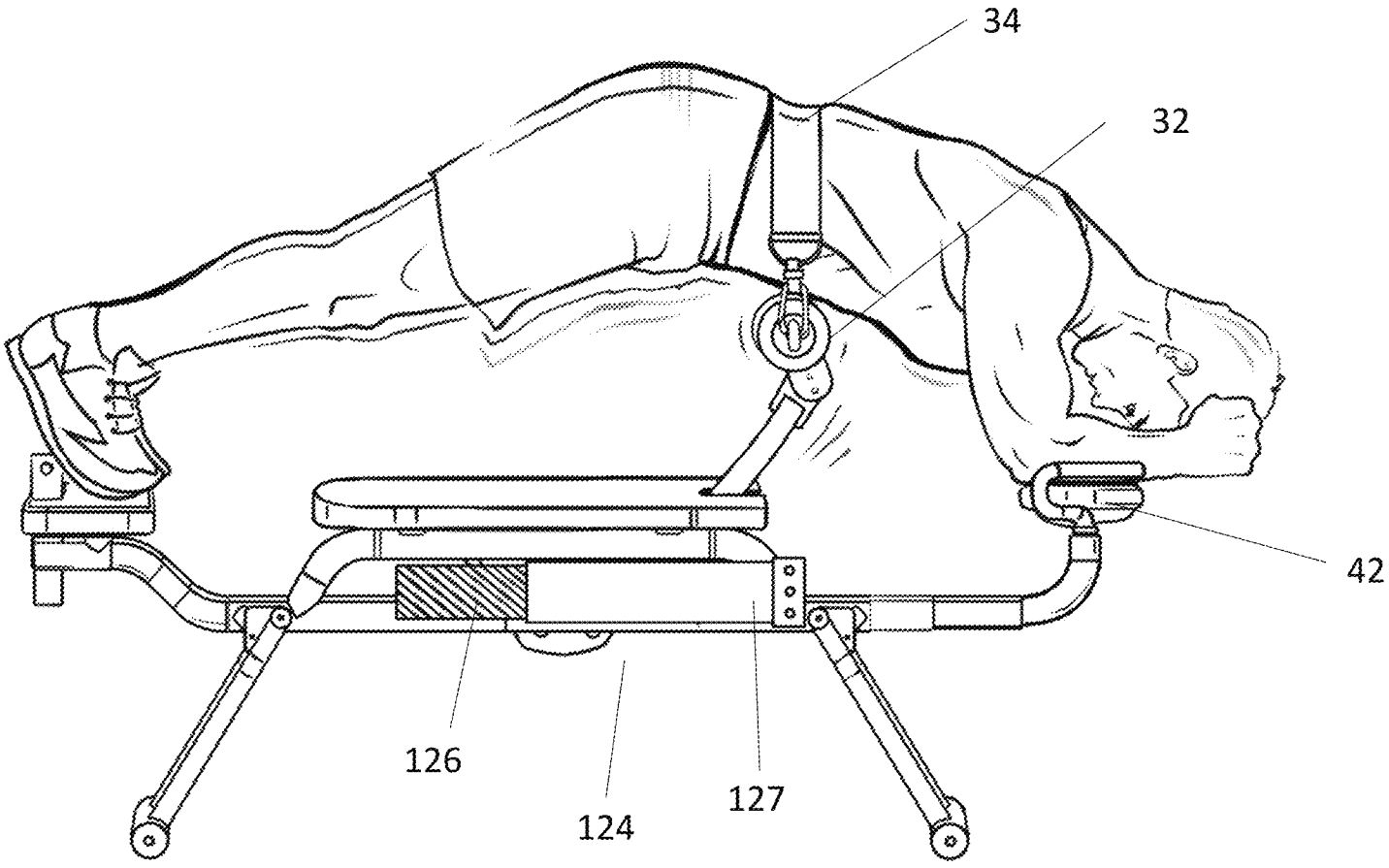
FIG. 45 is a side view of a user performing an added load major movement plank.

FIG. 45 illustrates another embodiment of a user utilizing the machine to perform an added load version of the exercise described in FIG. 44. The ratcheting and protecting element of the guide arm 30 and belt assembly 34 allow a user to perform this added load exercise. The exercise is performed by starting in plank position and pulling the body up to achieve the position as illustrated. In doing this the user imparts a very different stimulus on the abdomen. The same rib and chest musculature are involved as well as with exercises in the above figures of FIGS. 6 and 6*a*.

Figure 46:
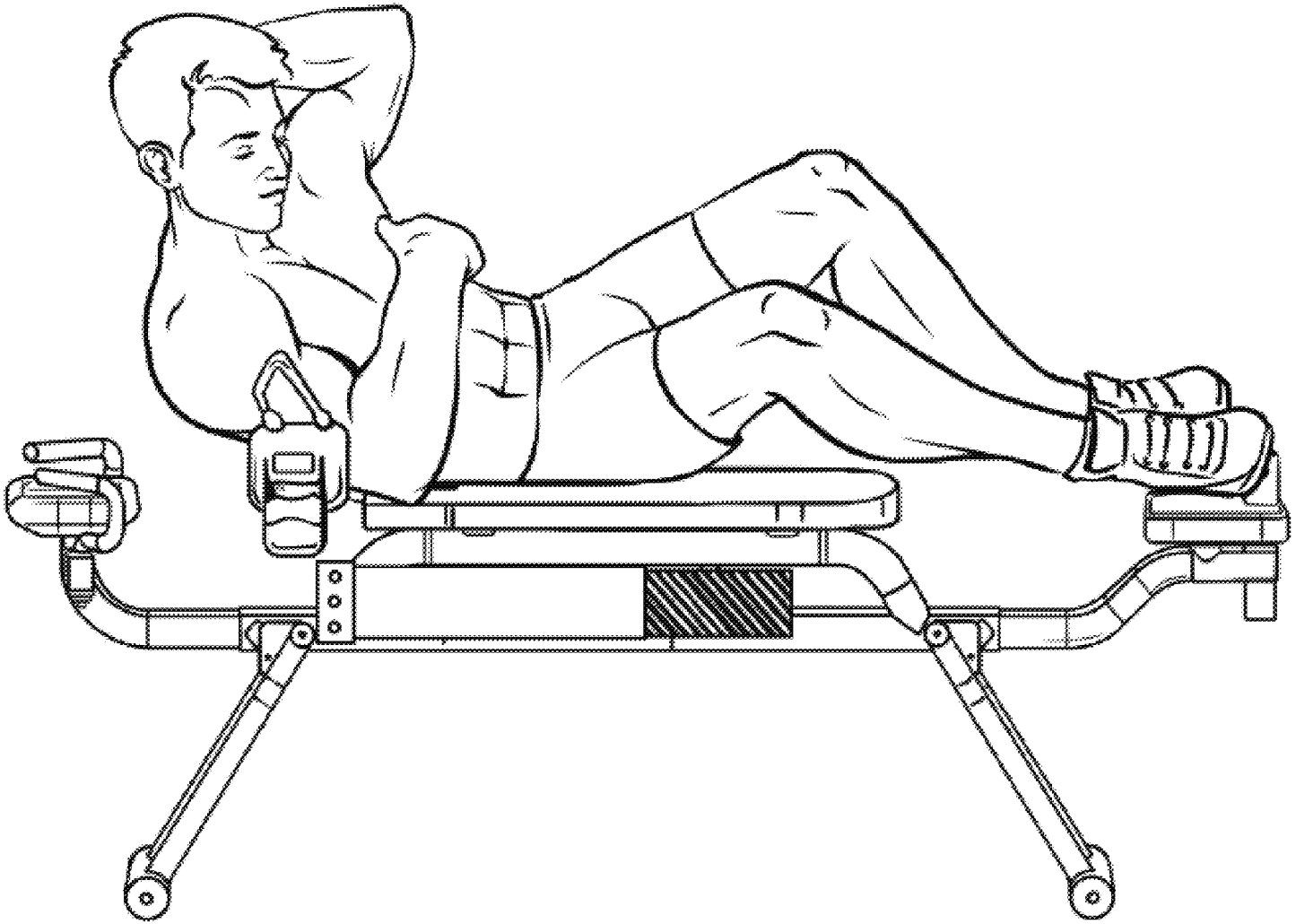
FIG. 46 is a side view of a user performing a twisting sit up exercise.

FIG. 46 illustrates an embodiment of a use of the machine in which a user performs a horizontally oriented traditional sit-up.

This exercise is performed by getting on the machine in a regular sit-up position and then rolling over onto one hip or the other. The shoulder of the opposite side being affected is usually principally in contact with the roller. In light of the assistance this exercise can be performed in many different angles. The exercise can be performed almost completely straight up and down in the sagittal plane. This is because of the assistance and guidance. This would be close to impossible without the machine.

Figure 47:
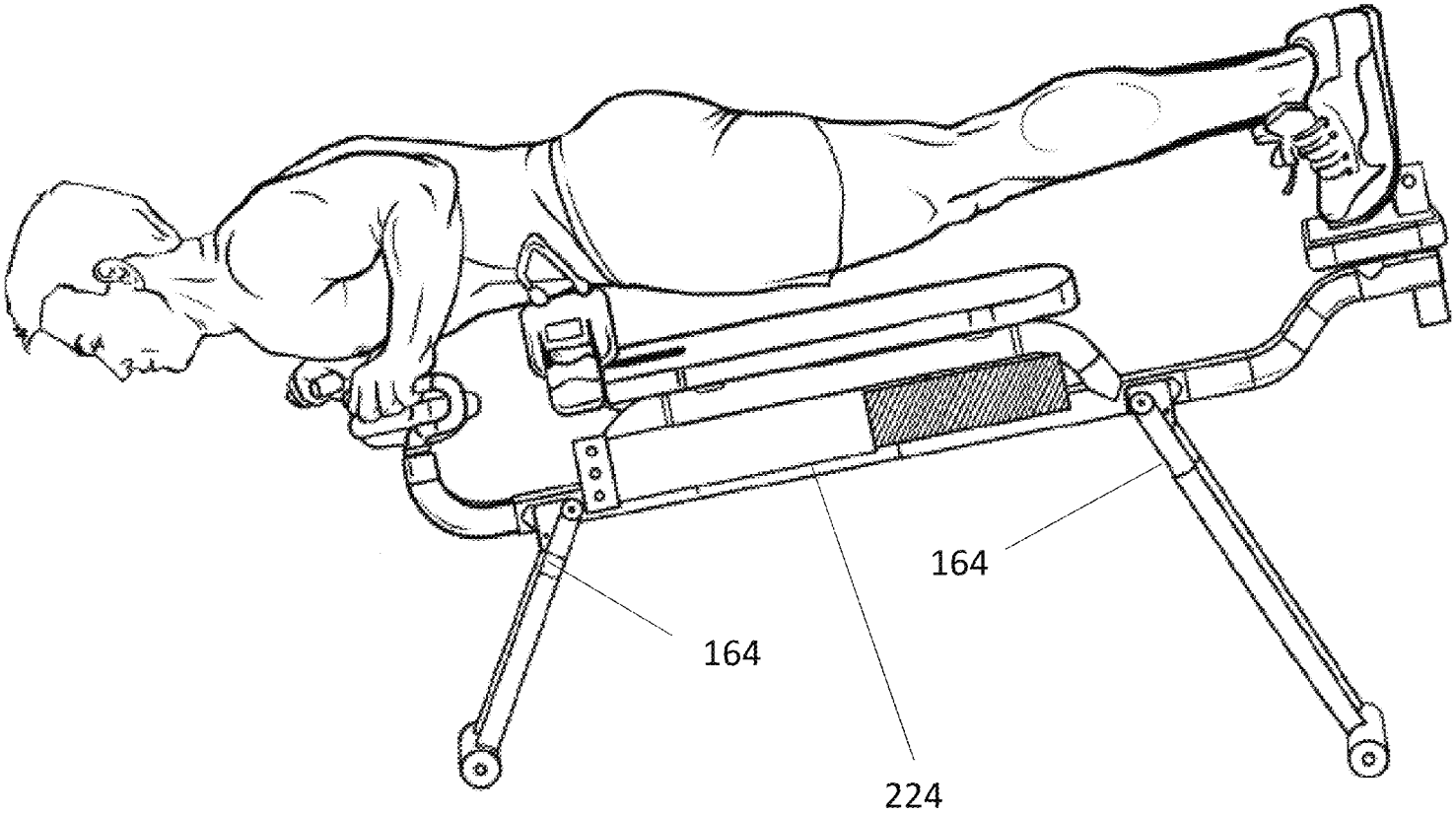
FIG. 47 is a side view of a user performing a decline push up exercise.

FIG. 47 illustrates an embodiment of the machine wherein the machine can be propped up by a jack or a telescoping leg mechanism 164 to form a decline. This creates greater force across the upper chest than is put across the upper chest in a flat bench position, much like how the upper chest is targeted more by performing an incline bench press as opposed to a flat bench press. The purpose of this figure is to illustrate how the user could put their body on an angle thereby affected how the force is being applied to the musculature of the upper body. In the figure, the user is facing left, the machine is facing left and the canister on the left side of the machine is the assisted canister 224 producing assistive force.

Figure 48:
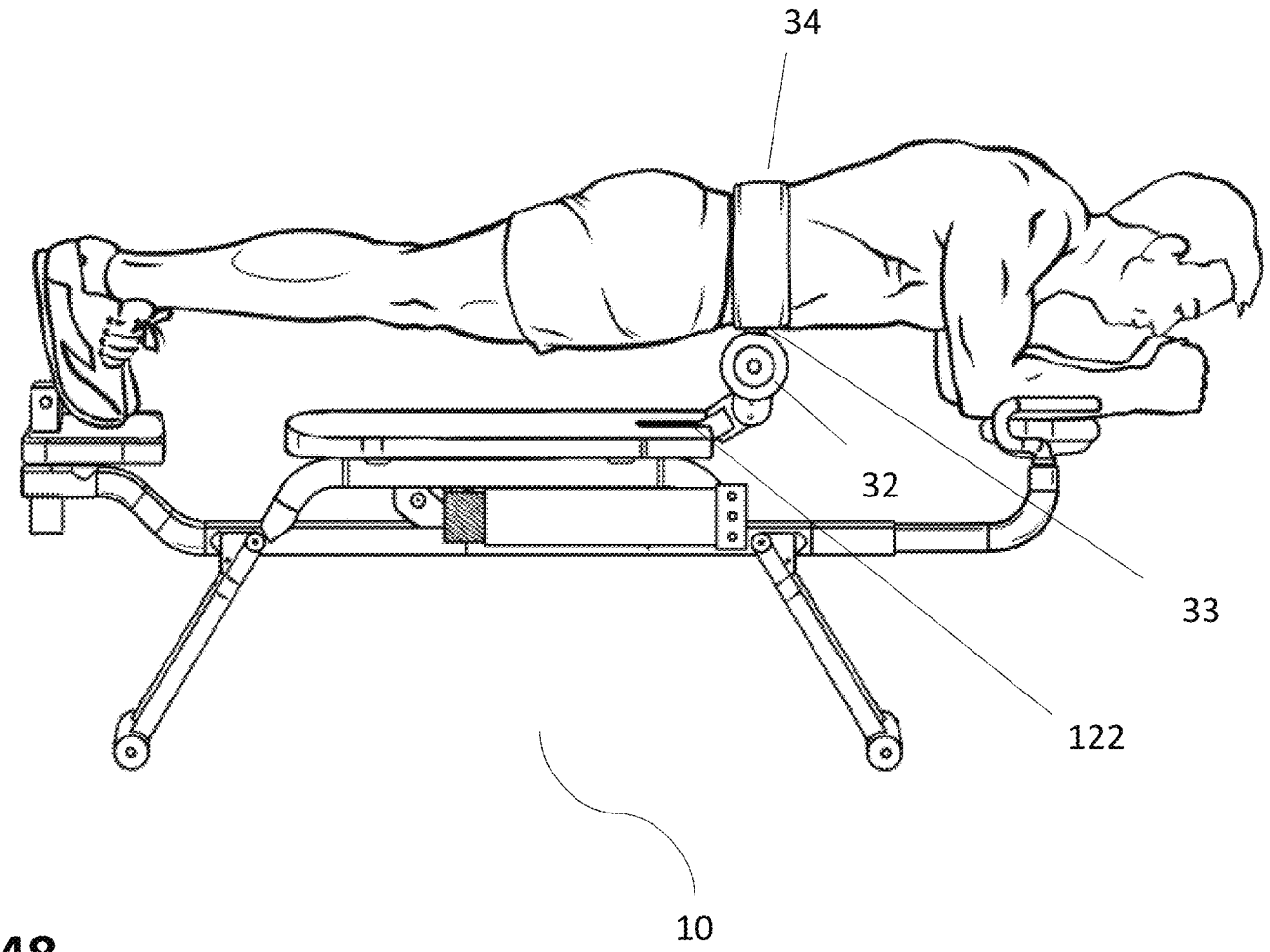
FIG. 48 is a side view of a user on the machine performing an added load plank pose exercise connected to the machine with a belt harness.

FIG. 48 is a side view of a user engaging the machine 10 and doing an added load plank pose exercise connected to the machine with a belt harness 34. The user performs the exercise as shown and is connected to the machine with a belt harness 34. The retractable mechanism 33 can be inside the belt harness 34 or housed in the guide arm pad 32 part of the machine.

Figure 49:
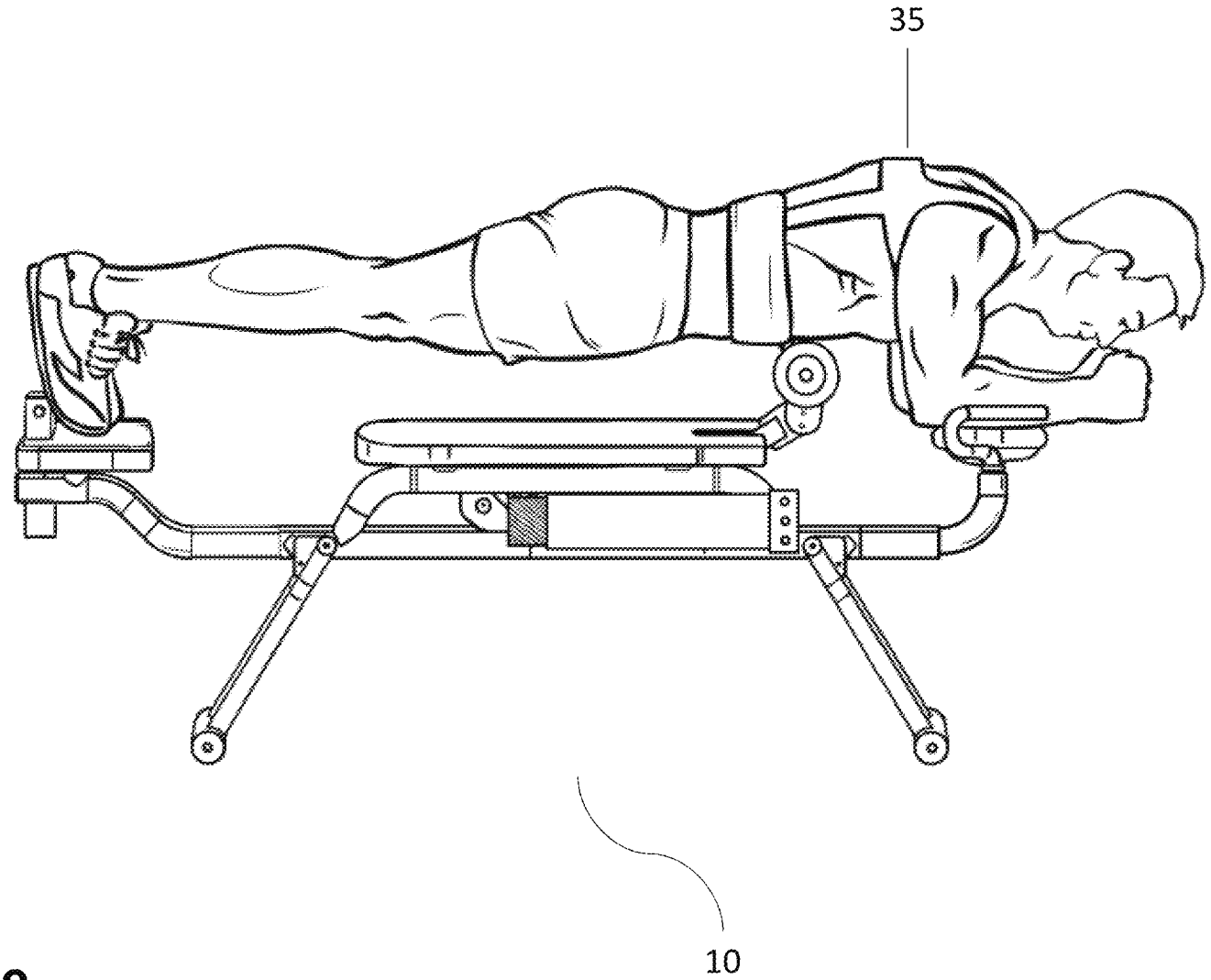
FIG. 49 is a side view of a user on the machine performing an added load plank pose exercise connected to the machine with a shoulder harness.

FIG. 49 is a side view of a user on the machine doing an added load plank pose exercise connected to the machine with a shoulder harness 35 operation, in the same configuration as FIG. 28 except that the user is connected to the machine 10 with a shoulder harness 35 instead.

Figure 50:
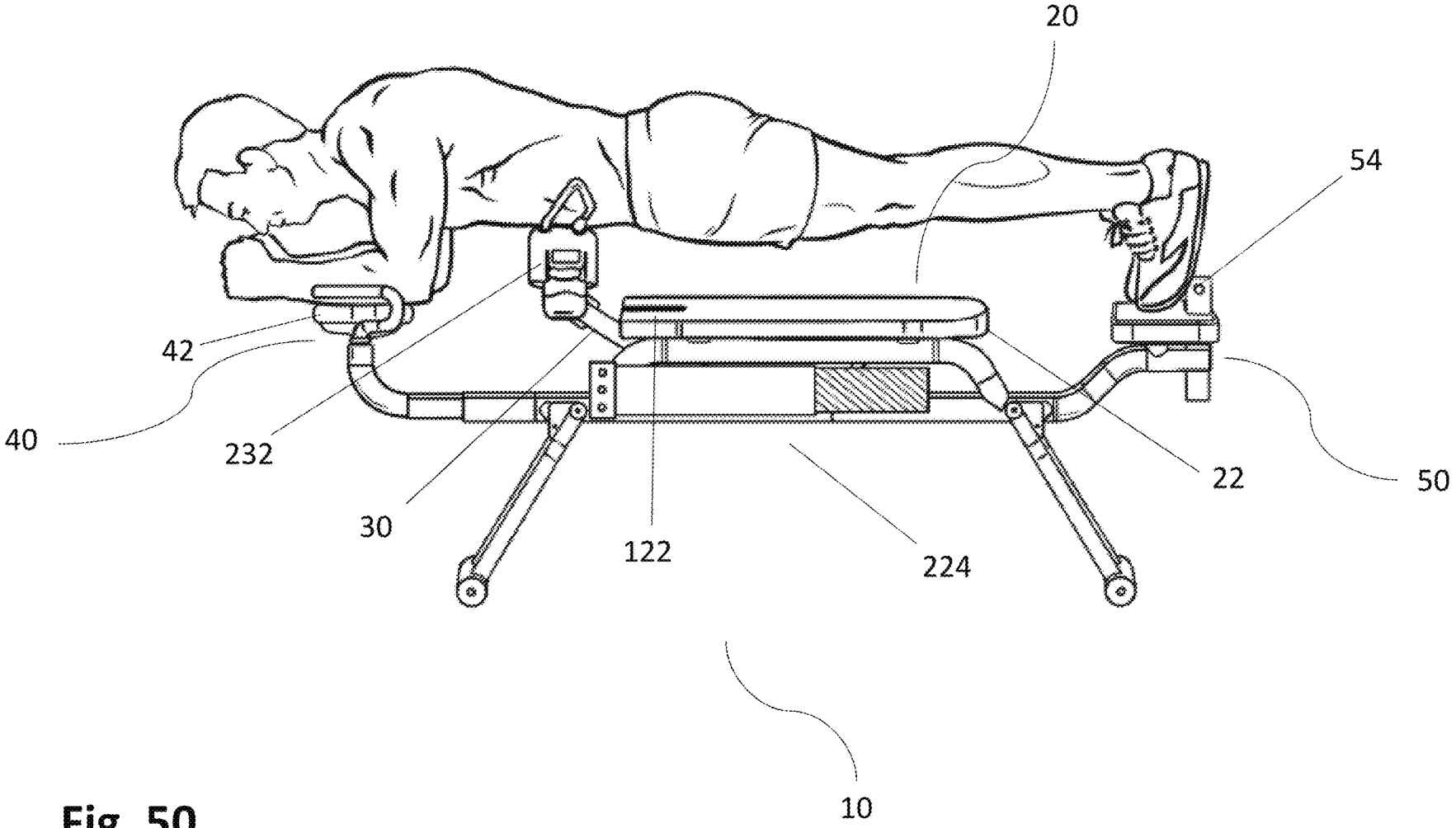
FIG. 50 is a side view of a user on the machine performing an assisted plank pose exercise.

FIG. 50 is a side view of the exercise machine 10 with a user performing an assisted static plank pose position exercise. In the operation of the exercise the user first kneels on the body support pad 22. Then one hand has the natural inclination to touch one embodiment of the guide arm support pad 232 and the other has an inclination to secure positioning on the plank pad 42. Eventually both hands are on the plank pad and the abdominal area is in contact with the guide arm pad 232. In the next portion of the procedure, the feet engage the foot support element 54 of the foot support 50 with the balls of their feet against the foot support element 54. Once in this position the user puts their forearms in a comfortable position on the plank pad 42.

After this sequence, the user assumes the plank position by making their body as straight as a board hence "the plank". The machine 10 aids tremendously in this effort as in this position the force originates, from the head of machine area 40 and is anchored as part of or outside of the core support 20. This force is radiated through the guide member 30 and during the performance of the exercise the purpose is to strengthen the entire core, although, the user tightens their entire body to hold the position. The exercise machine 10 provides stability for the entire exercise. More particularly, the guide arm support pad keeps the abdominal muscles from bowing out which is something that is commonly seen when a user has weak abdominal muscles. The variations in the force that can be created by the force producing element 125 offer the user the ability to change the neuromuscular stimulus differently than what they can achieve from their body alone. When the user is finished with the exercise, he she brings the guide arm 30 back to its up position by kneeing and raising their body off of the guide arm 30. This alignment removes the tension from the force producing element 125. At this point the user disengages the machine and very comfortably walks away.

Figure 51:
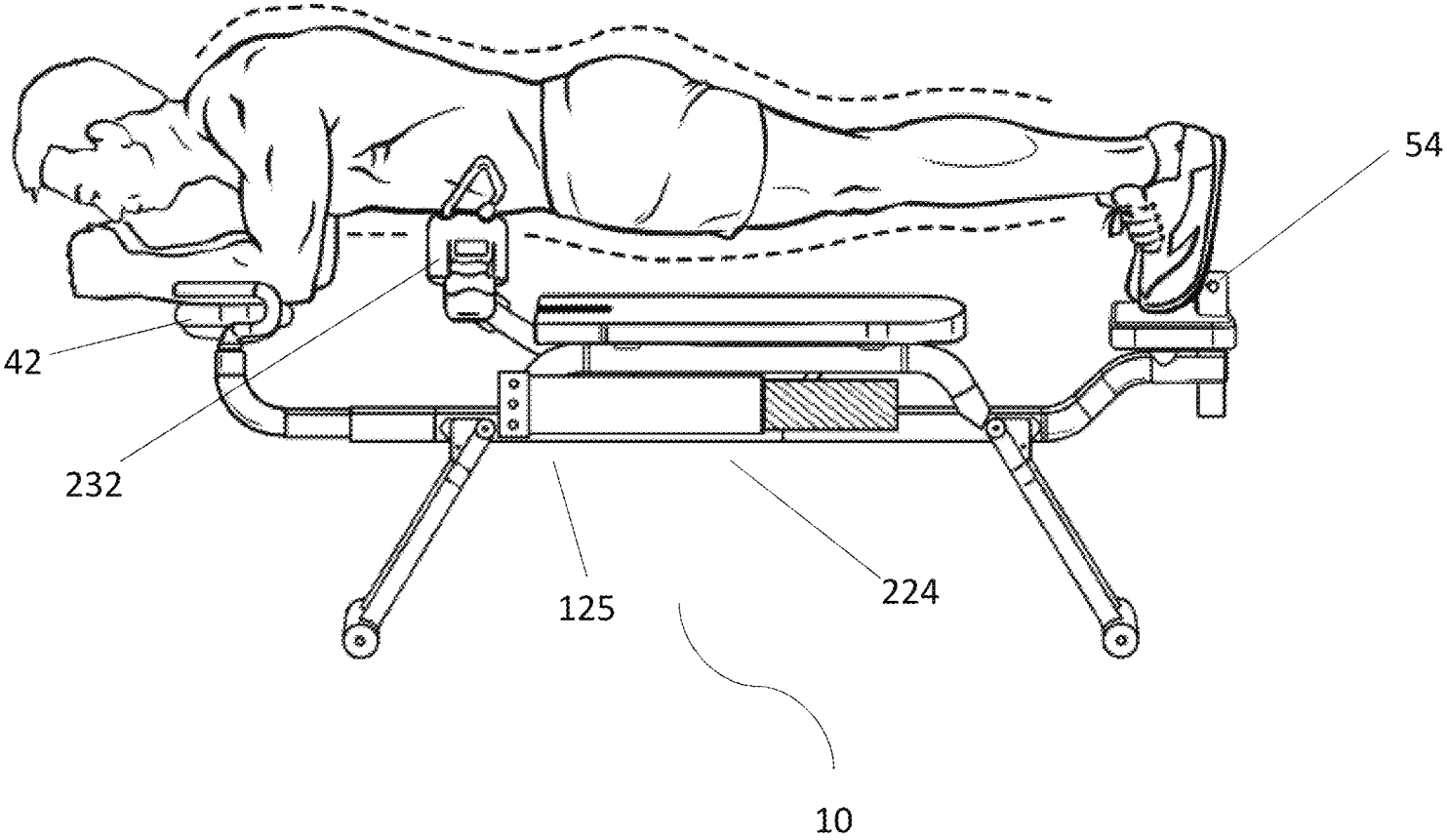
FIG. 51 is a side view of a user on the machine performing an assisted semi-static plank exercise.

FIG. 51 is the same as FIG. 50 however the body is illustrated to be moving ever so slightly in the configuration of a semi-static plank exercise. The support of the machine 10 accentuates this type of exercise differently than if the user did it on the floor without the machine.

Figure 52:
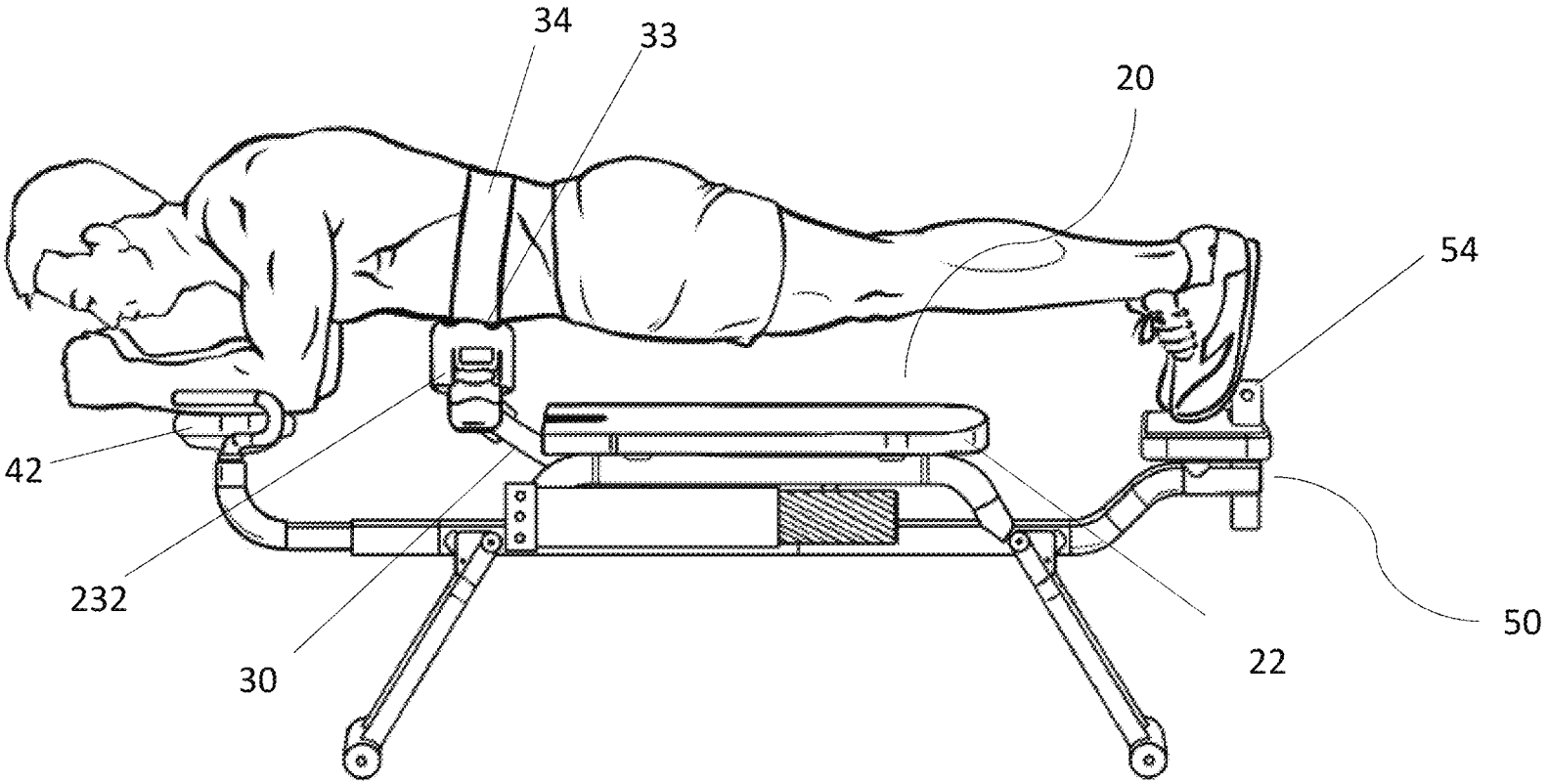
FIG. 52 is a side view of a user on the machine performing an added load plank pose exercise.

FIG. 52 is a side view of a user on the machine 10 performing an added load static plank position exercise. The operation of the exercise is similar to that shown in FIGS. 50 and 51, although, the force is now originating from the foot area 50 of the machine and is anchored as part of or outside of the core support 20. When the user engages the machine 10, the guide member 30 is under load and is in the down position. In order to operate the machine for this type of exercise the user needs to be connected to the machine. This achieved by a belt 34 or shoulder harness 35 being connected to the guide arm 30.

Thus, in line with FIG. 50, the user kneels on the machine, engages their feet with the foot support element 54 then they lay across the machine with their chest on the plank safety/support pad 42 and their abdominal area across the guide arm pad 32 which is in the down position and under load. While the user is resting on the machine, their hands are free, which is crucial so that the user can lock and unlock a retractable belt mechanism 33 that creates the connection. As stated above, this retractable belt mechanism 33 can be housed in the structure of the guide member 30 and within the belt 34 or shoulder harness 35. Once the user is secured they can proceed to get into the plank position with the machine providing more resistance then what their body produces naturally. To perform the exercise the user holds the position for a number of seconds.

When the exercise is completed the user reclines across the body support pad 22 and the plank pad 42, with hands free and is able to disengage from the resistance of the guide member 30 and get up and walk away from the machine as seen in FIG. 25. The added load planks affect the entire body and work to create a great pump within the body muscular area of the user in the performance of such exercise.

Figure 53:
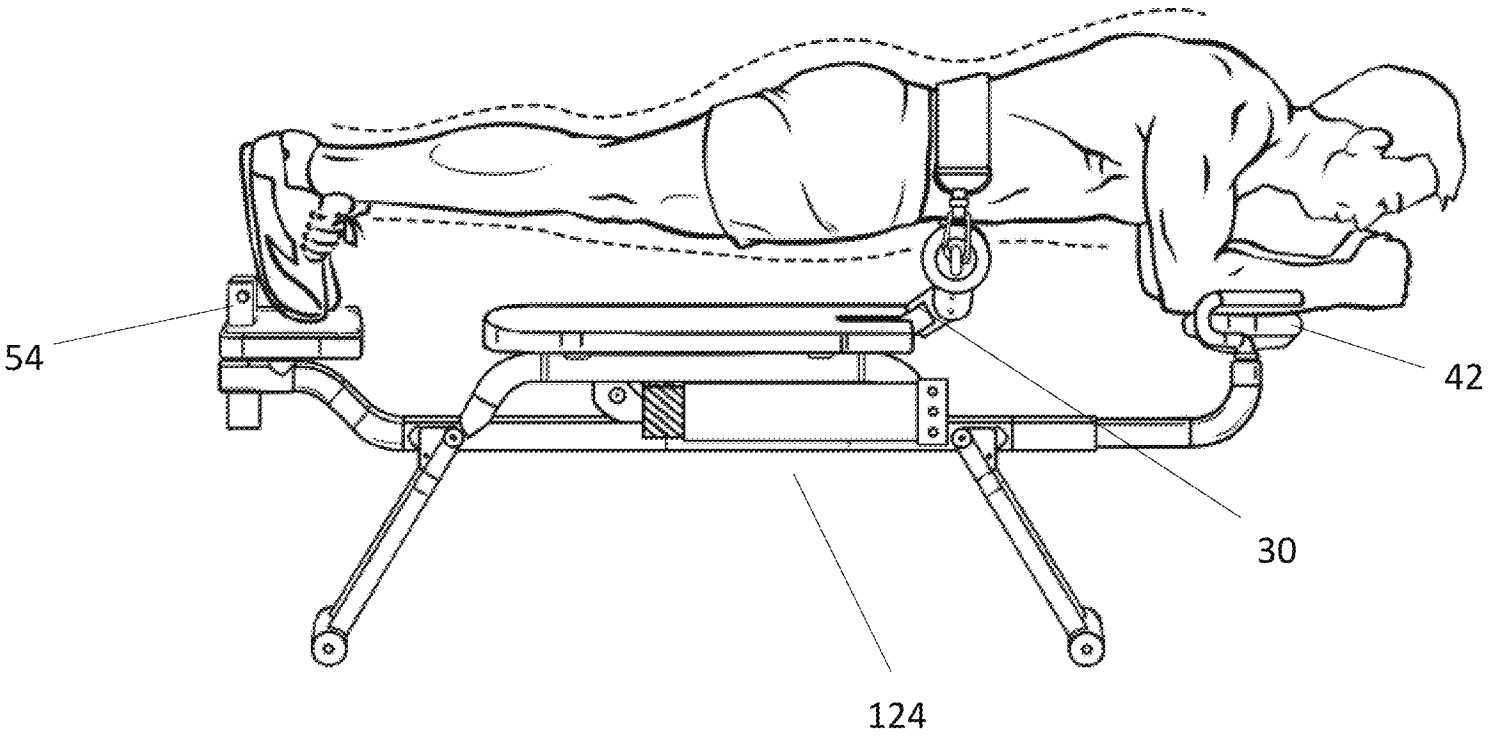
FIG. 53 is a side view of a user on the machine performing an added load semi-static plank exercise.

FIG. 53 is a side view of a user performing an added load semi-static plank exercise, as seen in FIG. 51 except that the machine 10 is now producing added resistance, yet still supporting the abdominals of the user is in a structured configuration. This configuration renders these semi-static exercises more intense and targeted.

Figure 54:
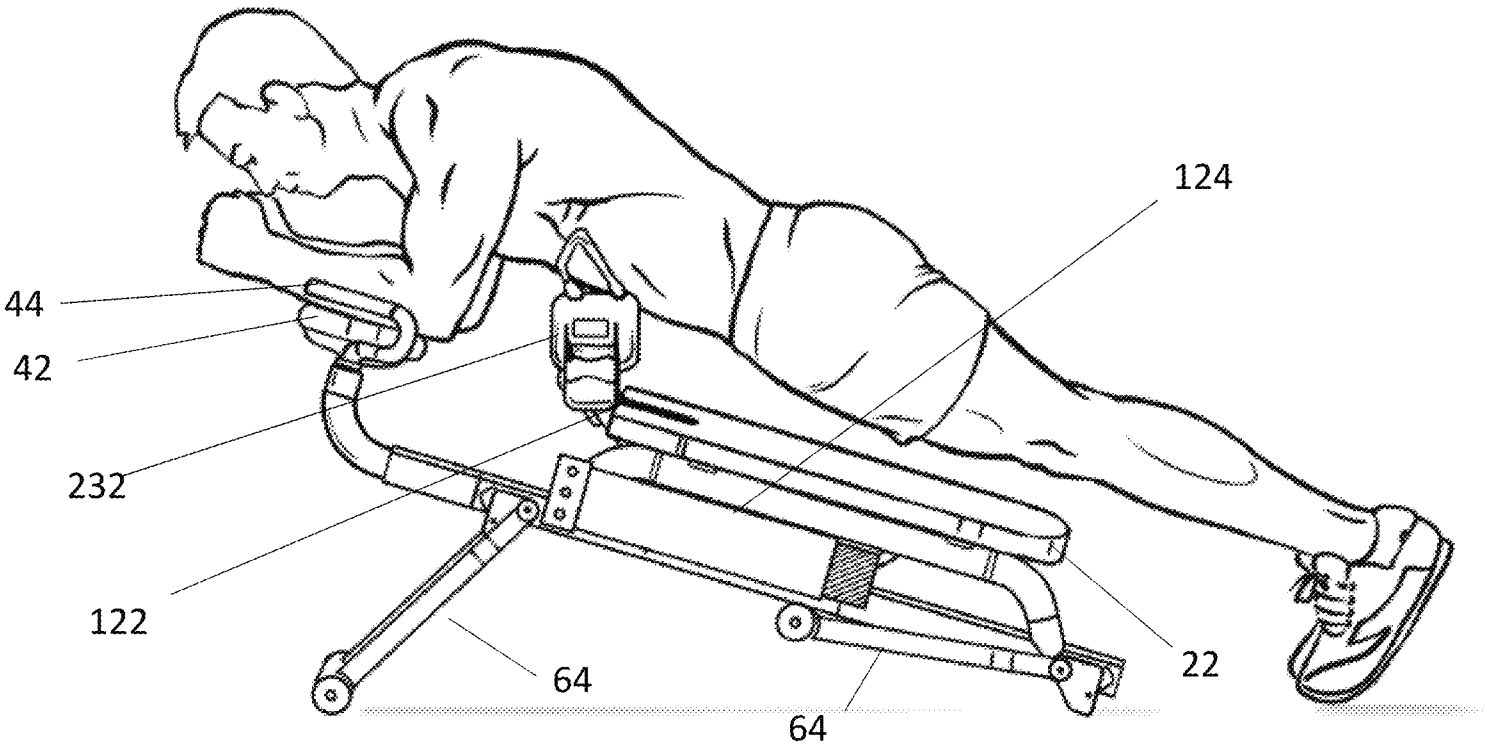
FIG. 54 is a side view of a user on the machine performing an assisted plank pose exercise with their feet on the floor.

FIG. 54 is a side view of a user performing an assisted static plank pose exercise on the machine 10 with their feet on the floor. This may be utilized in the same or in a separate embodiment. When it is the same embodiment, the foot support area of the machine 10 is removed to make room for the user to get into the position shown with their feet on the floor. The advantages to this may be for a very debilitated person to be able to engage with the machine 10 easier.

Figure 55:
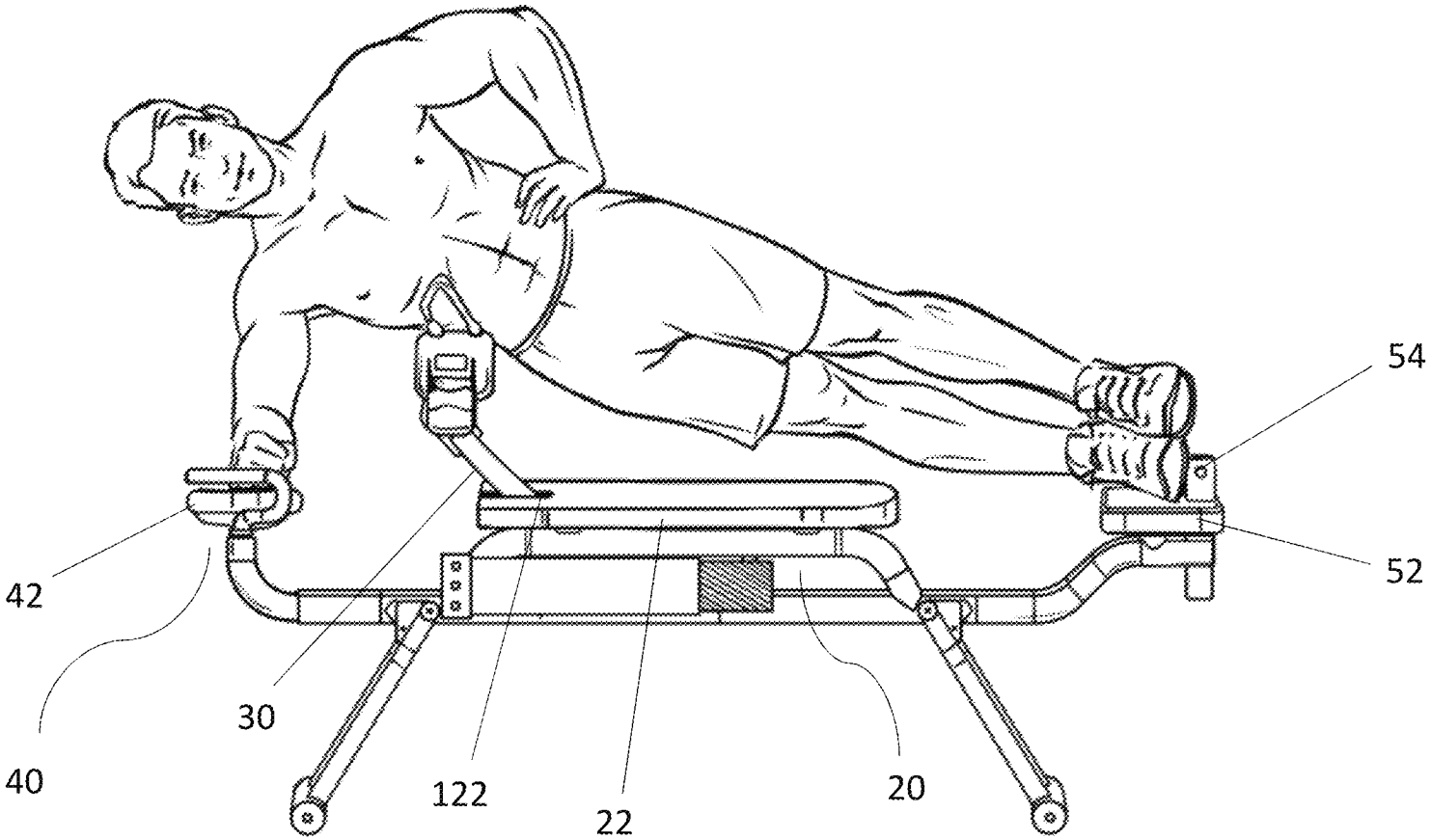
FIG. 55 is a side view of a user on the machine performing an assisted side plank pose exercise.

FIG. 55 is a side view of a user on the machine 10 performing an assisted side plank pose exercise which is performed much like the assisted straight plank pose exercises as seen in FIGS. 25 and 26 except the user is on the side and the emphasis is on the oblique musculature. Further, instead of both forearms being on the plank pad 42, only one is located therein and the other arm is positioned with hand on the hip. The user's feet are on top of one another on the foot area support 50 with the side of the bottom foot contacting the foot support pad 52 and the bottom of the bottom foot contacting the foot support element 54. The force is generated in the same manner as well and originates from the head of the machine support area 40 which may be anchored as part of or outside of the core support 20 and insertion attachment to the bottom of the guide arm 30.

Figure 56:
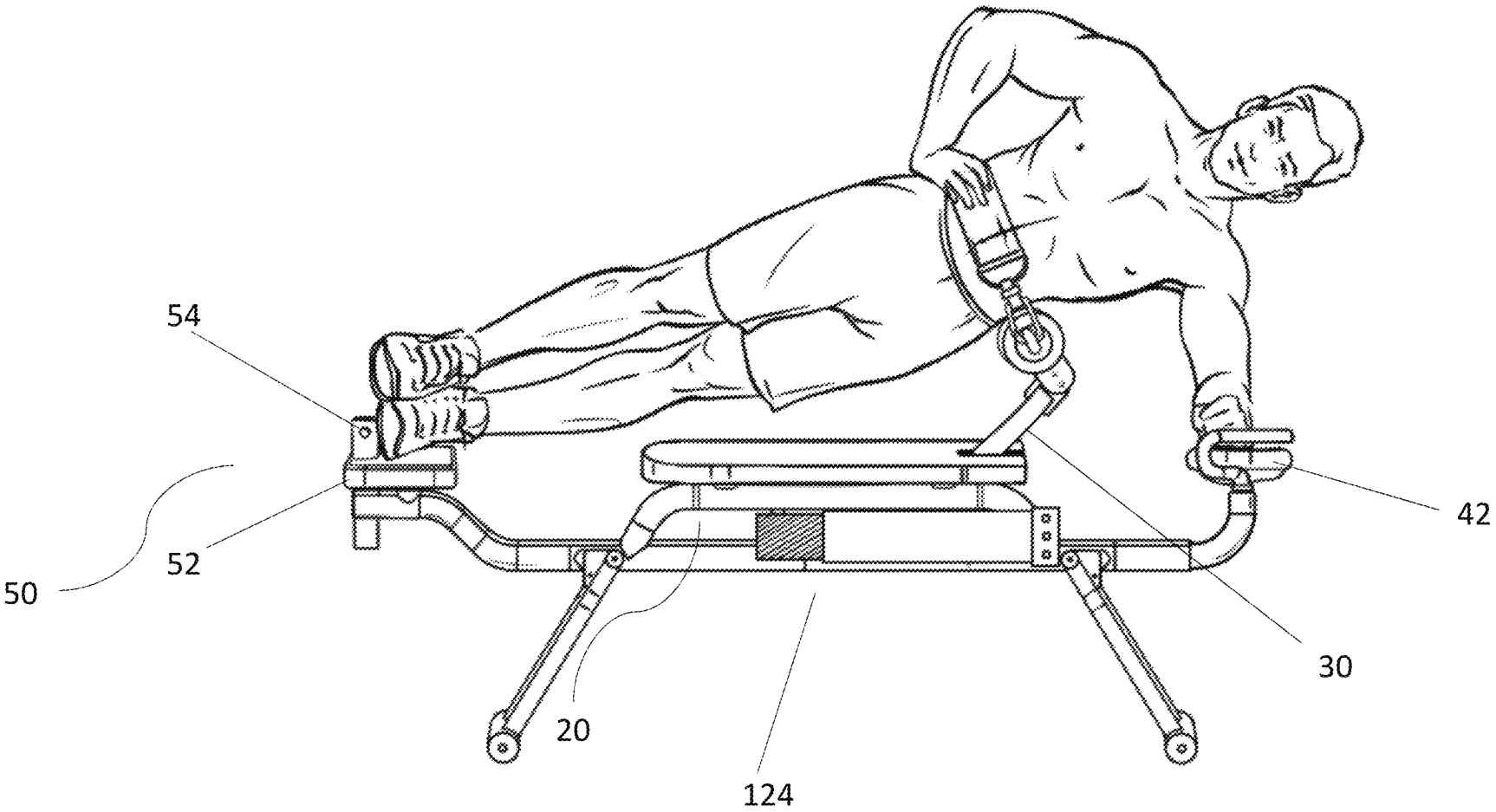
FIG. 56 is a side view of a user on the machine performing an added load plank pose exercise.

Mounting and dismounting the machine 10 in this position is a little different. The user is on their side the whole time. The process is the nearly identical, just that the user is on the hip as opposed to the position shown in FIGS. 50 and 51. FIG. 56 is a side view of the machine with a user on it performing a side plank pose exercise with added load. The exercise is performed much like the added load straight plank pose exercise as seen in FIGS. 48-49 and 52. In the performance of this exercise only one of the forearms is supported on plank pad 42. The other arm is placed on the hip, and both of the user's feet are on top of one another on the foot area support 50 in the same manner as FIG. 55. The force is generated in the same manner as in FIG. 42 whereby it is anchored as part of outside of the core support 20 and originates from the foot support side of the machine.

Additionally, the force generating element 125 is attached to the bottom of the guide member 30. When the user performs the exercise, this configuration pulls their hip toward the floor. The user performs the exercise by resisting such movement by creating a static pose in the position shown.

Figure 57:
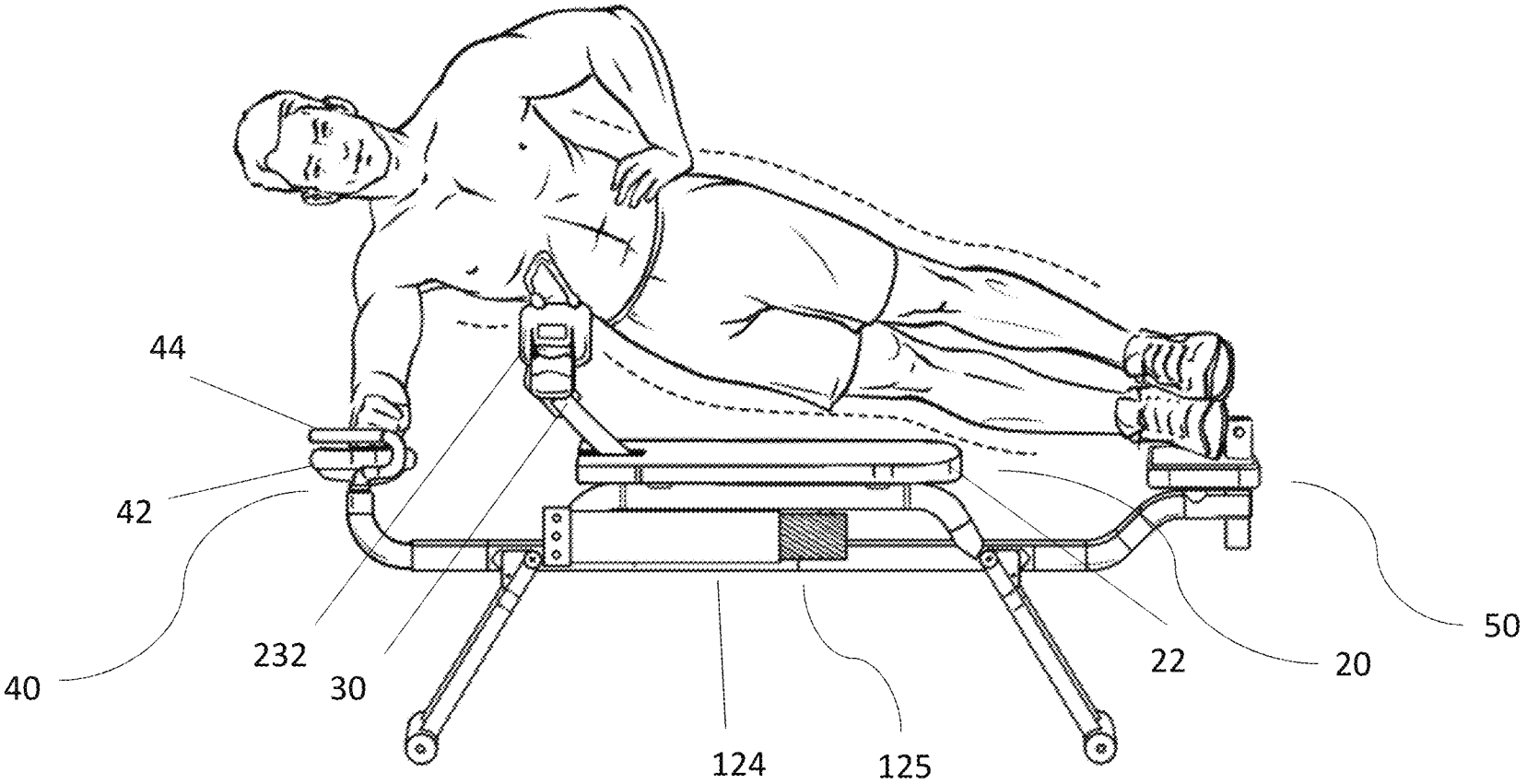
FIG. 57 is a side view of a user on the machine performing a semi-static assisted side plank exercise.
Figure 58:
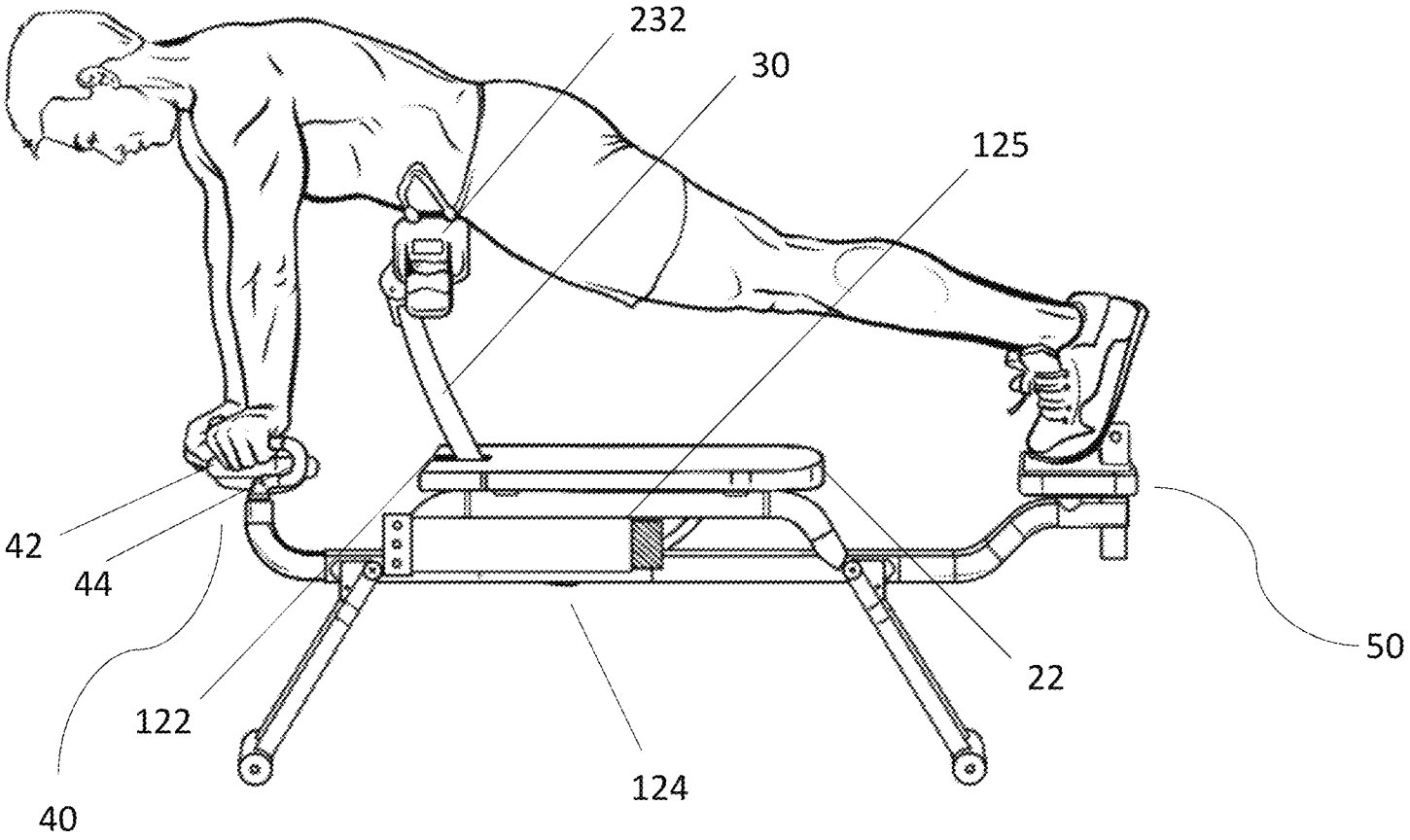
FIG. 58 is a side view of a user on the machine performing an assisted push-up exercise.

FIG. 57 is a side view of a user on the machine performing an added load semi-static side plank exercise. Once again, this is the same as FIG. 53, although the exercise is done in the side plank position. FIG. 58. is a side view of a user on the machine 10 performing an assisted push-up exercise. In the operation of this exercise the user engages the machine 10 much like they would in the performance of the plank exercise. After kneeling on the body pad 22 the user's inclination is to put one hand on one embodiment of the guide arm pad 232 and then proceed to put one and then the other on the plank pad 42 and next the handlebars 44.

In conjunction with the prior described alignment, the abdominal area is in contact with the guide arm pad 232. The user's feet are supported on the foot area support 50. While in the upward position the user reclines their body while being supported by the guide arm 30. The force of the force producing element 125 originates in the head of machine area 40 and is anchored as part of or outside of the core support 20 and its insertion is connected to the guide arm 30. The insertion of the force is under the body pad 22. As the user declines toward the bottom of the range of motion, energy is stored in the force producing element 125.

Figure 59:
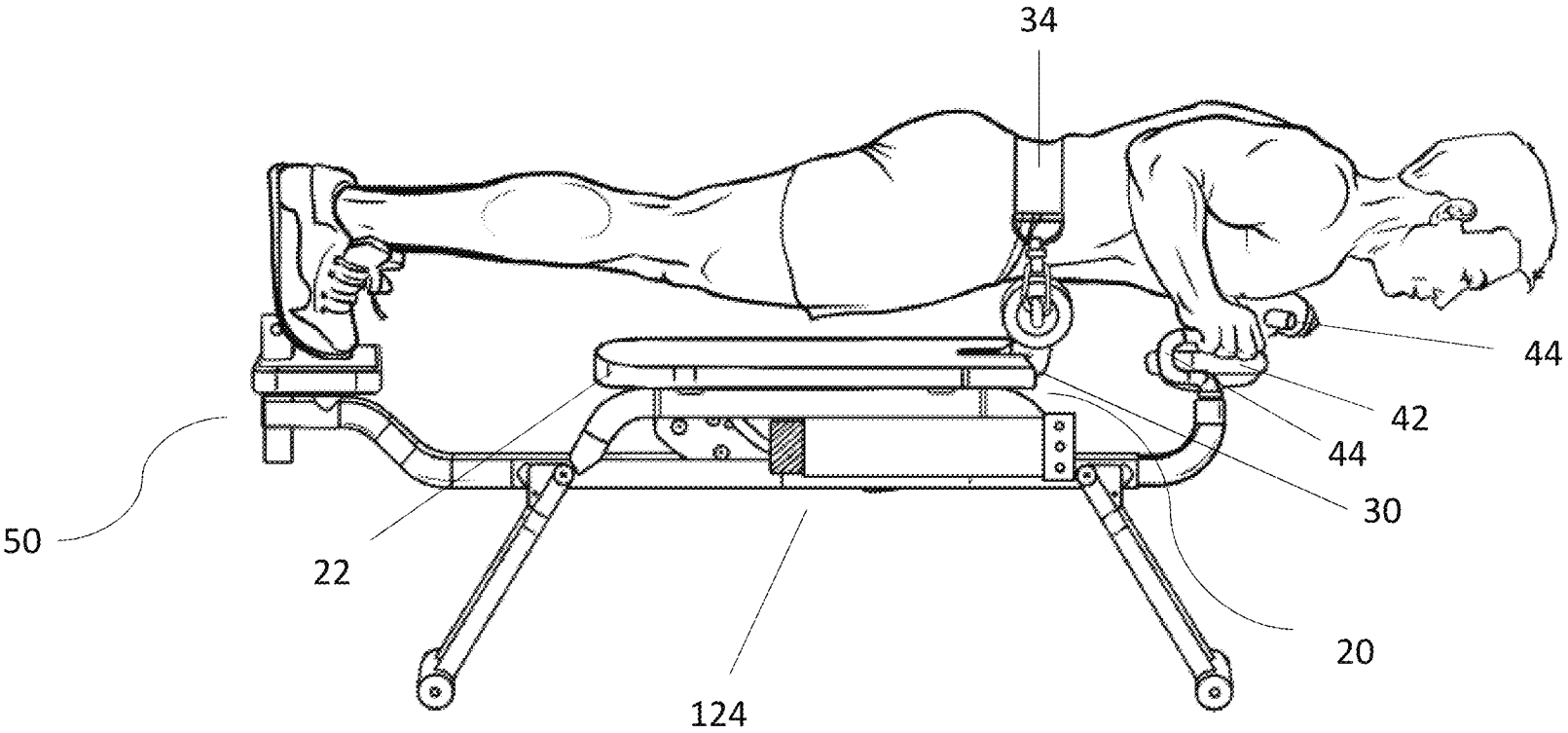
FIG. 59 is a side view of a user on the machine performing an added load push up exercise.
Figure 60A:
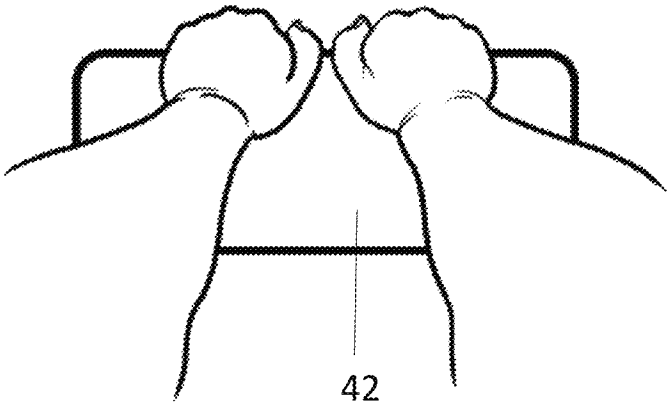
FIGS. 60A-60D are views of multiple variations of hand placements on the plank support pad.
Figure 60B:
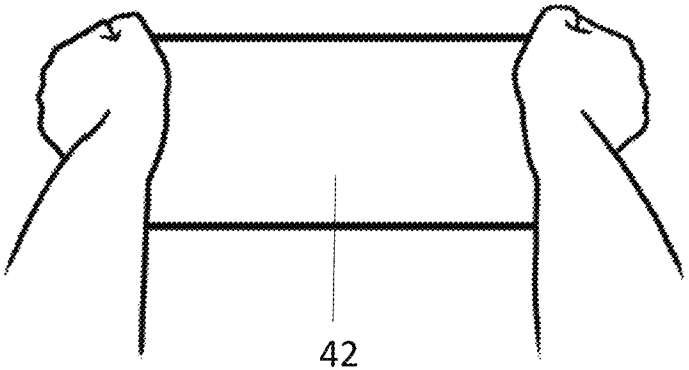
Figure 60C:
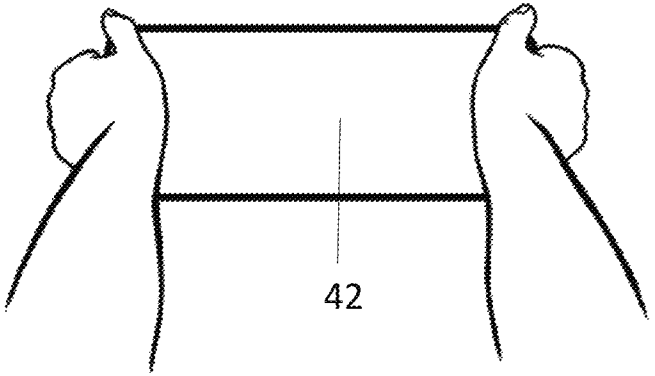
Figure 60D:
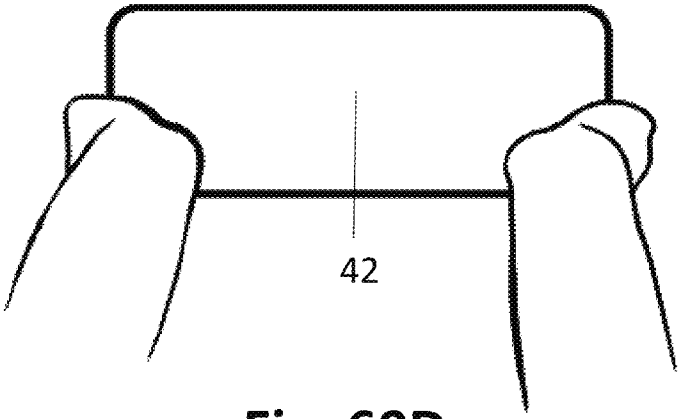

Next, once the user gets to the bottom of the range of motion and starts the concentric, or upward phase of the movement, the force producing element assists the user as they perform the exercise. When the user is finished with the exercise, the user kneels on the body pad 22, disengages the guide arm pad 32, places the feet on the floor and walks away from the machine 10. Also, FIG. 59 is a side view of a user on the machine 10 performing an added load push-up. In the operation of the machine 10 for this exercise, the user utilizes the same process as shown in FIG. 33 above. Except the force is originated in the foot area support 50 of the machine 10 and is anchored as part of or outside the core support 123 and the guide arm 130 is under load and in a down position. To engage the machine the user is harnessed to the machine in the methods shown above in FIGS. 48, 49 and others for planking exercise. The operation of the force element 125 is such that when the user goes from the down position to the up position, the force in the machine 10 is radiated through the guide arm 30 to add a greater load than what the user's body produces naturally. This is seen to be an extremely efficient and effective exercise.

FIGS. 60A-60D illustrate multiple top views of the head support 40 of the machine and different placements on the plank support pad. These placements include, the top of the pad, the top sides of the pads, the center sides of the pad and holding the bottom of the pad with the user's hands in a reversed position. In this way, a user can have various gripping options depending on what is most comfortable. This allows for safe and comfortable exercise. The plank support pad 42 allows for the pressure on the hands and wrists to be greatly reduced. Additionally, the variation of hand positions allows a user to target different muscle groups.

Figure 61:
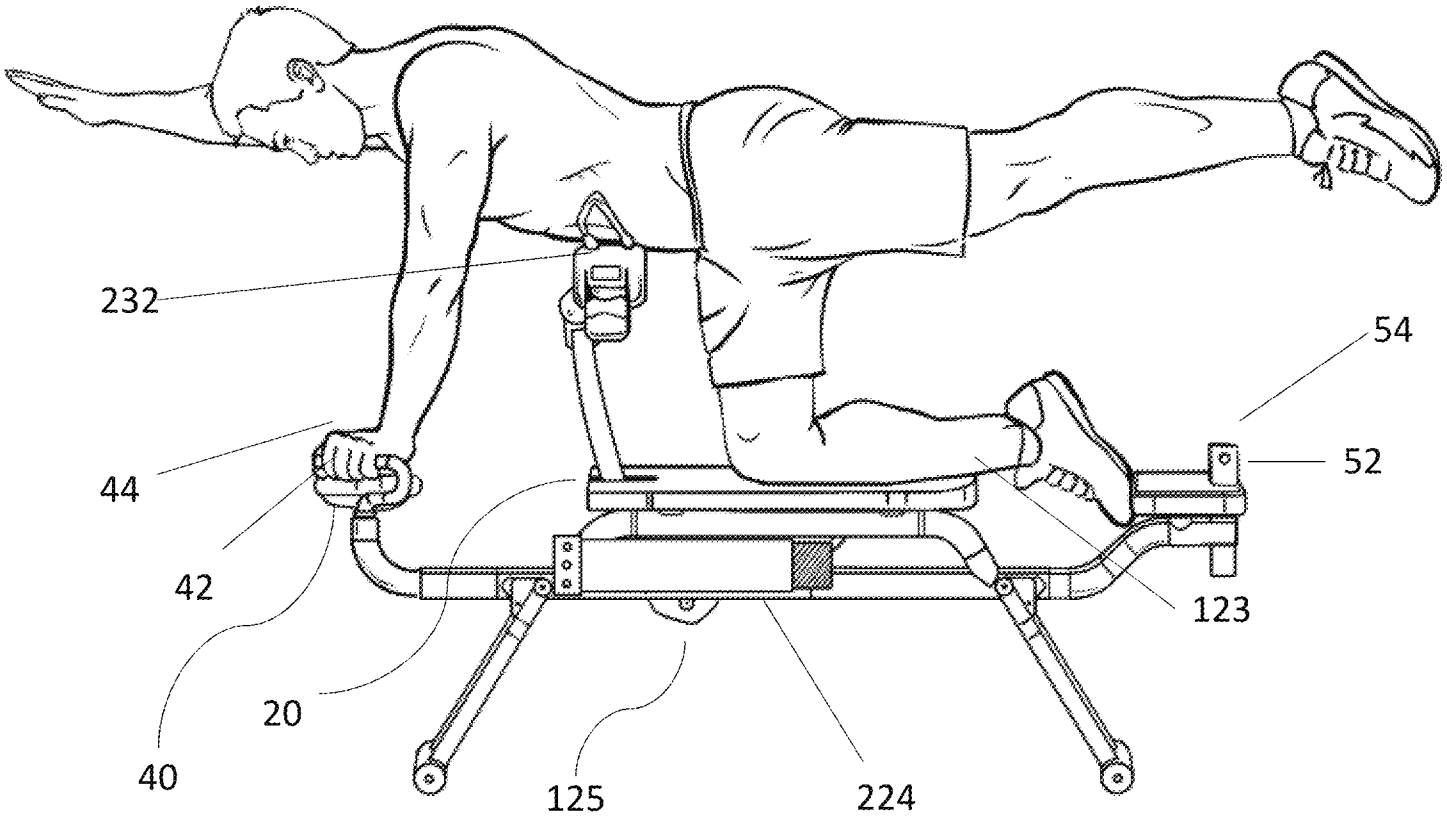
FIG. 61 is a side view of a user on the machine performing an assisted bird dog pose exercise.

FIG. 61 is a side view of a user on the machine 10 performing an assisted bird dog static pose exercise and this exercise is performed by assuming the position like a dog pointing at a bird, and hence the "bird dog." When the user performs this exercise, the user kneels on the machine much like is shown in many of the figures above. They have an inclination to put one hand on one embodiment of the guide arm support pad 232 and one hand on the plank pad 42 or one of the handles of the handlebars 44. In this position, the user's abdomen is in contact with the guide arm pad 232, one knee is down on the body support pad 22, the down hand is on the plank pad 42 and opposite the knee on the body support pad 22 or alternately described as diagonal from. Said arm and hand are in the air and pointing preferable straight in front of the user. On the other side of the machine, the foot of the down leg is in contact with the foot pad 52 and the foot element 54. The leg and foot diagonally across the body from the arm and hand in the air is also in the air and preferably pointing back straight.

Much like in performing the plank, the user holds this position for a number of seconds while the machine fortifies their position and allows them to concentrate on good performance of the exercise. This exercise is really great for strengthening the core musculature. In operation of the machine in this position the force is originating from the head of machine support 40 end of the machine and is anchored as part of or outside of the core support 20 and its insertion is connected to the bottom of the guide arm under the body pad 22 or the core support 20. This connection and action stores energy inside the force element 125 and assists the user to maintain the position shown.

Figure 62:
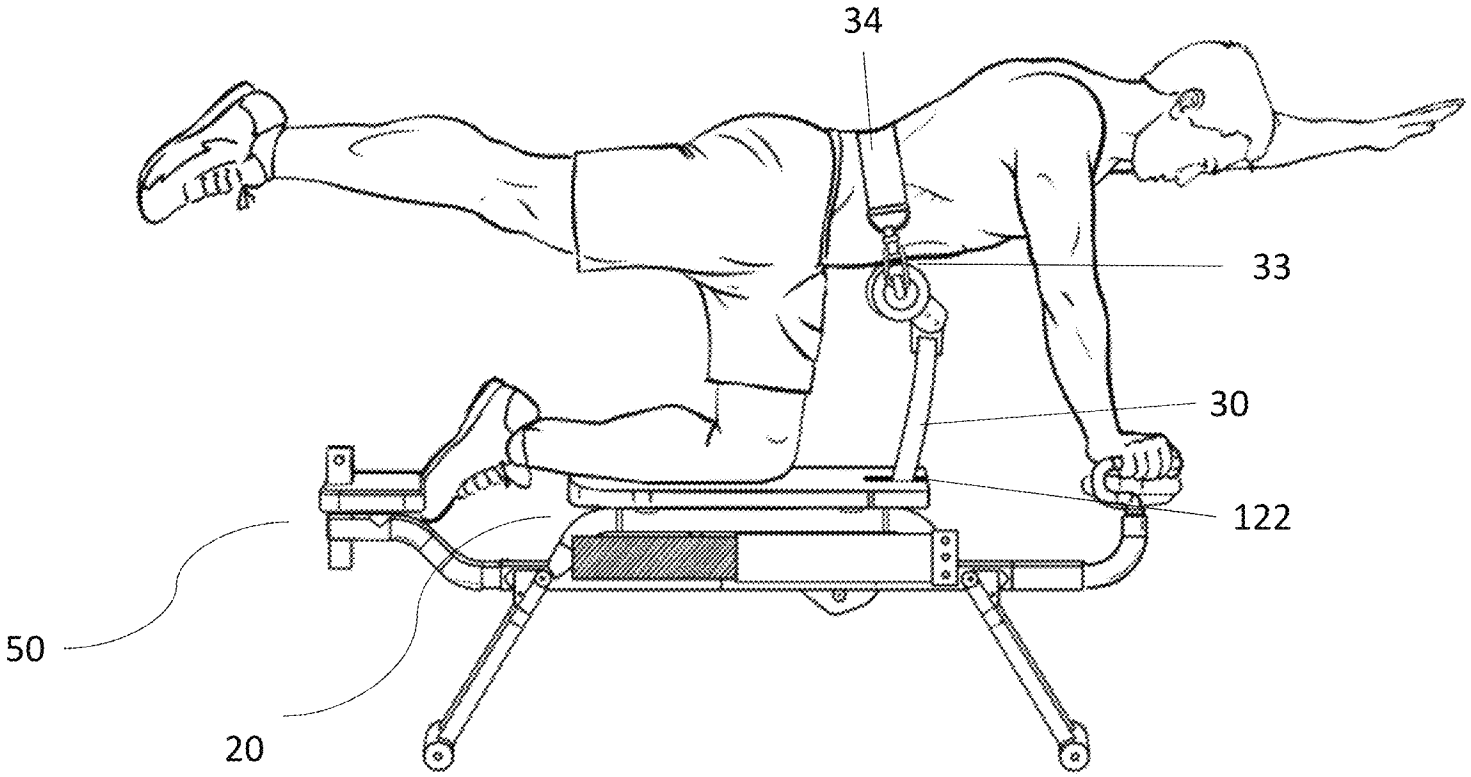
FIG. 62 is a side view of a user on the machine performing an added load bird dog pose exercise.
Figure 63:
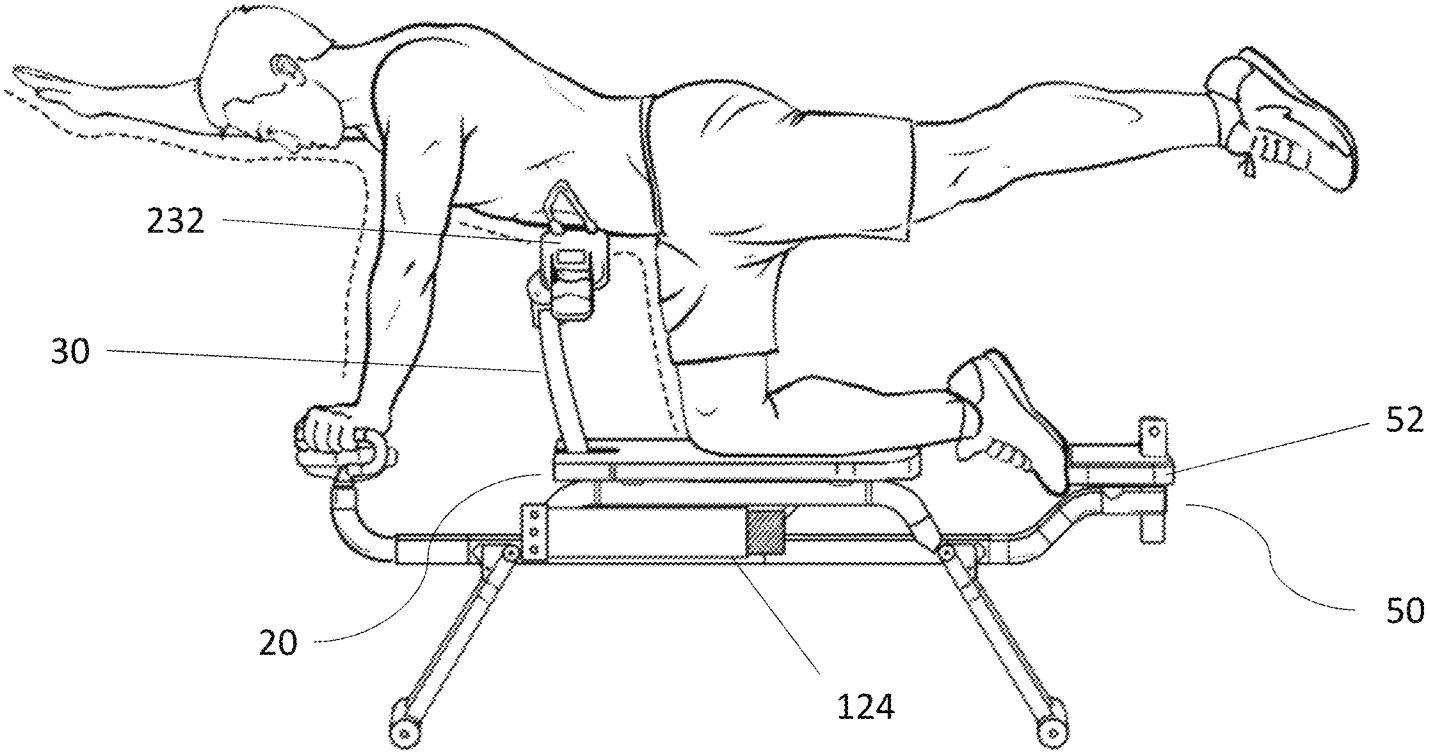
FIG. 63 is a side view of a user on the machine performing an assisted semi-static bird dog exercise.

FIG. 62 is a side view of a user performing an assisted semi-static bird dog exercise. The operation of the machine and the user is the same as above except the user bends forward ever so slightly as they perform the exercise and FIG. 63 is a side view of a user on the machine performing an added load bird dog pose exercise. In the performance of this exercise the user is in the position shown in FIG. 61 above. In the operation of this exercise, the force is originating from the foot support 50 side of the machine and is anchored as part of or outside of the core support 20.

Next, the user engages the machine much like when doing an added load plank or push-up whereby they are connected to the machine by belt 34 or shoulder harness 35. In this operation, the user starts in the down position and brings themselves to the position shown whereby the force producing element is adding resistance and pulling the user away from the position. In this action, the user performs the exercise by resisting the machines inclination to pull them down or out of position. This is a very difficult exercise to perform and requires the user to have very good core strength. Also, some slack in the connection between the retractable belt mechanism 33 and the belt 34 or shoulder harness 35 may need to be employed.

Figure 64:
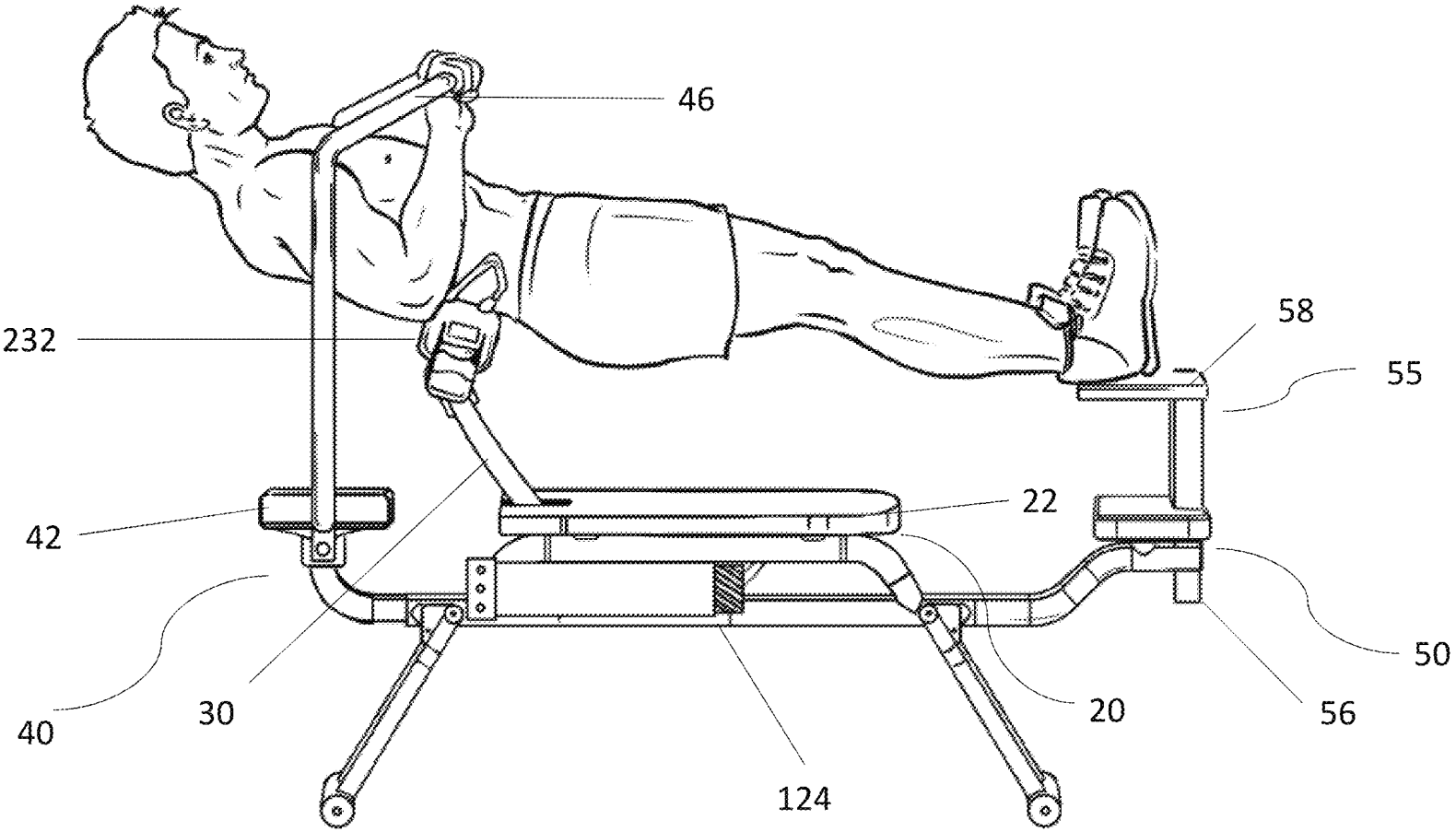
FIG. 64 is a perspective view of the exercise machine with an auxiliary high foot placement attachment embarked.

This is based on how high off the machine the user's torso is it relates to the guide arm 30. FIG. 64 is a perspective view of the machine adapted with the auxiliary foot support attachment 55 with the auxiliary foot pad 58. The higher foot placement attachment is employed when a user performs supine pull-ups or push-up or plank exercises where the body is in a declined position and the feet are above the hands. The higher foot placement attachment 55 can be telescopically affixed in the top of the foot element 54 of the foot support 50.

Figure 65:
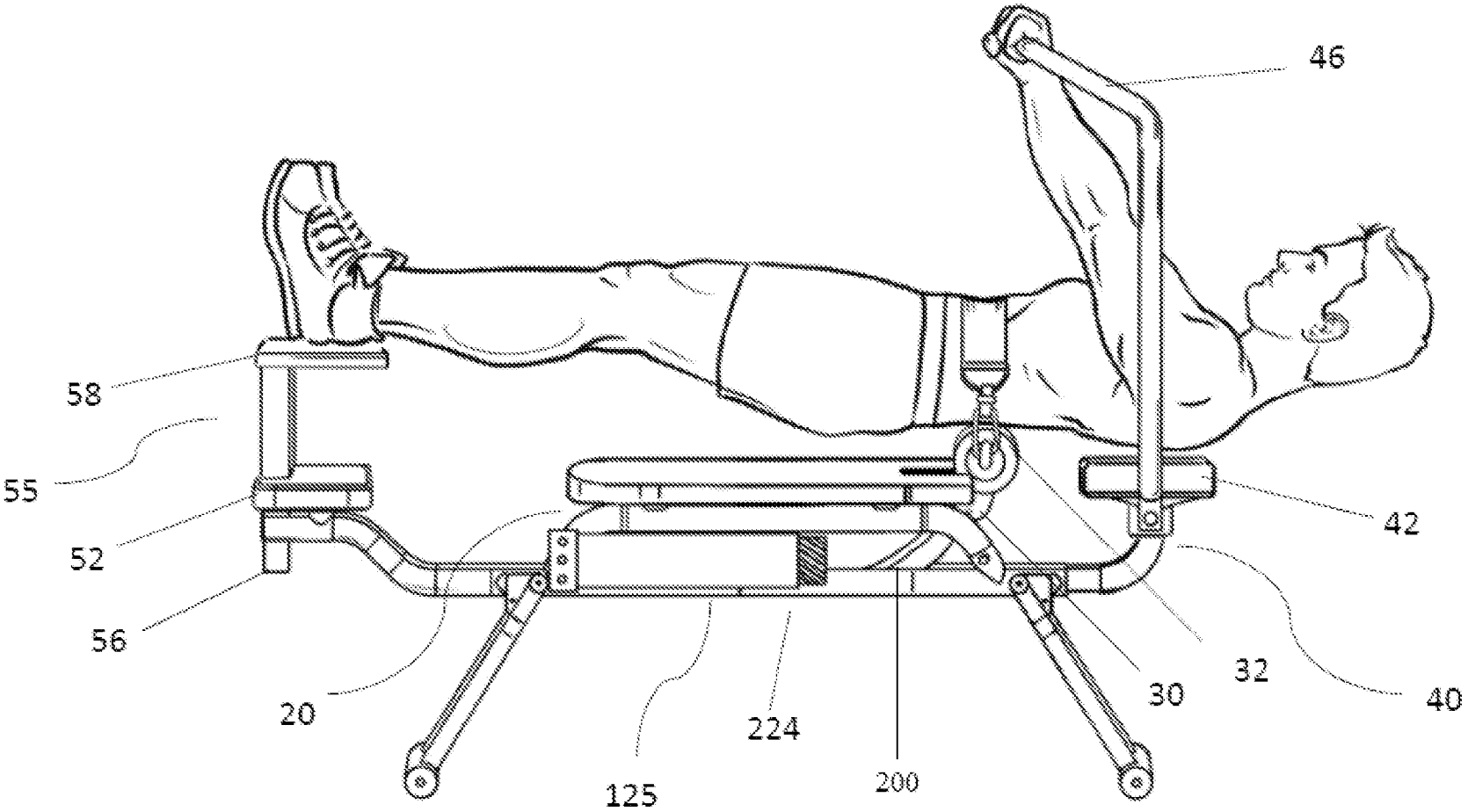
FIG. 65 is a side view of a user on the machine performing an assisted supine pull-up exercise.

FIG. 65 is a side view of a user on the machine 10 performing an assisted supine pull-up. The figure depicts the top or height of the range of motion whereby the user has pulled themselves up to their hands and has been assisted by the force generated from the assisted force canister 224. To perform the exercise the user sits on the body support pad 22 and engages the guide arm pad 32 on their back. Once in this position they lay backward storing energy in the assisted force canister 224. In this position, the top of the user's back is supported by the plank pad 42 of the head of the machine support 40 and the guide arm pad 32 is now in line with the user's lower back.

Next, when the user arrives at that position, the user places their feet up on the auxiliary foot support 55 which is telescopically positioned inside the foot support element 54 and held in place by the foot support positioner 56. At this point the user reaches up to the auxiliary handlebars 46 up over their head and aligned with the chest. From here the user performs an assisted supine pull-up by pulling with their arms and back to bring their chest to the auxiliary handlebars 46. During the performance of the exercise the force is originated from the head of the machine 40 side of the machine and is anchored as part of or outside of the core support 20 and its insertion point 200 is at the bottom of the guide member 30.

As the user moves from the up position to the down position, the force stored inside the force producing element 125 motivates and actuates the guide arm 30 to follow the user's body and provide assistive force. Once at the top of the range of motion, the user performs the downward phase of the movement and returns to the bottom of the range of movement which is on the body pad 22 and plank pad 42. The supine pull-up is an excellent alternative to vertical pull-ups. Doing a pull-up in this position affects the musculature of the back and arms differently. It seems that more of the back is involved as well as the core, and there may be less stress on the shoulders and biceps.

In addition to a supine pull-up, a user can also perform an inverted plank for backside of body. Rather than pulling up toward the auxiliary handlebars, the user can simply hold the position shown with added load. In holding this position, the exercise affects the glute and hamstring musculature in a way that has never been conceived before. The user pushes their heels into the support creating a contraction in the hamstring and gluteus muscles. The arms and the back are affected very intensely as well.

Figure 66:
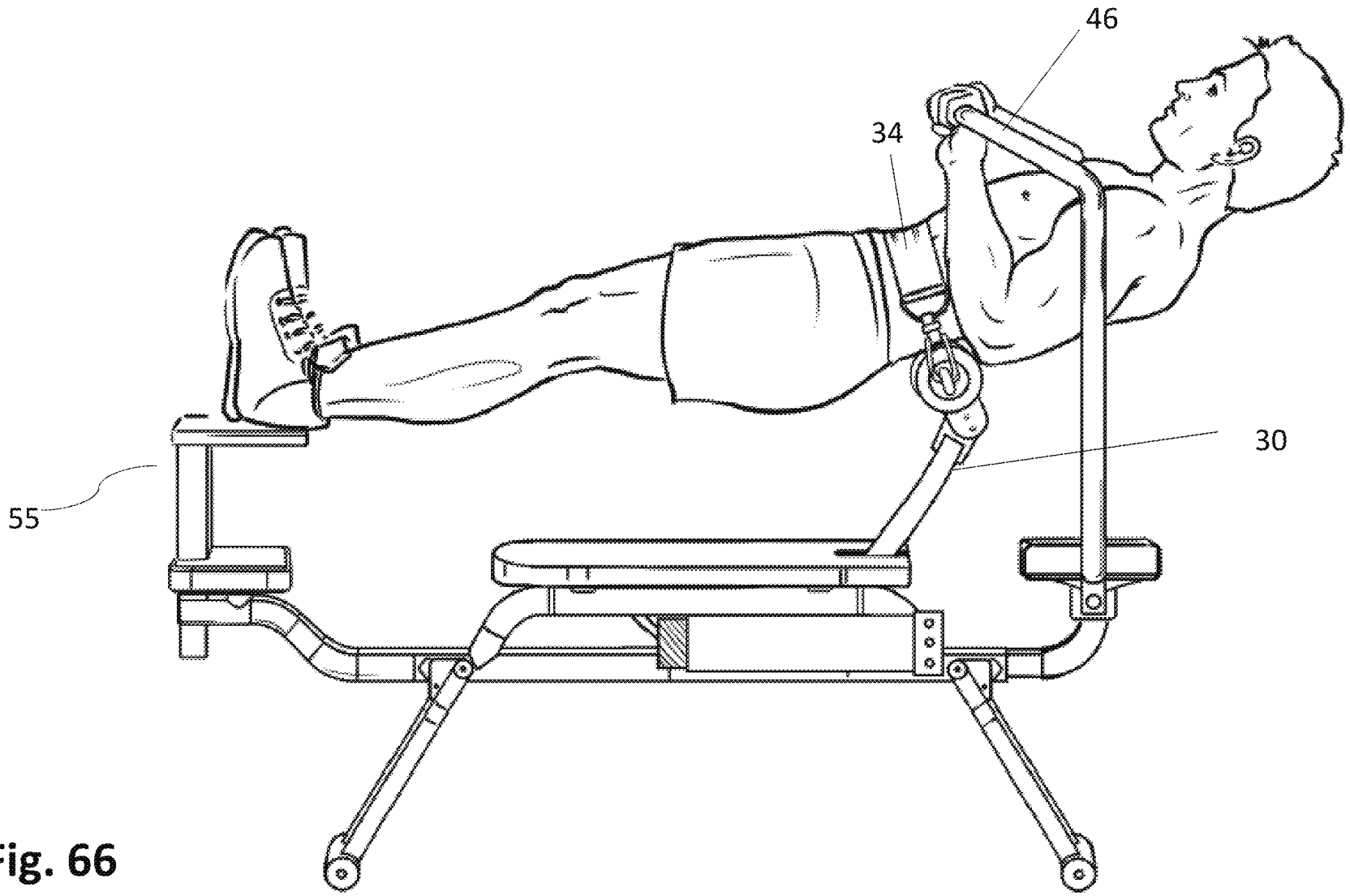
FIG. 66 is a side view of a user on the machine performing an added load supine pull-up exercise.

FIG. 66 Illustrates the ending position of the supine pullup described in FIG. 65 wherein the user has pulled the guide arm 30 up as he lifts his body up toward the auxiliary handlebars 46.

Figure 67:
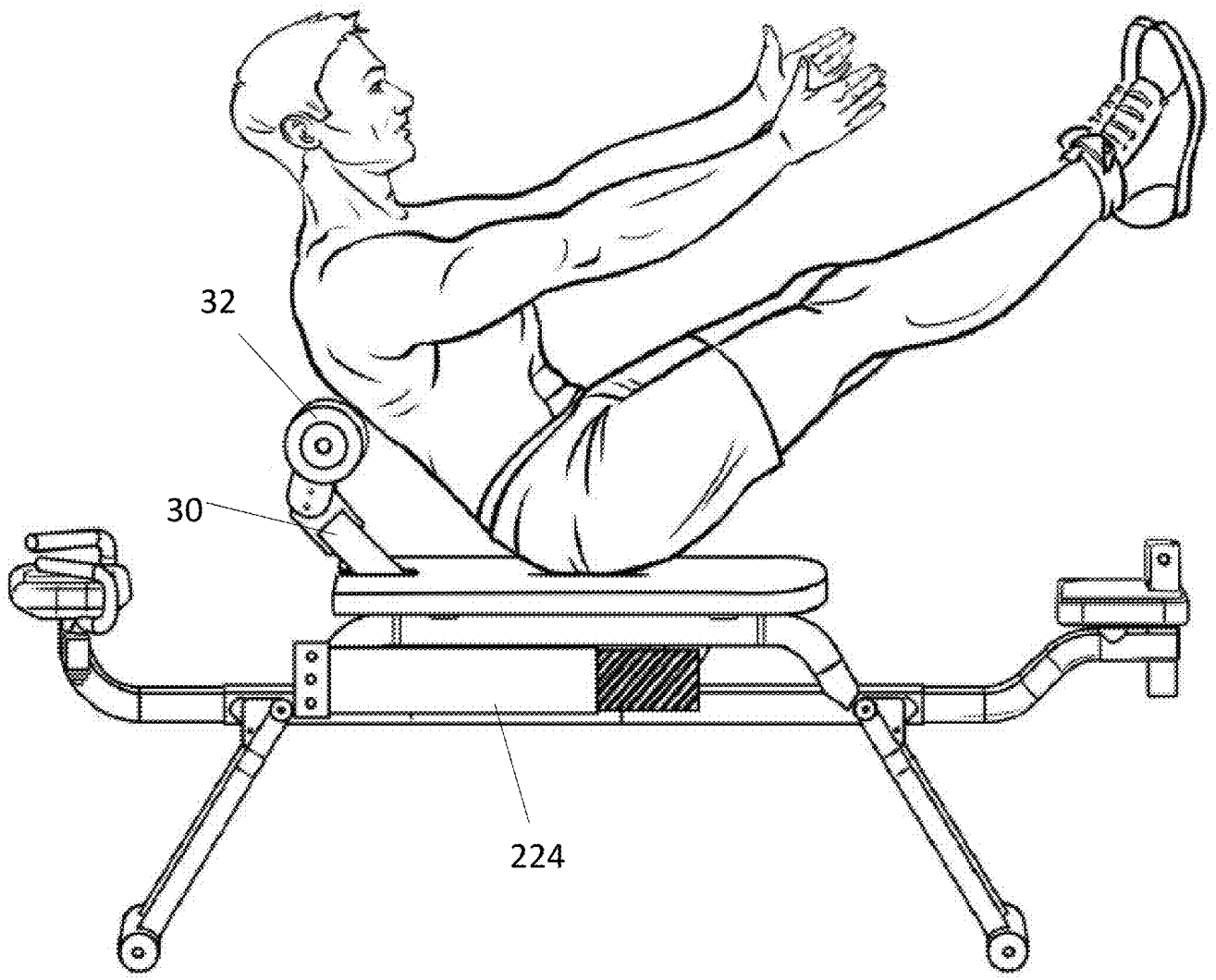
FIG. 67 is a side view of a user on the machine performing an assisted yoga half boat pose.

FIG. 67 is a side view of a user performing an assisted static yoga half boat pose exercise on the machine. In operation of this exercise the user sits on the machine and assumes the position shown. In this position, the user holds the legs in an isometric manner at a 45 degree or so angle and tries to hold their torso at the same angle with the aid of the machine. The force for this exercise originates from the head of the machine support 40 side of the machine and is anchored as part of or outside of the core support 20. When the user performs the exercise, the guide arm 30 has stored potential energy in it from its actions with the force producing element 24.

Figure 68:
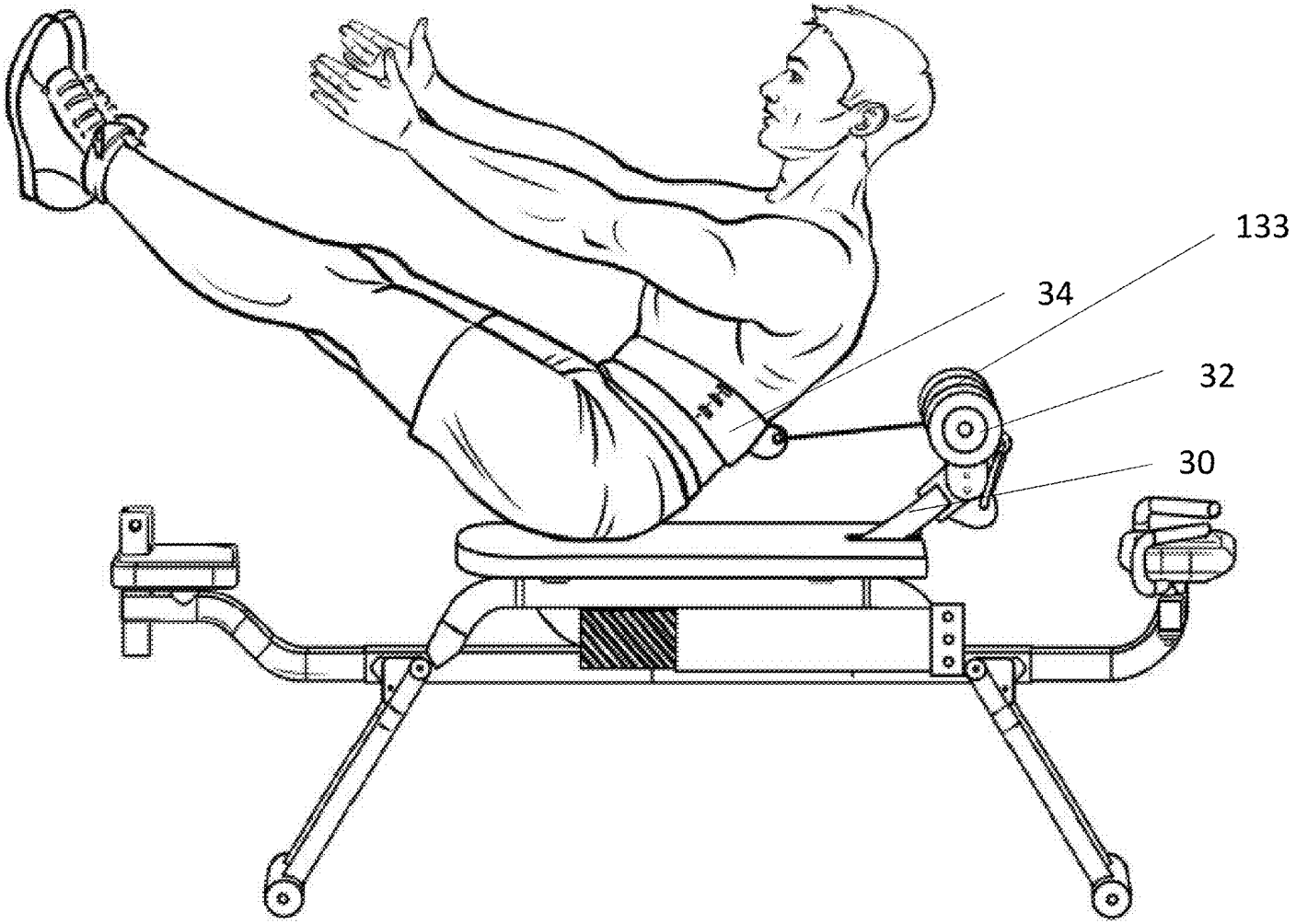
FIG. 68 is a side view of a user on the machine performing an added load yoga half boat pose.

FIG. 68 is a side view of a user performing an added load static yoga half boar pose exercise on the machine. This exercise is performed in the same manner described in FIG. 67 but the user is attached to a retractable harness 34. The harness creates tension, making it more difficult for the user to maintain this pose. Due to the increased difficulty, the user gets an increased core workout.

Figure 69:
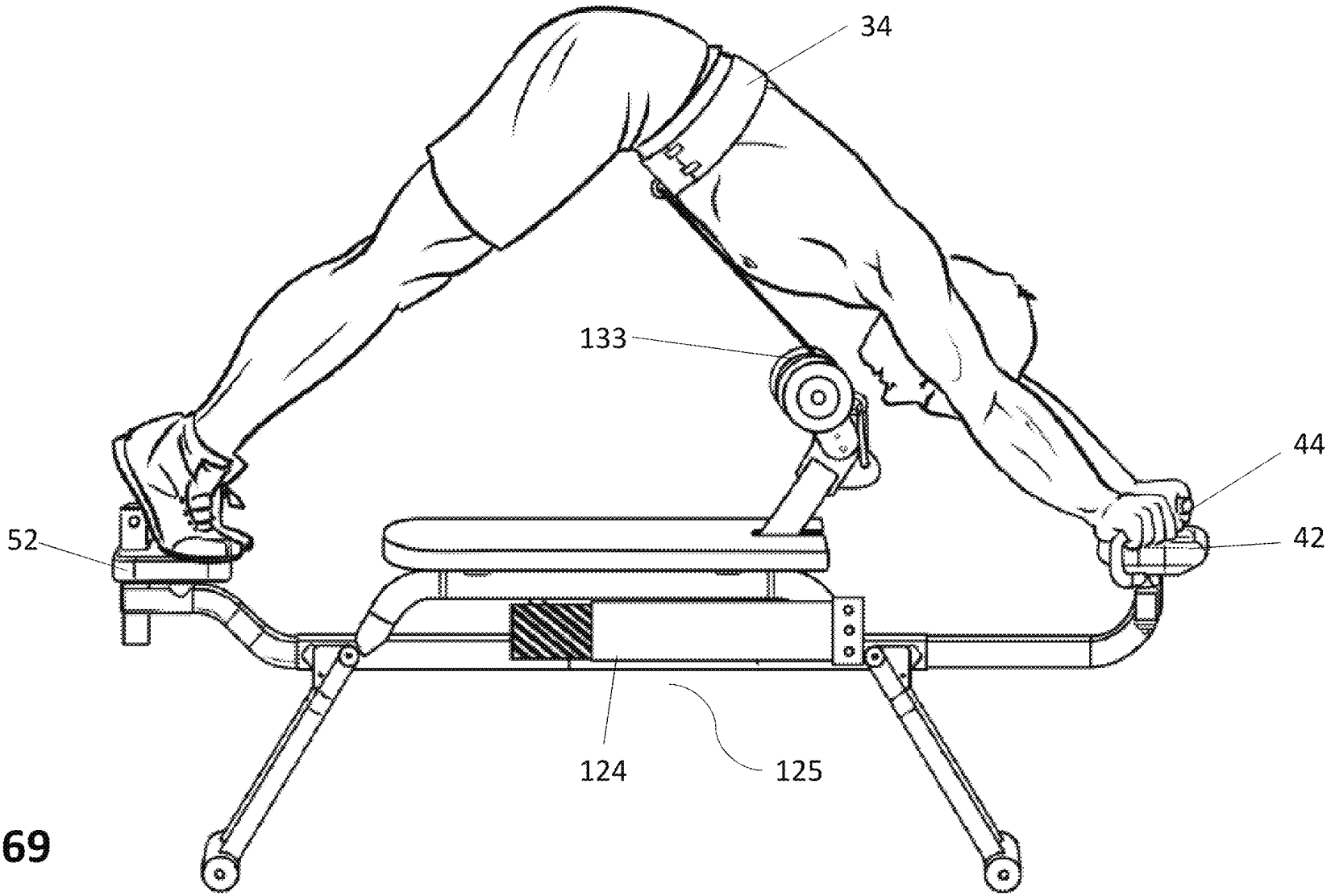
FIG. 69 is a side view of a user on the machine performing an added load downward dog yoga pose.

FIG. 69 is a side view of a user on the machine performing an added load downward dog pose exercise. In the performance of this exercise, the user is in the position illustrated. In the operation of the exercise the force originates from the foot support side of the machine and is part of or outside of the core support 22. The force is produced by the connection of the force element 125 to the insertion point on the bottom of the guide member 30. Said configuration increases the load when the exercise is performed and the user engages the machine much in the same manner as for an added load plank pose exercise, wherein the user reclines across the machine, and connects the machine at the guide arm pad 32, via a belt 34 or shoulder harness 35. Once connected, the user's feet are in contact with the foot element 54 and the foot pad 52, and their hands are on the handlebars 44 or plank pad 42.

In the operation of this exercise, the user starts in a down position and raises their hips as high as the can go while maintaining an inverted V-shape with their body and a connection with the foot element 52 and the handlebars 44. In the instant position, the user is pulling the guide arm off the frame of the machine 10 with their raised hips while machine 10 is under load. In executing this action, the user performs the exercise by resisting the machine 10 inclination to pull the hips of the user down or out of position much like the bird dog above. In concert with this activity, there is an interesting radiation of force through the feet into the legs, specifically the hamstrings up through the hips, the lower back, the upper back, the arms and eventually the hands. This can only really be experienced on the machine 10 and part of this different experience is that the user can push on both the foot element 52 and the inner surface of the handles. This accentuates the radiation of force through the entire body.

In yet another configuration, the user can flex the abdominal muscles as they push the back against the restraint caused by the belt 34 and this would not necessarily be the case if wearing a shoulder harness 35. Much like with the bird dog in FIG. 62 above the user needs to employ the use of slack in the system between the belt 34 or shoulder harness 35 and the retractable belt mechanism 33 as they perform these types of exercises.

Figure 70:
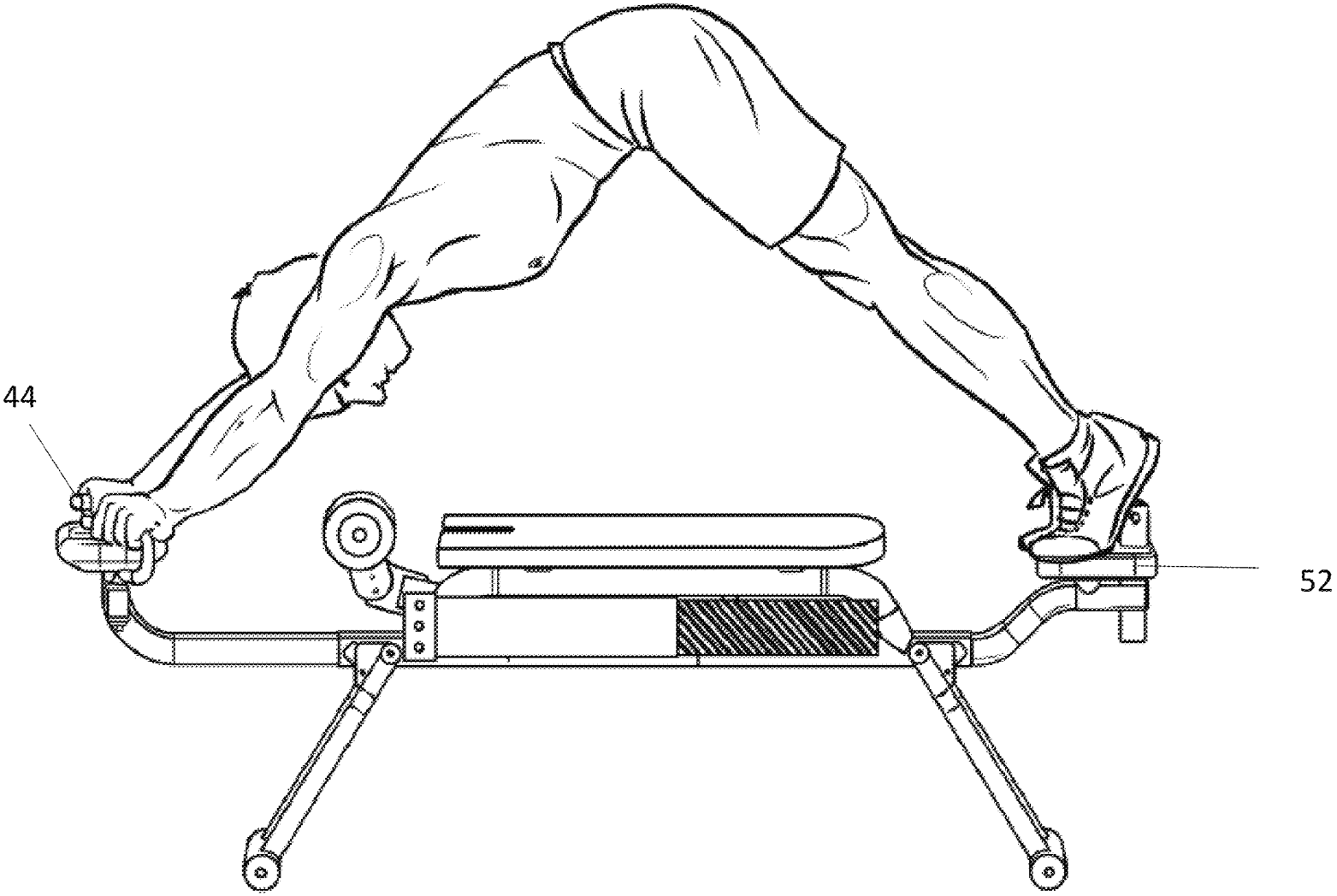
FIG. 70 is an isometric view of a user on the machine performing a downward dog yoga pose with no force hindering the user and just using the apparatus.

FIG. 70 is an isometric view of a user on the machine performing a downward dog pose exercise with no force connection to the machine. The machine at this point seems to be an apparatus, and a really good one for performing this exercise. This is much different than doing the exercise on the floor. The accentuated connection points between the hands and feet create an intensified connection between the entire kinetic chains of the body.

Figure 71:
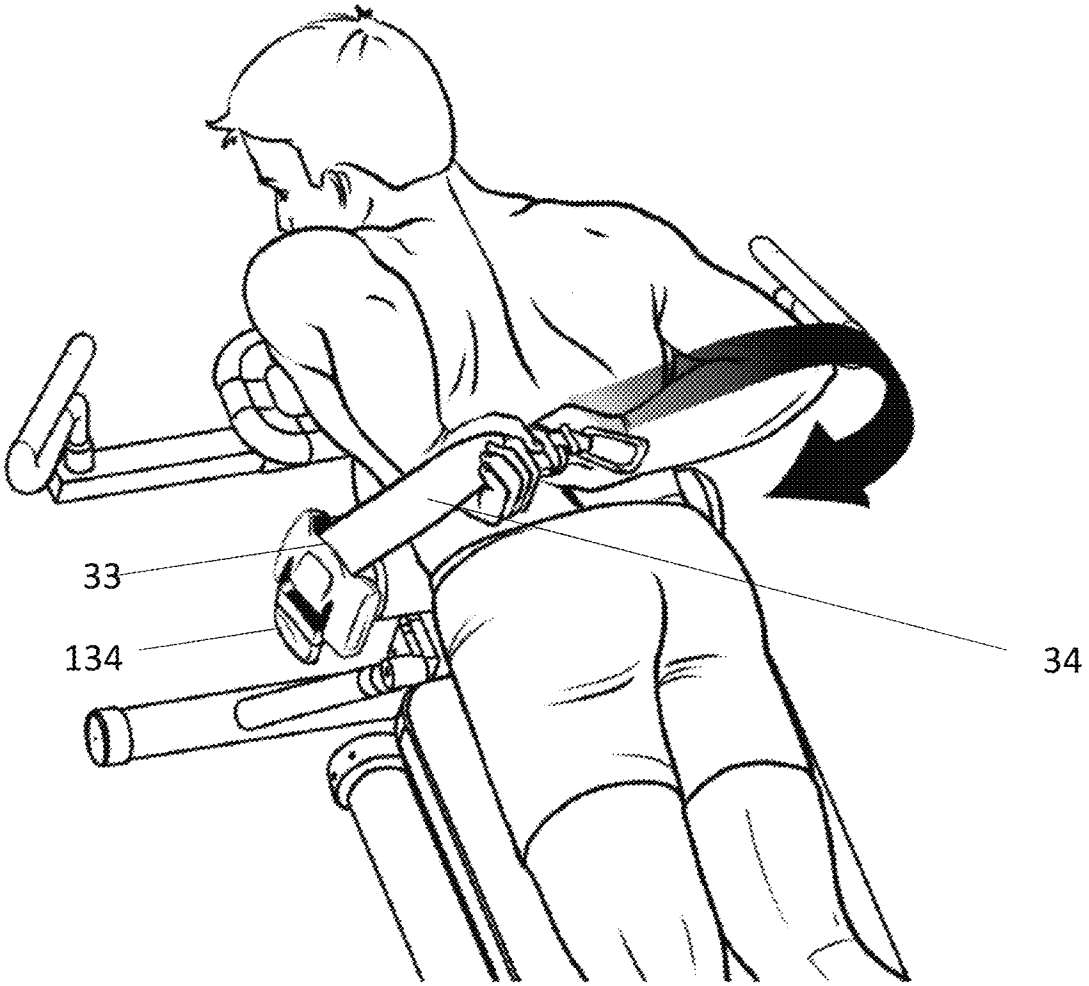
FIG. 71 is a back view of a user extending the retractable harness.

FIG. 71 illustrates the retractable harness 34 being extended from the harness retracting mechanism 33. Extending and retracting the harness is easy and can be accomplished with a single hand, as illustrated in the figure. The retractable harness can also be tightened through use of the harness ratcheting mechanism 134.

Figure 72:
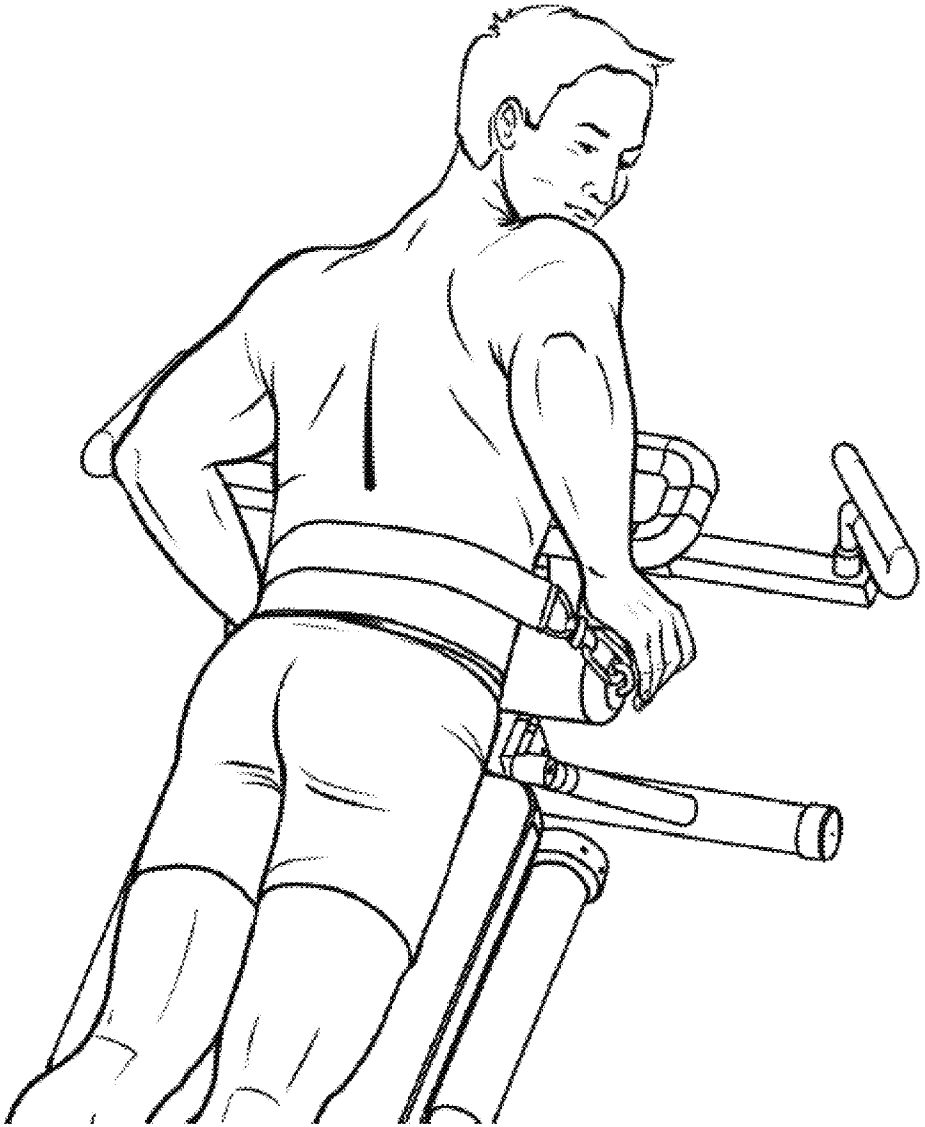
FIG. 72 is a back view of a user securing the retractable harness.

FIG. 72 illustrates the latching of the retractable harness using the harness latching mechanism 137. Additionally, FIG. 72 illustrates an embodiment of the harness with a harness pad 234.

Figure 73:
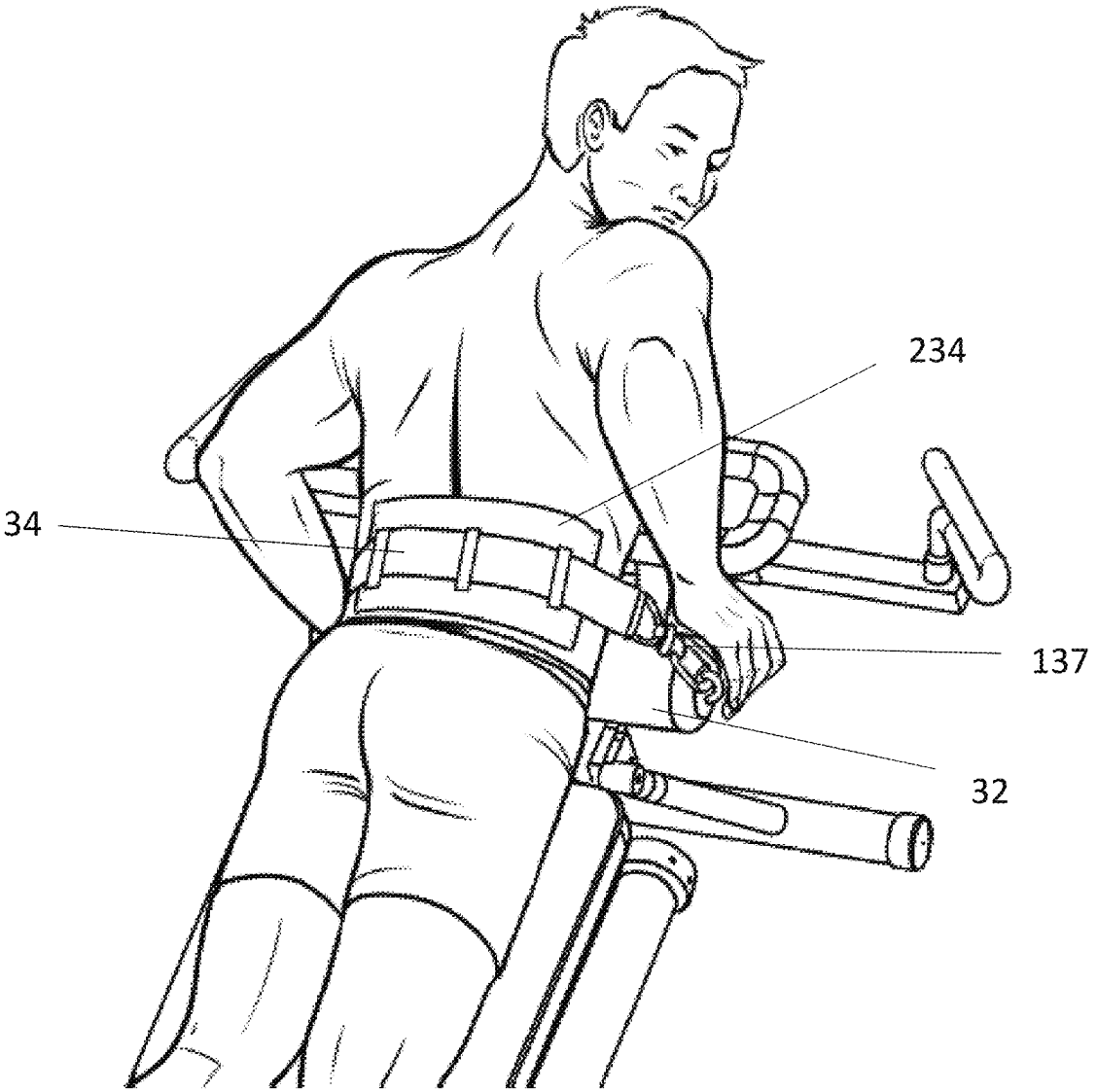
FIG. 73 is a back view of a user utilizing an embodiment of the harness containing a harness pad.

FIG. 73 is a back view of a user utilizing an embodiment of the harness containing a harness pad.

Figure 74B:
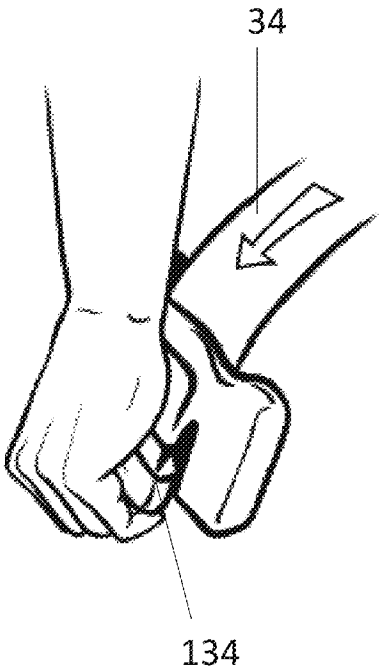
FIGS. 74A-74B are views of the harness ratcheting mechanism.
Figure 74A:
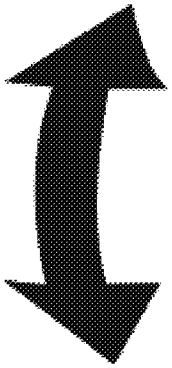
Figure 74A:
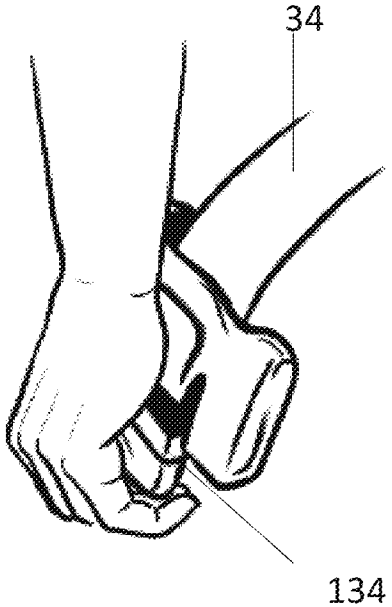

FIGS. 74A-74B are views of the harness ratcheting mechanism.

Figure 75:
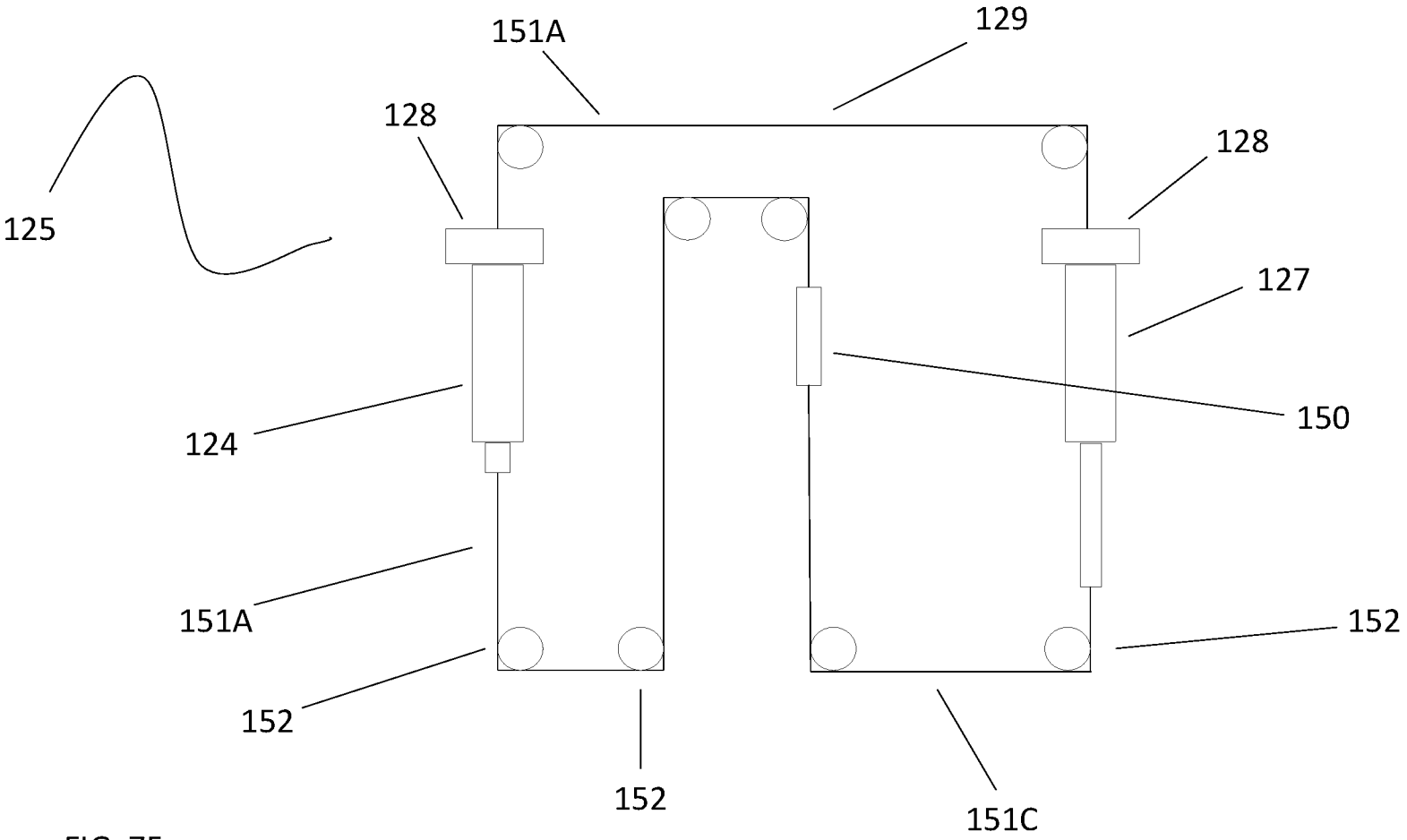
FIG. 75 is a view of the force component loop.

FIG. 75 illustrates an embodiment of a loop 129 as a force component 125 which allows for both assisted and added load systems in the same machine. The loop comprises at least two canisters 124, 224, wherein at least one canister is an added load canister 124 and at least one canister is an assisted canister 224, a trolley 150, and a guide cable 151 with at least three guide cable members 151*a*, 151*b*, 151*c*. The loop also has at least two cable guiding rotating members 152 at the front of the machine and dispersed in various spots on the front and back of the inner frame. The guide cable 151 is looped through the guiding rotating members 152 and connected to the trolley 150 and the two canisters 124, 125. One guide cable member 151*a* connects the back of one canister to the front end of the tang on the trolley. In the process, the guide cable member goes around at least two guide rotating members 152. A second guide cable member 151*c* connects the back end of the tang on the trolley to the back of a second canister. In the process of connecting the back end of the tang on the trolley to the back of a second canister, the guide cable member is looped through the guiding rotating members 152. A third guide cable member 151*b* connects the front end of the added load canister 124 to the front end of the assisted canister 224, once again engaging guiding rotational members 152 along the connection route.

Figure 76:
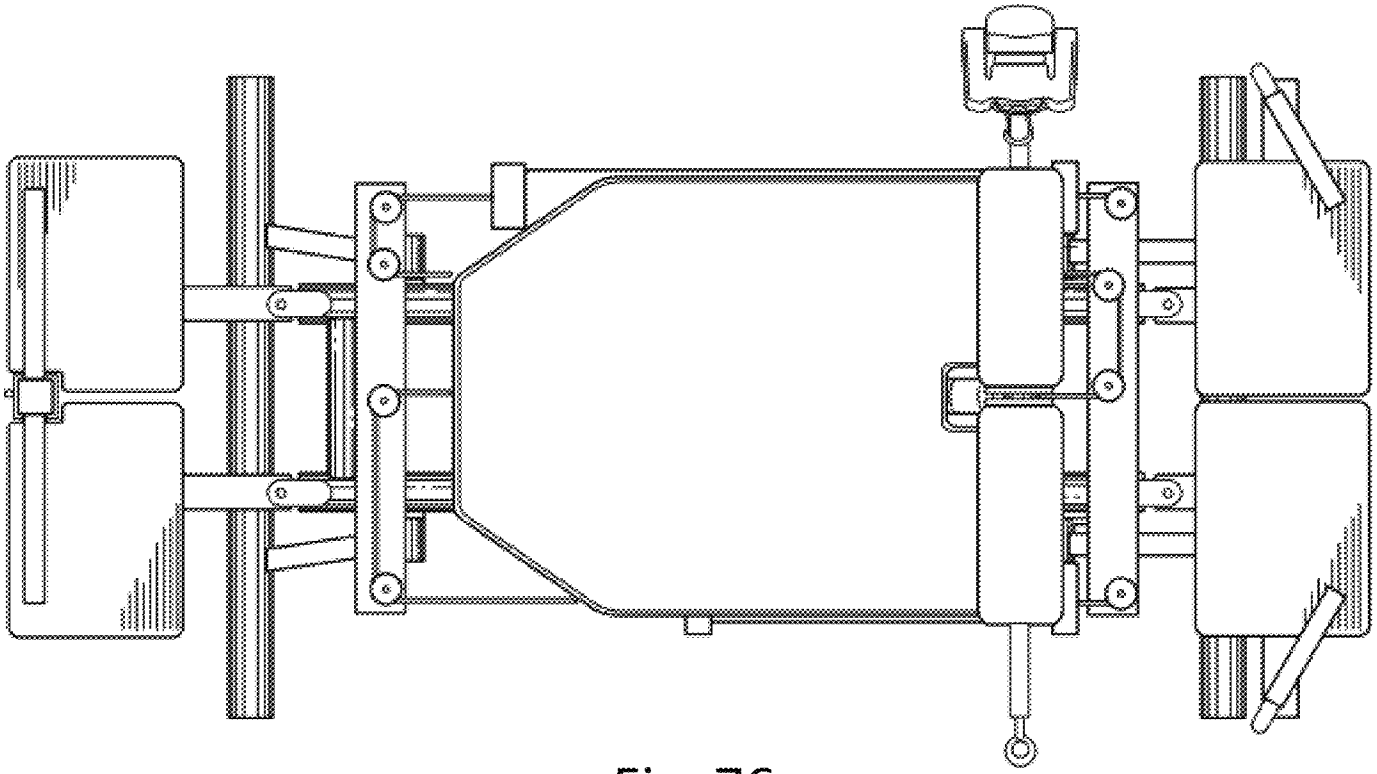
FIG. 76 is a view of one embodiment of the exercise machine with divided head and foot supports.

FIG. 76 illustrates one embodiment of the exercise machine comprising a divided foot support 350, divided foot support pad 352, divided head support 340, and divided plank support pad 342. In this embodiment, each half of the divided foot support 350 and head support 340 are attached to the main support frame 60 of the machine. The two halves of the divided foot support come together to surround the foot element positioner 56.

Figure 76A:
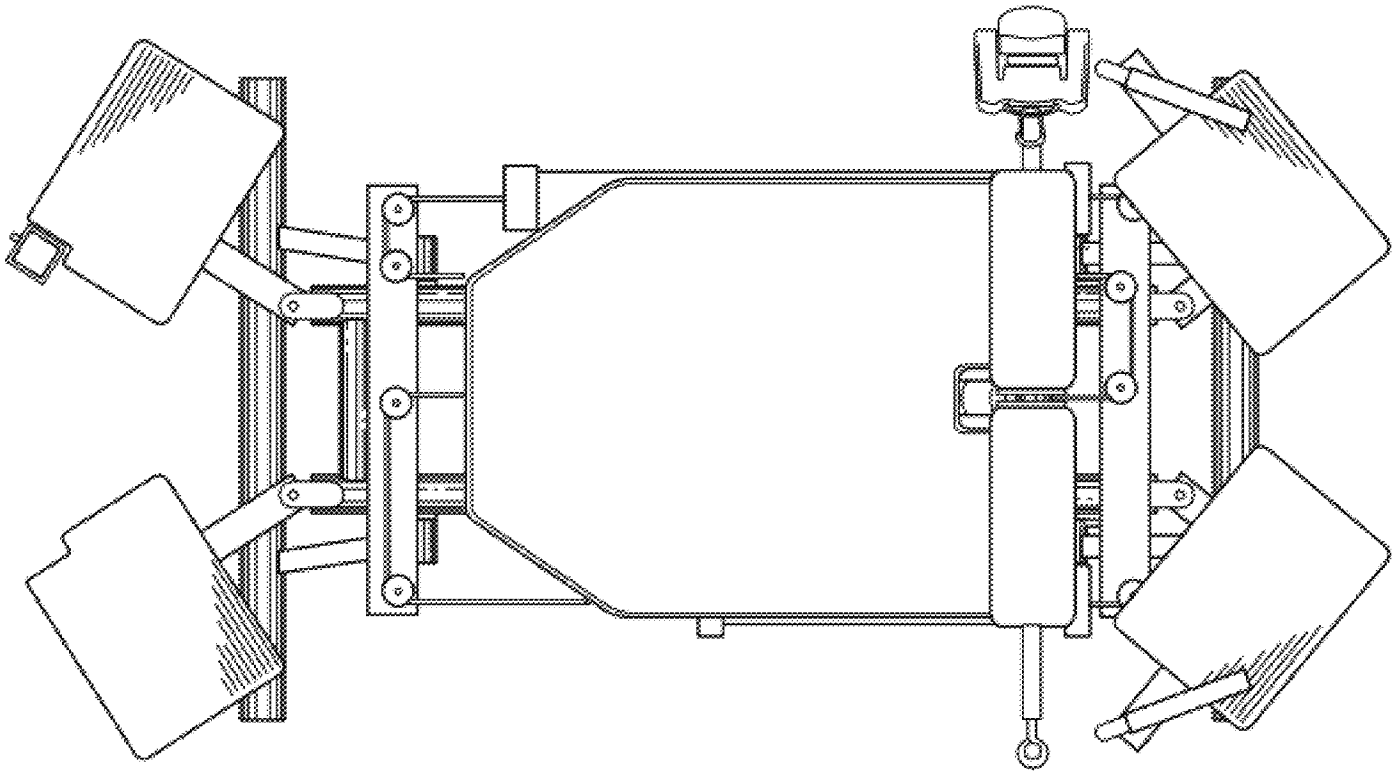
FIG. 76A is a view of the exercise machine with the divided support's rotated outward.

FIG. 76A illustrates the embodiment described in FIG. 76 with the two halves of the divided foot support 350 and the divided head support 340 rotated outwardly, which increases the distance between each half of the divided head support or divided foot support. Increasing the distance allows the user to vary the width and rotation of his or her hand or foot placement for exercise variations.

Figure 77:
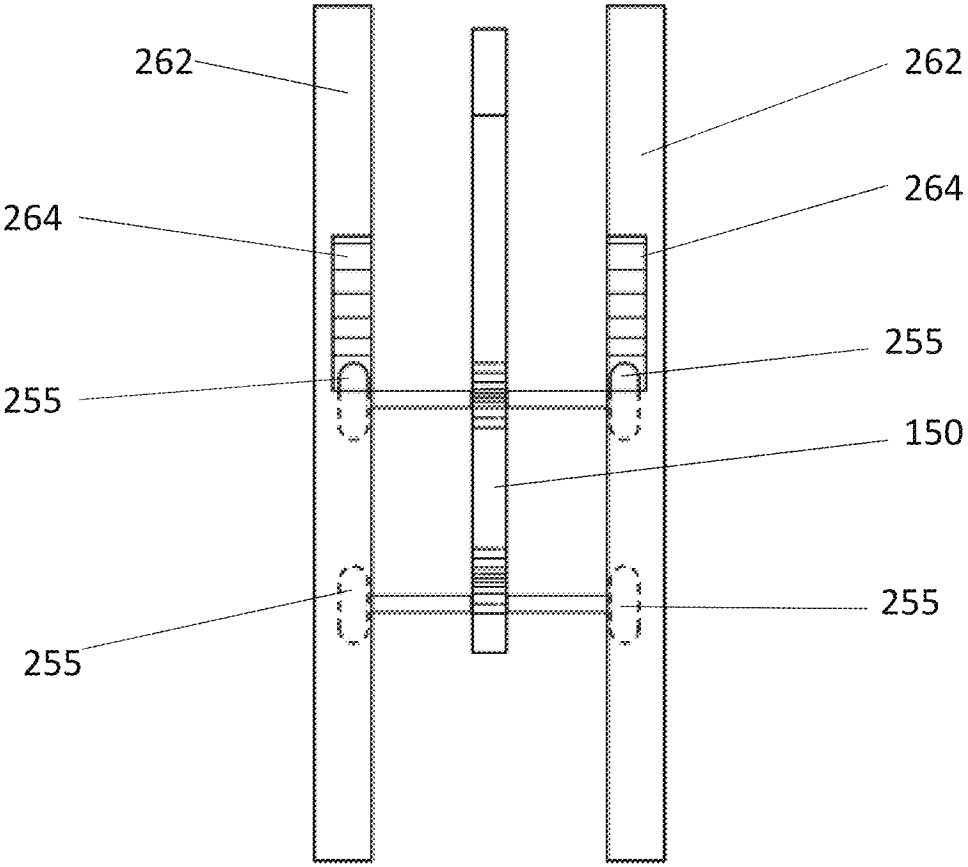
FIG. 77 is an embodiment of the trolley and rail system.

FIG. 77 illustrates an exploded view of an embodiment of the rail and trolley system. In this embodiment, the rails 262 are cut into two solid pieces of material whereby they create a channel 264. The trolley wheels are modified such that the modified trolley wheels 255 fit inside said channel 264. The channel is open on both sides on the tip so the trolley 150 and arm assembly can be fit in for operation.

Figure 78:
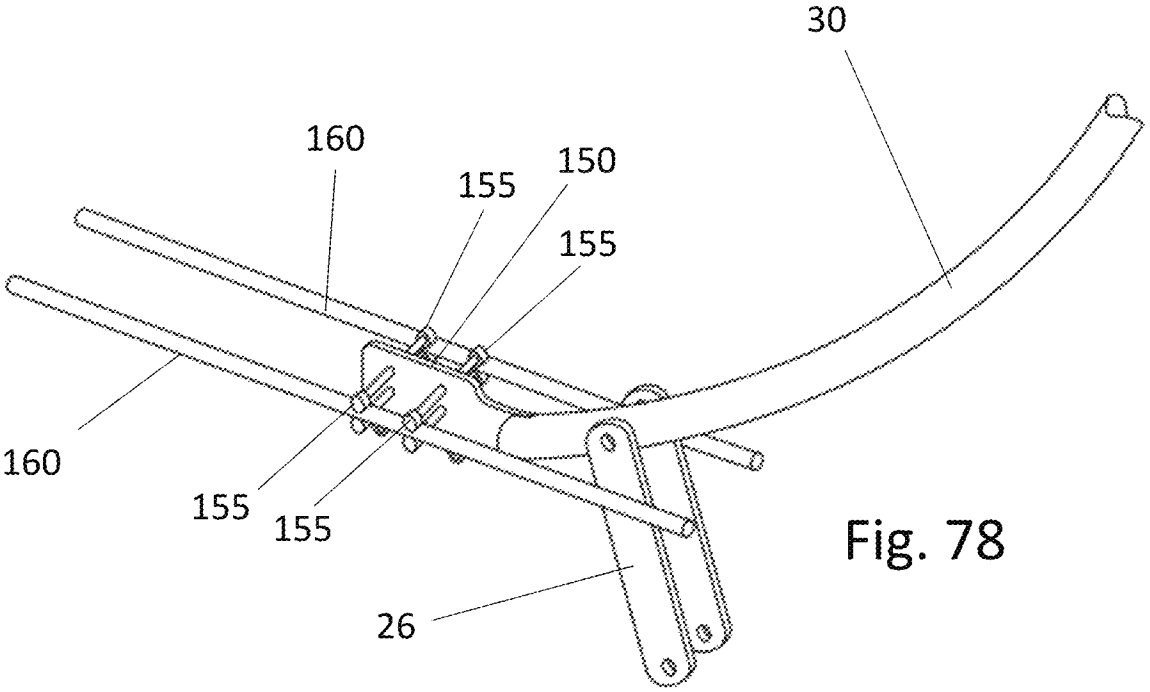
FIG. 78 is a view of an embodiment of the trolley and rail system with the guide arm.

FIG. 78 illustrates an exploded view of an embodiment of a trolley and rail system. It is comprised of the rails 160, the trolley 150 and guide arm 30. The trolley is comprised of at least two wheels 155 that hold it to the rails. The top wheels of the trolley are eccentric to help the wheels seat better on the rails.

Figure 79:
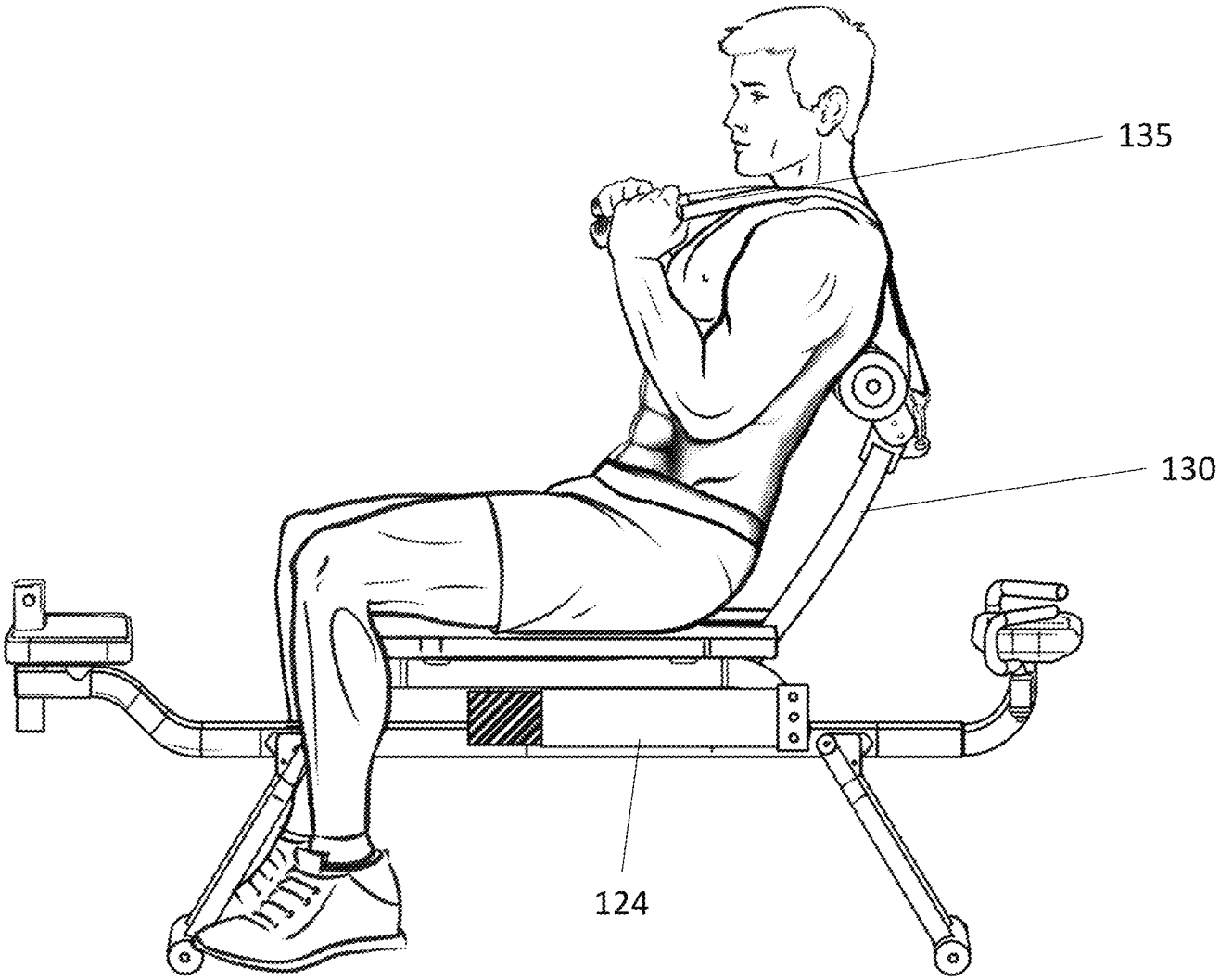
FIG. 79 is a side view of a user performing an added load vertical abdominal vacuum machine exercise.

FIG. 79 illustrates one embodiment of a vacuum exercise in which a user lifts his or her chest to train the intercostal muscles, including the serratus, and pull the abdomen up and in against the resistance of the machine. In this embodiment, the exercise is performed with an added load. To perform the exercise the user sits on the machine as shown in the figures. The user then attaches the harness 34 with an optional harness pad 234, engages the deep inner and lower abdominal musculature by creating a vacuum there and pulling said abdominal musculature up and in. Additionally, the user can lean backward with the machine pulling them. As this is happening, the musculature just mentioned along with the rib and chest supporting musculature resists the movement of the machine. Still further, the user can lift their chest as high as they can and tighten the whole area to affect, strengthen and form the musculature in said area. This exercise can also be performed with a concentration on just one side of the abdomen. Doing so makes the concentration right in the area of the oblique and hip flexor tie in.

Many other embodiments exist and can be included with moderate improvements or changes. For example, many different force configurations may be utilized in the construction and operation of this machine 10. In one possible embodiment, a rail system including a set of linear bearings connected to a force element connector, which actuates on rods, which are braced under the machine 10 is connected to the guide arm 30 via a link. In the operation of this force production mechanism the link moves the force element connector toward the foot support end of the machine 10. The force is originated or anchored inside or outside of the core support and the desired force is created by the number of elastic or spring elements selected. Separately spaced, but adjacent to the force element connector is the elastic or spring element selector.

Furthermore, in this embodiment the elastic or spring elements are housed between the force element connector and the rod brace originating in the head end of the machine 10. To select an elastic element to be used to produce a desired amount of force the user moves an elastic or spring element from the elastic or spring element selector to the force element connector. When the desired force is selected the movement of the guide arm 30, because of the action of the user causes the link to move the force element selector toward the foot end of the machine whereby the selected elastic or spring elements create tension in the whole mechanism. The elastic or spring elements not activated sit unstretched between the rod brace and the force element selector.

In another embodiment, the force element is a gas spring. The gas spring is affixed between rails of a truss or affixed to the bottom of the main central beam of the core support. This configuration has a link that connects the gas spring to the guide arm 30. In the way that the gas spring works there is relative relationship between the amount of force it produces and the angle of the guide arm 30. This relationship is caused by a crank mechanism which is housed in the back of central rail truss or the housing for the gas spring affixed to the bottom of the main central support beam of the core support. The more the gas spring is pushed forward by the crank mechanism the steeper the angle of the guide arm becomes. The steeper the angle, the more the male member of the gas spring retracts into the female member, thus producing more force. These elements of operation are thereby affected by the action of the user to perform the desired exercise.

In yet another embodiment the force configurations is a rail system force producing mechanism with linear bearings connected to a force element connector, which actuates on rods having head and foot rod braces. This mechanism is located under the body support pad 22 and is affixed to the underside of the components of the central support system. Said mechanism is connected to the guide arm 30 via a link. In the operation of this force production mechanism for assistance, the link moves the force element connector toward the foot support end of the machine being propelled by the action of the user. The force is originated and anchored to the rod brace of the head of machine support area 40 as part of the core support 20 and the desired force is created by the number of elastic or spring elements selected. Separately spaced, but adjacent to the force element connector is the elastic or spring element selector.

In the previously described embodiment, the elastic or spring elements are housed between the force element connector and the rod brace originating in the head end of the machine. To select an elastic element to be used to produce a desired amount of force the user moves an elastic or spring element from the elastic or spring element selector to the force element connector. When the desired force is selected the movement of the raised guide arm 30, because of the action of the user causes the link to move the force element selector toward the foot end 50 of the machine storing energy to assist the user, whereby the selected elastic or spring elements create tension in the whole mechanism. The elastic or spring elements not activated sit housed between the rod brace and the force element selector.

In yet another embodiment force configuration is bidirectional wherein the force element is a gas spring. Said gas spring will have metal members affixed on either end whose purpose is to act as contact points for the pins that will be used to vary the force. The gas spring is housed in the gas spring housing which is affixed to the bottom of the main central beam of the core support 20. This housing includes a series of holes on the head and foot end drilled through on the sides. The purpose of these holes is to create a way to change how much the gas spring compresses, therefore, changing the force it produces. The more it compresses the more force it produces. Said housing, also includes a slot along its bottom. This slot is for the engagement of the link between the gas spring and the guide arm 30. The linking member of this assembly is constructed so its head can fit inside the slot.

In the previously described embodiment, once the guide arm is inside the slot the head, the linking member is twisted by the operation of the twisting mechanism so it cannot come out of the slot. In operation, the head of the linking member will not be connected to, however will push against the gas spring. The gas spring will be varied in its force via the holes drilled through the sides of the head 40 and foot 50 areas of the gas spring housing. Pins will be placed in the holes depending on which direction the linking member will be going in according to the direction that the guide arm 30 will be going in for its intended use. In the operation of this configuration for assistive force, the pin is placed in the desired hole in the selection in the foot area 50 of the mechanism. The guide arm 30 is in the up position whereby any force produced is first stored in the mechanism when the user is at the bottom of the range of motion whereby the stored force is then imparted on the user to assist the user in the exercise.

The link of the guide member 30 has its head inserted into the slot. The amount of angle of the guide arm 30 determines the amount of assistive force that the mechanism will produce. This force is determined by where the pin is placed. The pins purpose is to act as a barrier and stop the gas spring from moving in its housing as the head of the linking member is pushing against it. The further the pin is set from the middle of the machine, the less steep the angle of the guide arm 30 the less force it will produce. The closer the gas spring head stops to the center of the machine the steeper the angle of the guide arm will be and the more assistive force it will produce in the operation of the mechanism. To reverse the direction of the machine and set it up for added load, the head of the linking member is twisted by the head twisting mechanism so the linking member can be removed from the slot.

Moreover, in this embodiment the guide member 30 will be placed in the downward position and the gas spring will be moved to the head of the machine side of the gas spring housing. A pin will be placed in the desired aperture or hole, to produce the desired force. The head of the linking member will be twisted again so it can fit in the slot. Once in the slot the twisting mechanism will twist the head and secure it in the slot. In the operation, the guide arm 30 is connected to the user. The action of the user instituting a pulling force on the guide member causes the linking member to contact the gas spring which is stopped in its desired location by the pin in the apertures of the gas spring housing. The closer the pin is set, the higher the guide arm pad 32 is off of the central support system and the less amount of resistive force can be produced. The farther away from the center of the machine that the pin is set, the closer the guide arm pad is to the central support system the more the gas spring compresses thereby producing more force.

In an alternate embodiment of this force producing mechanism crank mechanism can be utilized to vary the force. Simply put, instead of the apertures and pin configuration, a crank can be twisted to a stop position and establish the relationship between the angle of the guide, the linking member and the gas spring, thereby varying the type and amount of force.

To illustrate the overall operation of the one exemplary embodiment of the system, the three main support members 20, 40, 50 provide user support in performing certain exercises. The body support pad 22 in conjunction with the foot pad 52 and safety pad support the user's body while doing certain closed chain exercises with the exercise equipment 10. The guide arm 30 and guide arm pad 32 provide the user with greater stability and ensures proper posture while doing certain exercises. Further the guide arm 30 provides counterbalances or increases the load to the user and may be positioned in either an up position or a down position respectively. In an alternate embodiment of the invention, there may be an additional harness 34 or 35 component to allow the use to stay connected to the machine during certain exercises, such as planks, push-ups and bird dog exercises to provide the user with additional resistance than what their body provides naturally. In yet another embodiment, the invention may include additional and auxiliary user supports and allow for adjustable positioning of the guide arm 30 to match adjustments of the auxiliary supports.

The force component 24 may comprise any device known to one skilled in the art such as elastic cords, coil springs (extension or compression), torsion systems, gas springs (extension or compression), or any combination thereof, that is mechanically connected to both the guide arm and core support. Minor adjustments to the force component allow for small changes in the tension experienced by the user. In some iterations, large changes in force between sets is greatly felt, therefore, the user fatigues too quickly and the benefits of the machine 10 are diminished, which may cause frustration for those who are just beginning or out of shape. Conversely, said large changes in force between sets may be embraced by avid users and elite athletes because of the neuromuscular shock such large changes in stimuli produce.

In an alternate embodiment of the system, the force component 24 is connected to the guide arm 30 in an alternate location outside the core support 20, this connection is telescopically adjusted between the head of the machine support 40 and the guide arm 30. As the head of machine support 40 is adjusted outward from the core support 20 the angle of the guide arm becomes steeper therefore, producing more assistive force. As the head of machine support 40 is adjusted closer to the core support 20 the angle of the guide arm 30 becomes less steep therefore, producing less assistive force. These actions are characterized as the machine producing assistive force relative to the length and size of the user. On the foot support 50 end of the machine, as the force component anchor is adjusted further away from its insertion on the bottom of the guide arm 30, more force added load force is produced. These actions are characterized as the machine producing more added load force relative to the length and size of the user.

In yet another alternate embodiment of the system, the exercise equipment 10 is pneumatically powered and the force component is able to be changed while in operation. In yet another alternate embodiment of the invention, the force component and guide arm position are adjusted with a crank mechanism. Further still in another embodiment of the system, a rail system with a force element connector that is actuated by linear bearings, and connected to the guide arm 30 via a linking member is constructed under the user support pad 22 main central support beam and core support beam. In still another embodiment of the invention, there is no force component.

The position and shape of the safety pad 42 provides superior support to the user in performing certain exercises, such as the plank exercise, and is integral in providing safety for the user while performing push-ups there is no way for the user to smash their face. Additionally, this support/safety pad 42 is essential when the user is connecting to the machine to perform added load type exercises wherein the guide member 30 is in a down position and under load. The user needs to rest on said plank pad 42 to be able to have their hands free so they can lock the retracting connection device 33, whether that device be part of the machine or part of a belt 34 or shoulder harness 35. Also, this pad/support 42 creates a very comfortable, structured and innovative way for a user to have many close grip options for doing both assistive and added load push-ups. In the art it has been very difficult to achieve comfortable and stable hand positioning as is seen with this new improvement in the exercise as a whole.

The handlebars 44 are capable of being adjusted to a variety of positions, both rotationally to adjust the position of the user's hand and by telescoping laterally in and out of the head of machine support 40 to adjust the width of the user's grip, in order for the user to most optimally perform certain exercises, such as the push-up exercise, as well as adjust the level of difficulty for the user. In an alternate embodiment of the invention, the handlebars 44 may be locked into position with screw locks, or pop pin plunger devices.

The foot support 50 particularly provides stability for the user while performing closed chain exercises. The position of the foot element 54 ensures proper foot placement of the user in certain exercises, such as the push-up, plank and birddog exercises. In an alternate embodiment of the invention, the foot pad 52 and/or the foot element 54 may have resistive surfaces. In another embodiment of the system, the foot element 54 may be positioned at different heights. In still another embodiment of the invention, greater than one foot element may exist at varying heights.

In yet another alternate embodiment of the system, additional foot supports, that do not extend towards the user, may be placed above the foot element. In an alternate embodiment of the invention, the foot element 54 and foot element positioner 56 may be folded down for lower profile storage.

Other embodiments of the system may include variations on stability in the head of machine support 40 and foot support 50. The exercise equipment 10 is also foldable as seen in FIGS. 18 and 29, providing the user convenience in storing and transporting it. In an alternate embodiment of the invention, it is capable of folding multiple times for a smaller footprint storing. Other embodiments may include lighter weight materials to even further improve the user's ease of transporting it.

As stated above FIG. 19 depicts the foldability and ease of transport of the preferred embodiment.

The foregoing descriptions of specific embodiments of the present invention are presented for purposes of illustration and description. They are neither intended to be exhaustive nor to limit the invention to the precise forms disclosed, and obviously, many modifications and variations are possible in light of the above teaching. The embodiments were chosen and described in order to best explain the principles of the invention and its practical application, to thereby enable others skilled in the art to best utilize the invention and its various embodiments with various modifications as are suited to the particular use contemplated. It is, of course, not possible to describe every conceivable combination of components or methodologies for purposes of describing the claimed subject matter, but one of ordinary skill in the art may recognize that many further combinations and permutations of the claimed subject matter are possible. It is intended that the scope of the invention be defined most broadly by the specifications and the figures appended hereto and their equivalents. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A multipurpose exercise apparatus providing support and varied tension for use in strength training exercises comprising:

a head support, wherein the head support is configured to be adjusted telescopically, and further comprises:

a plank safety pad;

a foot support, wherein the foot support is configured to be adjustable telescopically, and further comprises:

a foot support pad;

a main support frame;

a core support, wherein the core support runs perpendicularly to the main support frame, and further comprises:

a body pad, wherein the body pad is located over the core support;

at least two legs, wherein the at least two legs elevate the multipurpose exercise apparatus from a ground surface;

a guide arm, wherein the guide arm is attached to the core support by at least one fulcrum;

a guide arm pad, wherein the guide arm pad envelopes the guide arm; and a force component, wherein the force component is configured to allow a user to vary a tension between exercise movements.

2. The multipurpose exercise apparatus of claim 1, further comprising a foot element positioner positioned vertically through the foot support pad;

a foot element connected vertically through the foot element positioner for supporting a user's feet on the foot support pad.

3. The multipurpose exercise apparatus of claim 2 further comprising an auxiliary foot support connected to the foot support area and the foot element positioner for purposes of elevating the user's feet during exercise.

4. The multipurpose exercise apparatus of claim 2 wherein the foot element or foot support pad has resistive surfaces.

5. The multipurpose exercise apparatus of claim 2 wherein the foot element and foot element positioner is configured to be folded down for a lower storage profile.

6. The multipurpose exercise apparatus of claim 1, wherein the force component is located below the core support and connected to an insertion point of the guide arm.

7. The multipurpose exercise apparatus of claim 1, wherein the force component further comprises:

at least two canister units, wherein at least one of the least two cannister units is an assisted canister and at least one of the at least two cannister units is an added load canister, wherein each canister of the at least two cannister units further comprises:

a female canister; and a male canister, wherein a diameter of the male canister is smaller than a diameter of the female canister such that the male canister is configured to be moved into and out of the female canister;

a guide cable further comprising at least two guide cable members;

at least one trolley connected to the added load canister and the assisted canister via the at least two guide cable members;

at least two guiding rotating members, wherein the guide cable passes through at least one of the at least two guiding rotating members to connect the assisted canister to the trolley;

at least two sheaves, wherein the at least two sheaves are connected to the top of each of the male canisters and the at least two sheaves are further connected to at least one of the at least two guide cable members;

wherein as the male canister starts to move out of the corresponding female canister in one of the at least two canister units, the male canister in the other of the at least two canister units starts to move into the corresponding female canister, such that when one of the at least two canister units is active, the other of the at least two canister units is inactive so that the active canister unit of the least two canister units pulls the inactive canister unit of the at least two canister units.

8. The multipurpose exercise apparatus of claim 1, further comprising handlebars removably connected to the head support which are capable of being adjusted rotationally and telescopically.

9. The multipurpose exercise apparatus of claim 1, further comprising auxiliary handlebars connected to the head support area and arching over the plank safety pad for use in assisted supine pull-ups and added load supine pull-ups.

10. The multipurpose exercise apparatus of claim 1, wherein the guide arm is pivotally connected to the main support frame.

11. The multipurpose exercise apparatus of claim 1, wherein the guide arm is connected to the center of the core support and is configured to be raised or lowered.

12. The multipurpose exercise apparatus of claim 1, further comprising:

a belt harness; and a retractable harness connection;

wherein the retractable harness connection is located in the guide arm pad.

13. The multipurpose exercise apparatus of claim 1, further comprising a shoulder harness; and a retractable harness connection;

wherein the retractable harness connection is located in the shoulder harness or the guide arm pad.

14. The multipurpose exercise apparatus of claim 1, wherein the multipurpose exercise apparatus is foldable to be more easily stored and carried.

* * * * *